US010675549B1

(12) United States Patent
Warner et al.

(10) Patent No.: US 10,675,549 B1
(45) Date of Patent: Jun. 9, 2020

(54) SELF-SEALING BALLOON AND METHOD OF MANUFACTURE

(71) Applicants: Wesley Warner, Anaheim, CA (US); Troy Stark, Weston, FL (US)

(72) Inventors: Wesley Warner, Anaheim, CA (US); Troy Stark, Weston, FL (US)

( * ) Notice: Subject to any disclaimer, the term of this patent is extended or adjusted under 35 U.S.C. 154(b) by 0 days.

(21) Appl. No.: 16/450,950

(22) Filed: Jun. 24, 2019

Related U.S. Application Data

(63) Continuation-in-part of application No. 15/798,309, filed on Oct. 30, 2017, now Pat. No. 10,328,353, which is a continuation-in-part of application No. 14/930,646, filed on Nov. 2, 2015, now Pat. No. 9,844,737, which is a continuation-in-part of application No. 13/952,608, filed on Jul. 27, 2013, now Pat. No. 9,174,141.

(60) Provisional application No. 62/103,520, filed on Jan. 14, 2015, provisional application No. 61/676,969, filed on Jul. 29, 2012.

(51) Int. Cl.
*A63H 27/10* (2006.01)

(52) U.S. Cl.
CPC ..... *A63H 27/10* (2013.01); *A63H 2027/1041* (2013.01)

(58) Field of Classification Search
CPC ..... A63H 27/10; A63H 2027/1041; A63H 2027/1025; F17C 13/06; F17C 5/06
See application file for complete search history.

(56) References Cited

U.S. PATENT DOCUMENTS 2,553,513 A * 5/1951 Denison ..... B65D 75/54 426/119
2,597,924 A * 5/1952 Davenport ..... A41C 3/105 450/38
3,088,242 A * 5/1963 Rockovits ..... A63H 27/10 446/220
3,108,396 A * 10/1963 Dorman ..... F16K 15/20 446/220
3,262,244 A * 7/1966 Cutler ..... B65B 9/12 53/551
4,560,360 A * 12/1985 Isaacs ..... A63H 27/10 446/222
4,681,138 A * 7/1987 Giuliani ..... A63H 27/10 137/516.29

(Continued)

FOREIGN PATENT DOCUMENTS

WO WO 88/05328 7/1988
WO WO 90/00430 1/1990

*Primary Examiner* — Jeffrey S Vanderveen
(74) *Attorney, Agent, or Firm* — Allen D. Hertz, P.A.; Allen D. Hertz

(57) ABSTRACT

A method of forming a self-sealing balloon by applying an adhesive to a balloon form, then applying material to the balloon form to create the balloon. The adhesive is applied forming an annular adhesive ring. The adhesive can be applied using a fiberization process. The balloon form can be rotated during the adhesive application process. The adhesive can be encapsulated within an adhesive staging segment formed within a neck segment of the balloon. Airflow can be directed to the interface between an unfinished lip of the balloon material and the surface of the balloon form to aid in at least one of a forming process and a release process. The adhesive ring can be at least partially encapsulated within an adhesive staging segment of the balloon neck segment.

20 Claims, 41 Drawing Sheets

(56) References Cited

U.S. PATENT DOCUMENTS 4,911,379 A 3/1990 Kopelman
5,084,061 A 1/1992 Gau et al.
5,121,595 A * 6/1992 Shore ..... A63H 27/10 141/173
5,188,558 A * 2/1993 Barton ..... A63H 27/10 446/220
5,282,930 A * 2/1994 Lang ..... A63H 27/10 156/289
5,295,892 A * 3/1994 Felton ..... A63H 27/10 446/220
5,334,072 A * 8/1994 Epstein ..... A63H 27/10 446/220
5,769,683 A * 6/1998 Park ..... A63H 27/10 24/304
5,776,291 A * 7/1998 Lang ..... A63H 27/10 156/290
6,015,472 A * 1/2000 Garcia ..... A63H 27/10 156/290
6,183,591 B1 2/2001 Lang
7,963,285 B2 * 6/2011 Attila ..... A61F 6/00 128/844
8,349,417 B2 * 1/2013 Heffernan ..... A61M 29/02 428/35.2
9,174,141 B2 * 11/2015 Warner ..... A63H 27/10
2002/0158466 A1 * 10/2002 Jones ..... F16L 37/0845 285/105
2004/0049099 A1 * 3/2004 Ewers ..... A61B 1/32 600/206
2005/0176339 A1 * 8/2005 Cuisinier ..... A63H 27/10 446/220
2007/0102601 A1 * 5/2007 Thompson ..... A47G 1/175 248/205.1
2007/0167107 A1 7/2007 li et al.
2009/0242450 A1 10/2009 Zhang et al.
2009/0277458 A1 * 11/2009 McCarthy ..... A61F 6/04 128/844
2010/0255226 A1 * 10/2010 Heffernan ..... A61M 29/02 428/34.1
2011/0030697 A1 * 2/2011 Thompson ..... A61F 6/04 128/844
2011/0098615 A1 * 4/2011 Whalen ..... A63B 21/00181 601/151
2011/0151744 A1 * 6/2011 Archer ..... A63H 27/10 446/222
2013/0019374 A1 * 1/2013 Schwartz ..... A61F 5/00 2/69
2014/0116907 A1 * 5/2014 Holstein ..... A61F 13/0008 206/441
2014/0371672 A1 * 12/2014 Pinchuk ..... A61M 25/10185 604/99.02

* cited by examiner

SELF-SEALING BALLOON AND METHOD OF MANUFACTURE

CROSS-REFERENCE TO RELATED APPLICATION

This Non-Provisional Patent Application claims a common domestic benefit as follows:

wherein this Non-Provisional Utility Patent Application is a Continuation-In-Part claiming the benefit of U.S. Non-Provisional patent application Ser. No. 15/798,309, filed on Oct. 30, 2017 (scheduled to issue as U.S. Pat. No. 10,328,353 on Jun. 25, 2019), wherein U.S. Non-Provisional patent application Ser. No. 15/798,309 is a Continuation-In-Part claiming the benefit of U.S. Non-Provisional patent application Ser. No. 14/930,646, filed on Nov. 2, 2015 (now issued as U.S. Pat. No. 9,174,141 on Nov. 3, 2015), wherein U.S. Non-Provisional patent application Ser. No. 14/930,646 claims a domestic benefit under multiple branches as follows:

A) wherein U.S. Non-Provisional patent application Ser. No. 14/930,646 is a Continuation-In-Part claiming the benefit of U.S. Non-Provisional patent application Ser. No. 13/952,608, filed on Jul. 27, 2013 (now issued as U.S. Pat. No. 9,174,141 on Nov. 3, 2015), and wherein U.S. Non-Provisional patent application Ser. No. 13/952,608 is a Non-Provisional Patent Application which claims the benefit of U.S. Provisional Patent Application Ser. No. 61/676,969, filed on Jul. 29, 2012; and B) wherein U.S. Non-Provisional patent application Ser. No. 14/930,646 is also a Non-Provisional Patent Application which claims the benefit of U.S. Provisional Patent Application Ser. No. 62/103,520, filed on Jan. 14, 2015, C) wherein the entireties each of above the above applications are incorporated herein by reference.

FIELD OF THE INVENTION

The present invention relates to a self sealing balloon assembly and method of manufacturing the same, and more particularly, a rubber or latex balloon having a moldable adhesive loop embedded within an adhesive staging segment formed as an annular loop within a neck segment of a balloon.

BACKGROUND OF THE INVENTION

Balloons are designed having a variety of shapes and sizes and are fabricated of any of a wide selection of suitable gas impervious materials, including: Mylar, latex, rubber, and the like. A pressurized gas, such as air, helium, nitrogen, and the like is used to inflate the balloon. The pressurized gas enters a balloon gas retaining expansion cavity through a balloon neck segment. The pressurized gas expands the balloon gas retaining expansion cavity. The pressurized gas is retained within the expanded balloon gas retaining expansion cavity by sealing a fill conduit provided through the balloon neck segment. This is commonly accomplished by tying a knot in the balloon neck segment.

The process of sealing pressurized gas within the expanded balloon gas retaining expansion cavity by tying a knot in the balloon neck segment presents a number of drawbacks. Initially, the process is very tedious and time consuming. The cycle time for the process of tying each balloon neck impacts the overall efficiency and profit for balloon preparation party. Once the neck of the balloon is tied into a knot, it is nearly impossible to untie the knot in order to deflate and reuse the balloon.

Latex balloons are formed by applying latex, in a liquid form, onto a balloon form and curing the latex. The elasticity of the latex enables removal of the formed and cured balloon from the balloon form. Mylar balloons are fabricated by adhering two sheets of Mylar together in accordance to a predetermined peripheral shape. Characteristics of the Mylar material direct the balloon fill process away from tying a knot in the neck segment. Conversely, tying a ribbon or similar material about the neck segment can seal the neck segment. Alternative sealing devices, such as sealing clips, and the like can be used to seal the neck segment.

In one known embodiment, a layer of adhesive tape is placed on an interior surface of the neck of the balloon. The adhesive tape is covered with a protective coating, which is removed when ready for use. The adhesive tape requires two planar surfaces to come together and join in a manner to provide a gaseous seal therebetween. Drawing two planar sheets of adhesive together to create a gaseous seal therebetween can be difficult. Any wrinkle or gap would provide an imperfection in the gaseous seal therebetween, thus creating a gas leak. Additionally, the adhesive tape can't be separated, thus eliminating any potential for deflating and reusing the balloon.

Accordingly, there remains a need in the art for a self-sealing balloon that provides a feature enabling a quick, reliable sealing process that can be separated, enabling deflation and reuse of the balloon.

SUMMARY OF THE INVENTION

The present invention overcomes the deficiencies of the known art and the problems that remain unsolved by providing an apparatus and method for quickly and reliably sealing a balloon.

In accordance with one embodiment of the present invention, the invention consists of a balloon comprising:

a balloon body having a tubular balloon neck segment extending in fluid communication between a balloon unfinished edge and a balloon gas retaining expansion cavity;

a moldable adhesive ring carried by an interior of the tubular balloon neck segment, the moldable adhesive ring having a moldable adhesive cross sectioned profile formed into a ring shape, the moldable adhesive ring circumscribing an interior circumference of a portion of a length of the interior of the tubular balloon neck segment; and an adhesive staging segment formed about a peripheral surface of the moldable adhesive cross sectioned profile of the moldable adhesive ring, the adhesive staging segment temporarily covering the peripheral surface of the moldable adhesive cross sectioned profile, wherein the adhesive staging segment is shaped from the tubular balloon neck segment.

In one aspect, the moldable adhesive has a pliable characteristic resembling clay.

In another aspect, the moldable adhesive is dispensed about a circumference of a balloon neck mold segment of a balloon form member. The moldable adhesive preferably forms a ring about a central, longitudinal axis of the balloon neck mold segment.

In yet another aspect, the adhesive staging segment is designed to expose the moldable adhesive ring when a tensile force is applied in a longitudinal direction between ends of the tubular balloon neck segment.

In yet another aspect, the adhesive staging segment is shaped as a loop covering the peripheral surface of the moldable adhesive cross sectioned profile, wherein the adhesive staging segment loop is formed by at least one of:

a portion of the tubular balloon neck segment spanning between the moldable adhesive ring and the balloon unfinished edge, and a portion of the tubular balloon neck segment spanning between the moldable adhesive ring and the balloon gas retaining expansion cavity.

In yet another aspect, the adhesive staging segment is designed to expose the moldable adhesive ring when a tensile force is applied in a longitudinal direction between ends of the tubular balloon neck segment.

In yet another aspect, the unfinished edge adhesive staging segment and the expansion cavity adhesive staging segment abut one another proximate an interior quadrant of the moldable adhesive cross sectioned profile.

In yet another aspect, a lip bead is formed at a balloon unfinished edge, wherein the balloon unfinished edge is provided at a free end of the tubular balloon neck segment.

In yet another aspect, the balloon body segment can be shaped in bulb shape, a star shape, an oblong shape, a square shape, a rectangular shape, a triangular shape, a hexagonal shape, an octagonal shape, a polygonal shape, and the like.

In accordance with a second embodiment of the present invention, the invention consists of a method for fabricating a self sealing balloon assembly, the method comprising the steps of:

obtaining a quick seal balloon fabrication form comprising at least one balloon form member, each of the at least one balloon form comprising a balloon body mold segment extending from a balloon neck mold segment and an adhesive material dispensing section located about a circumference of a central section of the balloon neck mold segment;

applying an adhesive material about an circumference of a portion of a length of an exterior surface of the balloon neck mold segment, the moldable adhesive ring having a moldable adhesive cross sectioned profile formed into a ring shape;

applying balloon material upon an exterior surface of the balloon body mold segment and further extending upward onto a portion of the balloon neck mold segment to a location beyond the adhesive material dispensing section, wherein the balloon material is applied to the quick seal balloon fabrication form either prior to or subsequent to the application of the adhesive material;

shaping an adhesive staging segment into a loop, wherein the adhesive staging segment at least partially encapsulates the moldable adhesive ring; and removing the shaped balloon from the quick seal balloon fabrication form.

In yet another aspect, the method further comprises a step of curing the balloon material.

In yet another aspect, wherein the step of shaping the adhesive staging segment into a loop is accomplished by using at least one roller. The roller would apply a frictional force to the exterior surface of the balloon material extending the material and forming the looped shape.

In yet another aspect, each at least one roller can be fabricated of a rubber or similar pliant friction enhancing material.

In yet another aspect, each at least one roller can be coated with a rubber or similar pliant friction enhancing material, wherein each at least one roller is designed to be easily serviced. Easily service can be defined as being easily accessible and easily removed and reinstalled.

In yet another aspect, each at least one roller can be coated with a rubber or similar pliant friction enhancing material, wherein each at least one roller is designed to be easily serviced, where service can include replacement of one or more rollers. Easily service can be defined as being easily accessible and easily removed and reinstalled.

In yet another aspect, each at least one roller can be coated with a rubber or similar pliant friction enhancing material, wherein each at least one roller is designed to be easily serviced, where service can include replacement of a rubber or similar pliant friction enhancing material that covers a roller base. Easily service can be defined as being easily accessible and easily removed and reinstalled.

In yet another aspect, each at least one roller can be coated with a rubber or similar pliant friction enhancing material, wherein each at least one roller is designed to be easily replaced. Replacement can be a result of wear of the roller, wear of the material of the roller, wear of the rubber of the roller, wear of the rubber coating of the roller, and the like. Easily replaced can be defined as being easily accessible and easily removed and replaced.

In yet another aspect, each at least one roller can be coated with a rubber or similar pliant friction enhancing material.

In yet another aspect, the method further comprises a step of generating a lip bead at a free end of the tubular balloon neck segment.

In yet another aspect, the method further comprises a step of utilizing the balloon material to aid in forming the dispensed adhesive roll.

In yet another aspect, the method further comprises a step of dispensing the adhesive material into a recess formed within the adhesive dispensing segment.

In yet another aspect, the step of shaping the adhesive staging segment into a loop is accomplished by using at least one roller, wherein roller would apply a frictional force to the exterior surface of the balloon material extending the material and forming the loop shape.

In yet another aspect, the step of shaping the adhesive staging segment into a loop is accomplished by using at least one roller, wherein roller would apply a frictional force to the exterior surface of the balloon material extending the material and forming the loop shape.

In yet another aspect, the step of shaping the adhesive staging segment into a loop is accomplished by:

forming an unfinished edge adhesive staging segment of the adhesive staging segment by rolling a portion of the tubular balloon neck segment spanning between the moldable adhesive ring and the balloon unfinished edge over an unfinished edge portion of the moldable adhesive cross sectioned profile, and forming an expansion cavity adhesive staging segment of the adhesive staging segment by rolling a portion of the tubular balloon neck segment spanning between the moldable adhesive ring and the balloon gas retaining expansion cavity over an expansion cavity portion of the moldable adhesive cross sectioned profile.

In yet another aspect, at least one of the step of forming the unfinished edge adhesive staging segment and the step of forming the expansion cavity adhesive staging segment is accomplished by applying a friction to an exterior surface of the tubular balloon neck segment.

In yet another aspect, the adhesive material is dispensed into a recess formed within the adhesive material dispensing section.

In yet another aspect, air is blown in a direction between the balloon material and the balloon form.

In yet another aspect, air is blown through a nozzle in a direction between the balloon material and the balloon form.

In yet another aspect, air is blown through a nozzle in a direction between the balloon material and the balloon form, wherein the nozzle directs the air to a location where the exposed edge of the balloon material and the balloon form meet one another.

In yet another aspect, air is blown through a nozzle in a direction between the balloon material and the balloon form, wherein the nozzle directs the air to a location where the exposed edge of the balloon material and the balloon form meet one another, wherein the nozzle is in a non-contacting arrangement respective to the balloon material and the balloon form.

In yet another aspect, air is blown through a nozzle in a direction between the balloon material and the balloon form, wherein the nozzle directs the air to a location where the exposed edge of the balloon material and the balloon form meet one another, wherein the nozzle is in a contacting arrangement respective to the balloon material and the balloon form.

In yet another aspect, air is blown through a nozzle in a direction between the balloon material and the balloon form, wherein the nozzle directs the air to a location where the exposed edge of the balloon material and the balloon form meet one another, wherein the nozzle is inserted between the balloon material and the balloon form.

In yet another aspect, the nozzle can be formed having an arched surface having a radius that is substantially similar to a radius of the balloon form.

In yet another aspect, the nozzle can be axially moveable respective to the balloon form.

In yet another aspect, the nozzle can be axially moveable respective to the balloon form, wherein the nozzle slides along a surface of the balloon form.

In yet another aspect, wherein the material used to fabricate the nozzle and the material used to fabricate the balloon form are the same.

In yet another aspect, wherein the nozzle is fabricated of a material that is softer than the material used to fabricate the balloon form, thus ensuring that the nozzle wears at a greater rate compared to the balloon form.

In yet another aspect, air is blown in a direction between the balloon material and the balloon form at least one of prior to and during the rolling process that forms the rolled end of the balloon neck.

In yet another aspect, air is blown in a direction between the balloon material and the balloon form prior to the rolling process that forms the rolled end of the balloon neck.

In yet another aspect, air is blown in a direction between the balloon material and the balloon form during to the rolling process that forms the rolled end of the balloon neck.

In yet another aspect, air is blown in a direction between the balloon material and the balloon form at least one of prior to and during the rolling process that repositions the neck material to at least partially surround the adhesive composition bead.

In yet another aspect, air is blown in a direction between the balloon material and the balloon form prior to the rolling process that repositions the neck material to at least partially surround the adhesive composition bead.

In yet another aspect, air is blown in a direction between the balloon material and the balloon form during the rolling process that repositions the neck material to at least partially surround the adhesive composition bead.

In accordance with a third embodiment of the present invention, the invention consists of a method for fabricating a self sealing balloon assembly, the method comprising the steps of:

- introducing an adhesive dispensing adapter onto a balloon form comprising a balloon neck mold segment extending axially from a balloon body bulb shaped mold segment, wherein the adhesive dispensing adapter circumscribes the balloon neck mold segment and includes an adhesive dispensing system integrated therein, the adhesive dispensing system comprising an adhesive material dispensing section;
- applying balloon material upon an exterior surface of the balloon body mold segment and further extending upward onto a portion of the balloon neck mold segment, continuing onto an exterior surface of the adhesive dispensing adapter;
- dispensing an adhesive composition through the adhesive dispensing adapter to form a bead about a neck portion of the balloon;
- forming the balloon material to at least partially surround the adhesive composition bead; and
- removing the shaped balloon from the quick seal balloon fabrication form.

In yet another aspect, the adhesive material dispensing section is provided as a gap formed between a lower edge of the adhesive dispensing adapter and an exterior surface of the balloon neck mold segment.

In yet another aspect, the adhesive material dispensing section is provided as a series of orifices formed through a body of the adhesive dispensing adapter.

In yet another aspect, the series of orifices are formed through the body of the adhesive dispensing adapter at a location proximate a lower edge of the body of the adhesive dispensing adapter.

In yet another aspect, the adhesive dispensing adapter is adapted to employ a pressure to aid in the dispensing of the adhesive composition. The pressure can be provided by a flow of adhesive into the adhesive dispensing adapter, air pressure or another gaseous propellant, and the like.

In yet another aspect, the balloon material is formed in a shape of a roll, encapsulating the adhesive bead.

In yet another aspect, the balloon material is formed in a "C" shape, encapsulating the adhesive bead therein.

In yet another aspect, a powder is applied to an exposed surface of the adhesive bead prior to encapsulating the adhesive bead within the balloon material.

In yet another aspect, the self sealing balloon is inflated by steps of:

- inflating the balloon gas retaining expansion cavity with a volume of material;
- applying a tensile force in a longitudinal direction between ends of the tubular balloon neck segment to expose the moldable adhesive ring from the adhesive staging segment;
- compressing the exposed moldable adhesive ring together forming a seal, thus entrapping the volume of material within the balloon gas retaining expansion cavity.

In yet another aspect, the method is accomplished by automating the process.

In yet another aspect, the step of applying balloon material upon an exterior surface of the balloon body mold segment and further extending upward onto a portion of the balloon neck mold segment is accomplished by at least one of a dipping process, a spray process, a brush application process, a rolling application process, and the like.

In another variant, the sealing adhesive can be dispensed circumferentially about an exterior surface of a balloon form.

In another aspect, the sealing adhesive can be dispensed circumferentially about an exterior surface of a balloon form using a dispenser formed circumferentially about the balloon form.

In yet another aspect, the sealing adhesive can be dispensed circumferentially about an exterior surface of a balloon form using a dispenser which rotates circumferentially about the balloon form.

In yet another aspect, the sealing adhesive can be dispensed circumferentially about an exterior surface of a balloon form using a fixed dispenser and rotating the balloon form within the fixed dispenser.

In another variant, the sealing adhesive can be dispensed circumferentially about an exterior surface of a balloon form using a form adaptor, wherein the form adaptor is placed circumferentially about the provided balloon form. The form adapted is configured to dispense sealing adhesive onto the exterior surface of at least one of the form adaptor and the balloon form.

In yet another aspect, the exterior surface of the balloon form further comprises a balloon form neck adhesive receiving element.

In yet another aspect, the balloon form neck adhesive receiving element is fabricated of a material enabling ease of release of the sealing adhesive.

In yet another aspect, the balloon form neck adhesive receiving element extends outward from an exterior surface of the balloon form.

In yet another aspect, the balloon form neck adhesive receiving element is flush with the exterior surface of the balloon form.

In yet another aspect, the balloon form neck adhesive receiving element is recessed inward from the exterior surface of the balloon form.

In another application process, the process includes steps of:

- placing a neck of a prefabricated balloon upon an adhesive applicator balloon neck support element;
- partially unrolling the balloon neck onto the adhesive applicator balloon neck support element towards a supported end of the adhesive applicator balloon neck support element;
- continuing an unrolling the balloon neck onto the adhesive applicator balloon neck support element in a reverse direction, towards a free end of the adhesive applicator balloon neck support element, exposing an interior surface of the balloon neck;
- applying a sealing adhesive to the exposed interior surface of the of the balloon neck;
- rolling the end of the balloon neck rearward, covering the applied sealing adhesive; and
- removing the balloon from the adhesive applicator balloon neck support element.

In a second aspect, the step of applying the sealing adhesive is accomplished using a sealing adhesive applicator.

In another aspect, the step of applying the sealing adhesive is accomplished by dispensing the sealing adhesive from a fixed sealing adhesive applicator and rotating the adhesive applicator balloon neck support element.

In yet another aspect, the step of applying the sealing adhesive is accomplished by dispensing the sealing adhesive from a fixed adhesive applicator balloon neck support element and rotating the sealing adhesive applicator.

In yet another aspect, the step of rolling the end of the balloon neck rearward, covering the applied sealing adhesive is assisted by using a balloon neck sleeve element.

In yet another aspect, the balloon neck sleeve element is slideably assembled to the adhesive applicator balloon neck support element.

In yet another aspect, the balloon neck sleeve element includes a tapered lead in segment.

In yet another aspect, the balloon neck sleeve element includes a conically shaped lead in segment.

In yet another aspect, the balloon neck sleeve element includes a frustum shaped lead in segment.

In yet another aspect, the balloon neck sleeve element includes an interior cavity having a size and shape to receive the folded balloon neck, including the ring of sealing adhesive.

In yet another aspect, wherein the interior cavity of the balloon neck sleeve element is located forward (towards a free side) of a sliding element of the balloon neck sleeve element.

In yet another aspect, the balloon neck sleeve element interior cavity is formed having an opening span that is equal to or larger than a like span of the ring of sealing adhesive.

In yet another aspect, a balloon sealing adhesive applicator assembly includes a plurality of adhesive applicator balloon neck support elements.

In yet another aspect, a balloon sealing adhesive applicator assembly includes a plurality of adhesive applicator balloon neck support elements, each of the adhesive applicator balloon neck support elements is rotationally supported by an adhesive applicator balloon neck support element operating frame arm of an adhesive applicator balloon neck support element operating frame.

In yet another aspect, the adhesive applicator balloon neck support element operating frame is adapted to rotate about a central axis.

In yet another aspect, the balloon forms rotate about a central axis.

In yet another aspect, the balloon form rotates about a central axis during an application of the adhesive.

In yet another aspect, the balloon form rotates about a central axis during an application of the balloon material, such as latex.

In yet another aspect, the balloon form rotates about a central axis during an application of the adhesive, wherein the adhesive is applied by a fixed adhesive applicator.

In yet another aspect, the balloon form rotates about a central axis during an application of the adhesive, wherein the adhesive is applied by a moving adhesive applicator.

In yet another aspect, the balloon form rotates about a central axis during an application of the adhesive, wherein the adhesive is applied by an adhesive applicator that rotates about the balloon form.

In yet another aspect, each of a plurality of balloon forms rotates about each respective central axis during an application of the adhesive.

In yet another aspect, each of a plurality of balloon forms rotates about each respective central axis during an application of the balloon material, such as latex.

In yet another aspect, each of a plurality of balloon forms rotates about each respective central axis, wherein the rotation is caused by a cam rotating assembly. The cam rotating assembly comprising a series of cam arms extending generally radially from a rotational member of the balloon form. The cam arms are moveably assembled to a synchronizing arm. The synchronizing arm is moveably assembled to a drive arm. The drive arm is rotated by a drive arm rotating drive component. The rotating drive component can be an electric motor, a gear, a series of gears, a transmission, a steam powered motor, a combustion powered engine, manually operating, or any other suitable rotational drive system.

In yet another aspect, the cam rotating assembly can include at least one spacer to ensure components are arranged to avoid contact and/or interference with one another.

In yet another aspect, the cam rotating assembly can include mechanical fasteners to maintain assembly of components to one another. Examples of mechanical fasteners include screws, rivets, nuts, bolts, clips, c-clips, o-rings, washers, and the like. The mechanical fasteners can be removable or permanently assembled. Examples of removable mechanical fasteners include threaded fasteners, such as screws, nuts, and bolts; spring retaining fasteners, such as clips, c-clips, and o-rings; and the like. Examples of permanently assembled mechanical fasteners include rivets, welded, brazed, or soldered washers, bent features, compressed or broadened features, and the like.

In yet another aspect, each of a plurality of balloon forms rotates about each respective central axis, wherein the rotation is caused by a gear drive rotating assembly. The gear drive rotating assembly comprising a series of balloon form gears, one balloon form gear of the series of balloon form gears being assembled to a rotational member of the balloon form. The balloon form gears are rotationally coupled to one another by a series of synchronizing gears. One synchronizing gear is in rotational communication with a pair of adjacent balloon form gears, wherein rotation of one balloon form gear causes rotation of a respective synchronizing gear in an opposite direction, wherein the respective synchronizing gear drives the other balloon form gear in a same direction as the original balloon form gear.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
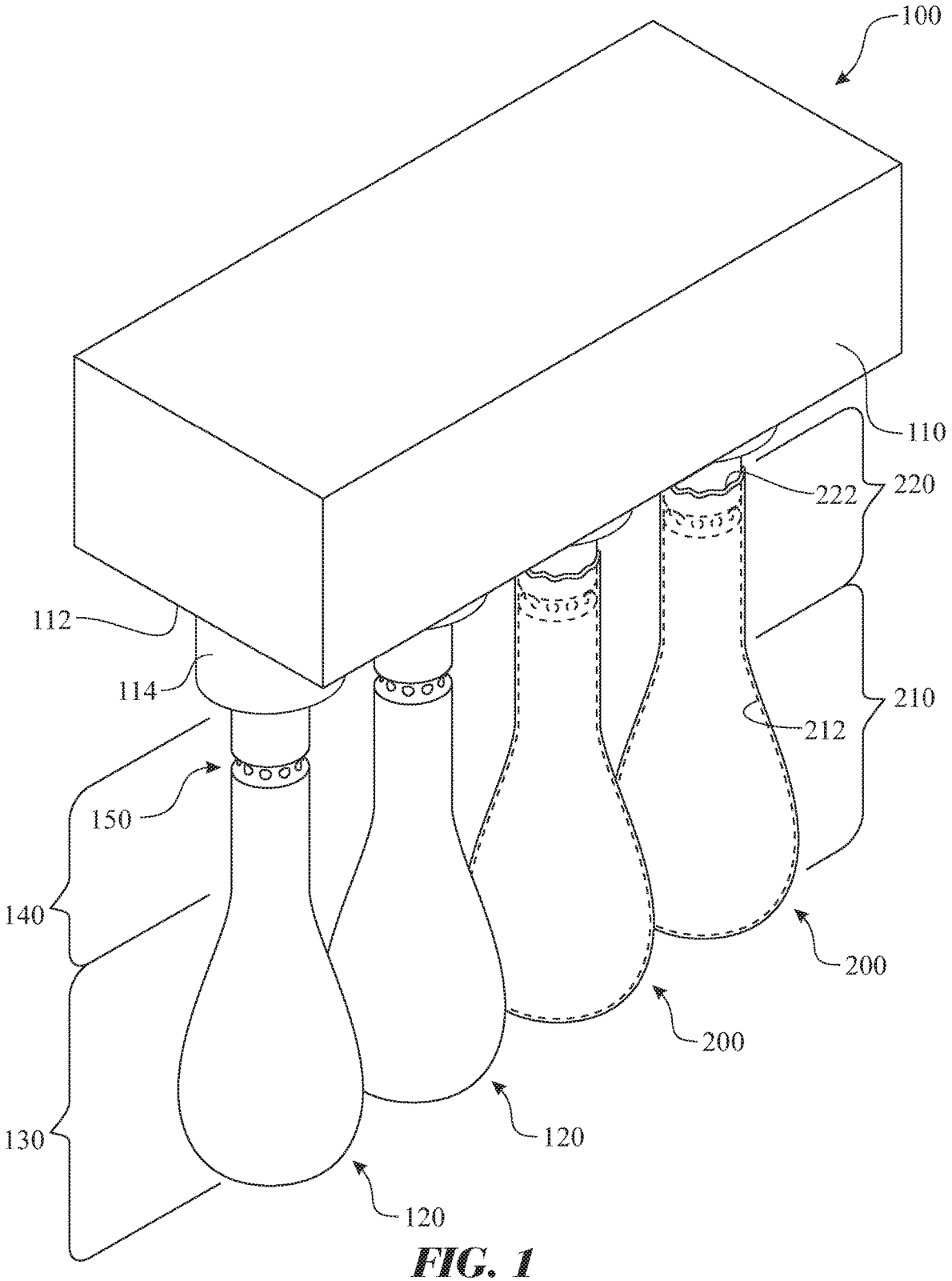
FIG. 1 presents an isometric view of an exemplary quick seal balloon fabrication form, the illustration including two exemplary uncoated forms and two exemplary forms coated with balloon forming material.

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

One or more balloons 200 are formed using a quick seal balloon fabrication form 100 as illustrated in FIGS. 1 through 9. The exemplary embodiment of the quick seal balloon fabrication form 100 presented in FIG. 1 includes four (4) balloon form member 120, wherein two (2) of the four (4) balloon form members 120 are coated with a balloon forming material to create an exemplary self sealing balloon 200.

Figure 2:
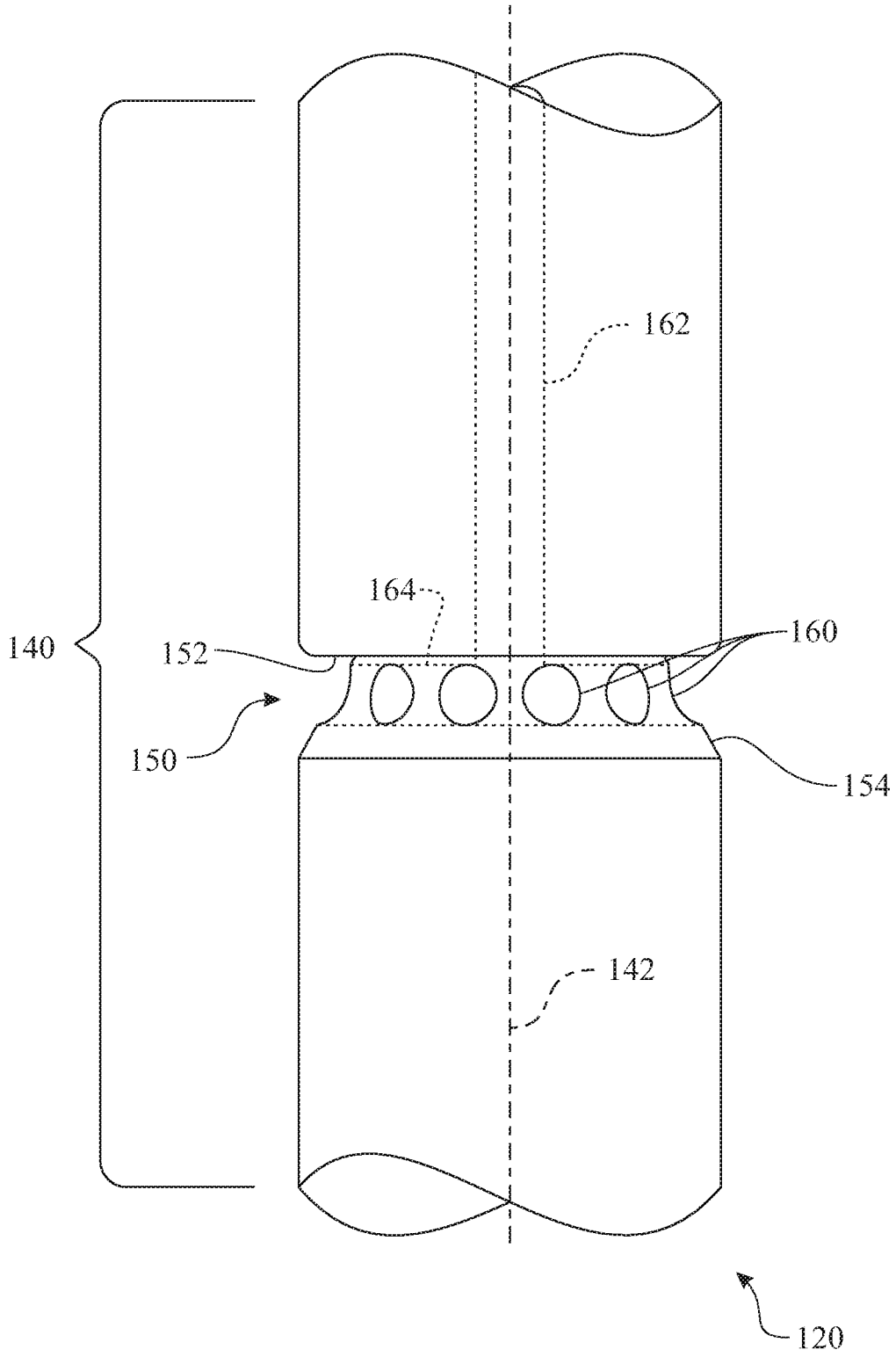
FIG. 2 presents an enlarged elevation view detailing an exemplary adhesive dispensing segment of an exemplary balloon neck mold segment of the exemplary quick seal balloon fabrication form originally introduced in FIG. 1, wherein the neck segment is shown prior to dispensing of a moldable adhesive.

Each balloon form member 120 is shaped to include a balloon body mold segment 130 extending from a balloon neck mold segment 140. The balloon body mold segment 130 can be shaped in any desired shape, wherein the shape of the balloon body mold segment 130 defines the shape of the finished balloon gas retaining expansion cavity 210. The balloon neck mold segment 140 is preferably shaped having a circular cross sectional shape to form a circular, tubular balloon neck segment 220. An adhesive dispensing segment 150 is provided in a central region of the balloon neck mold segment 140 as illustrated in FIG. 2. The exemplary adhesive dispensing segment 150 is formed including a recess defined having a base adhesive control surface 152 and an angled adhesive control surface 154. The base adhesive control surface 152 extends laterally inward from a circumference of the neck mold segment exterior surface. The angled adhesive control surface 154 extends outward and downward from an interior edge of the base adhesive control surface 152, wherein the angled adhesive control surface 154 terminates at an exterior surface of the balloon neck mold segment 140. The base adhesive control surface 152 and angled adhesive control surface 154 are provided to aid in guiding the separation of a dispensed adhesive roll 170 from the adhesive dispensing segment 150. A series of adhesive dispensing aperture 160 are provided in a spatial arrangement about the angled adhesive control surface 154. A series of adhesive distribution delivery conduit 164 are provided connecting each of the adhesive dispensing apertures 160 to an adhesive primary delivery conduit 162. The adhesive dispensing aperture 160 and respective adhesive distribution delivery conduit 164 can be fabricated in the balloon neck mold segment 140 by drilling a hole completely through the balloon neck mold segment 140. The adhesive distribution delivery conduit 164 preferably is directed bisecting a longitudinal axis 142 of the balloon neck mold segment 140. The adhesive primary delivery conduit 162 is preferably formed extending concentrically along the balloon neck mold segment longitudinal axis 142.

The adhesive roll 170 is formed as a moldable adhesive ring having a moldable adhesive cross sectioned profile formed into a ring or annular shape. The fabrication process positions the moldable adhesive ring 170 to circumscribe an interior circumference of a portion of a length of an interior of the tubular balloon neck segment 220. An adhesive staging segment 172 will be formed from the tubular balloon neck segment 220, wherein the adhesive staging segment 172 will at least partially cover a peripheral surface of the moldable adhesive cross sectioned profile 180.

It is understood that the adhesive roll 170 can be applied using other application methods, including rolling, forming, and the like. The dispensed adhesive roll 170 can be fabricated of any suitable material, wherein one exemplary material is a high tack pressure sensitive adhesive solder under a Product Number 3794 offered by 3M and a second exemplary material is a reusable putty sold under a brand name of DAP BLUESTIK offered by DAP Products incorporated.

The dispensed adhesive roll 170 can be fabricated of a thermoplastic general purpose, high tack, pressure sensitive adhesive that can be spray or bead applied. The chemical base is a block co-polymer. The adhesive material preferably conforms to ASTM D 4236. The composition of the adhesive material can include a rubber-based vehicle.

Although the exemplary embodiment presents an adhesive dispensing segment 150 having a recess formed about a circumference of the balloon neck mold segment 140, it is understood that the adhesive dispensing segment 150 can comprise the plurality of adhesive dispensing apertures 160 in fluid communication with the adhesive primary delivery conduit 162 via a series of adhesive distribution delivery conduits 164, exclusive of the recess formed by the base adhesive control surface 152 and angled adhesive control surface 154.

The exemplary quick seal balloon fabrication form 100 includes a fabrication manifold 110. The fabrication manifold 110 would include a series of fluid conduits (not shown) forming a manifold for transferring an adhesive material from an adhesive material reservoir (not shown) to each of the individual form transition member 114 via any transfer mechanism. The transfer mechanism can be a pump, a pressurized system, and the like. A series of individual form transition member 114 (or similar feature) can be integrated into the fabrication manifold 110 or assembled to a fabrication manifold form surface 112 of the fabrication manifold 110, wherein each balloon form member 120 is attached to the fabrication manifold 110 via the individual form transition member 114. The individual form transition member 114 can provide fluid communication between the manifold of the fabrication manifold 110 and each respective adhesive primary delivery conduit 162. This configuration provides a single passageway for conveyance and disbursement of the adhesive material between the adhesive material reservoir and each of the adhesive dispensing segments 150.

The quick seal balloon fabrication form 100 is transferred placing the multiple balloon form members 120 attached thereto into a vat containing liquid balloon forming material. The liquid balloon forming material coats the balloon body mold segment 130 and balloon neck mold segment 140 of each of the balloon form members 120. The illustration shows two (2) of the four (4) balloon form members 120 being coated with liquid balloon forming material to present a before and after state. It is noted that the liquid balloon forming material is applied to the balloon form member 120, where the liquid balloon forming material covers the adhesive dispensing segment 150. A balloon unfinished edge 222 is created at the terminal end of the self sealing balloon 200.

Figure 3:
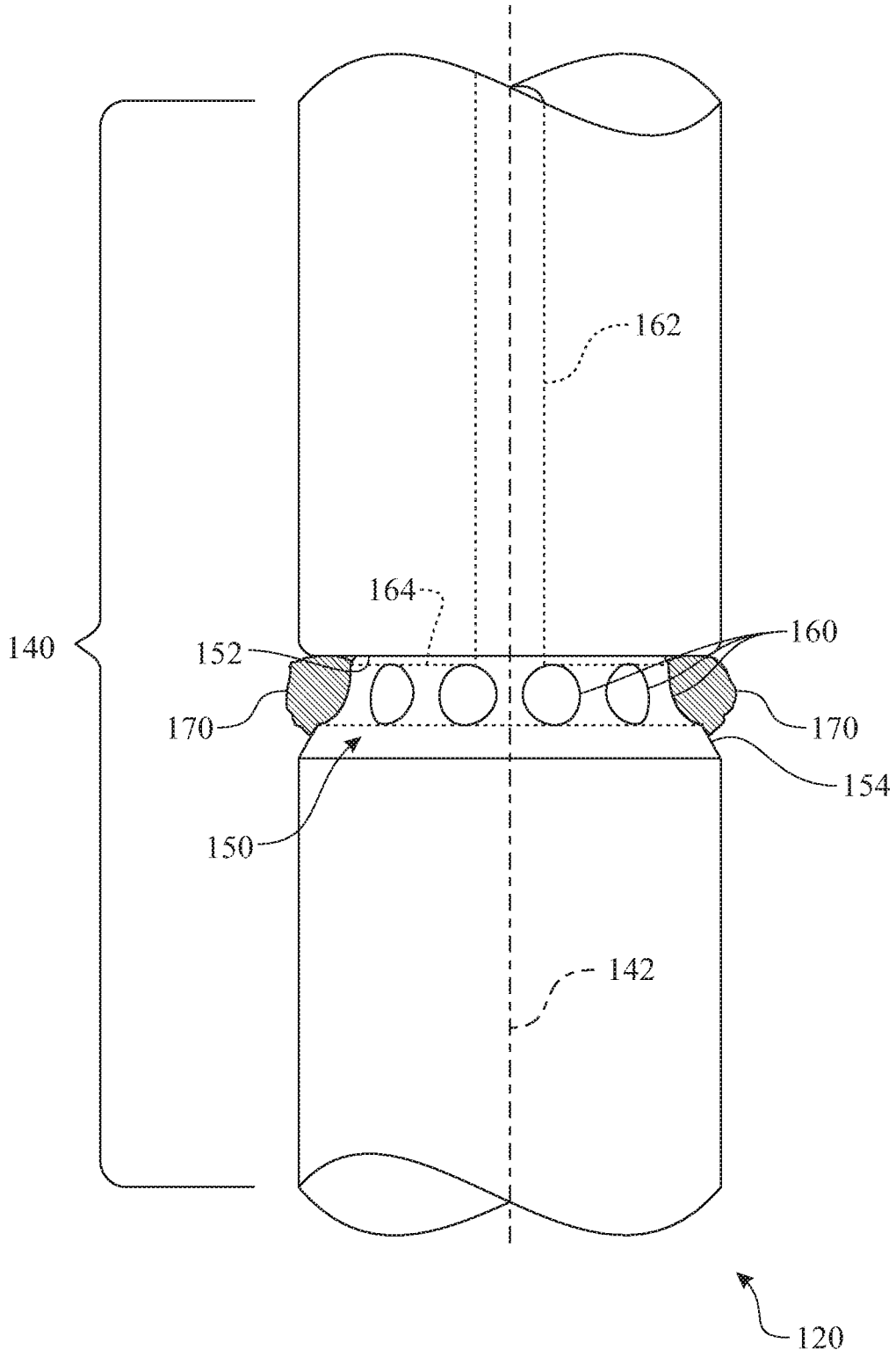
FIG. 3 presents a partially sectioned, enlarged elevation view detailing the exemplary adhesive dispensing segment as shown in FIG. 2, wherein the mold neck segment illustrates a cross section of an exemplary ring of moldable adhesive dispensed about the mold neck segment.
Figure 4:
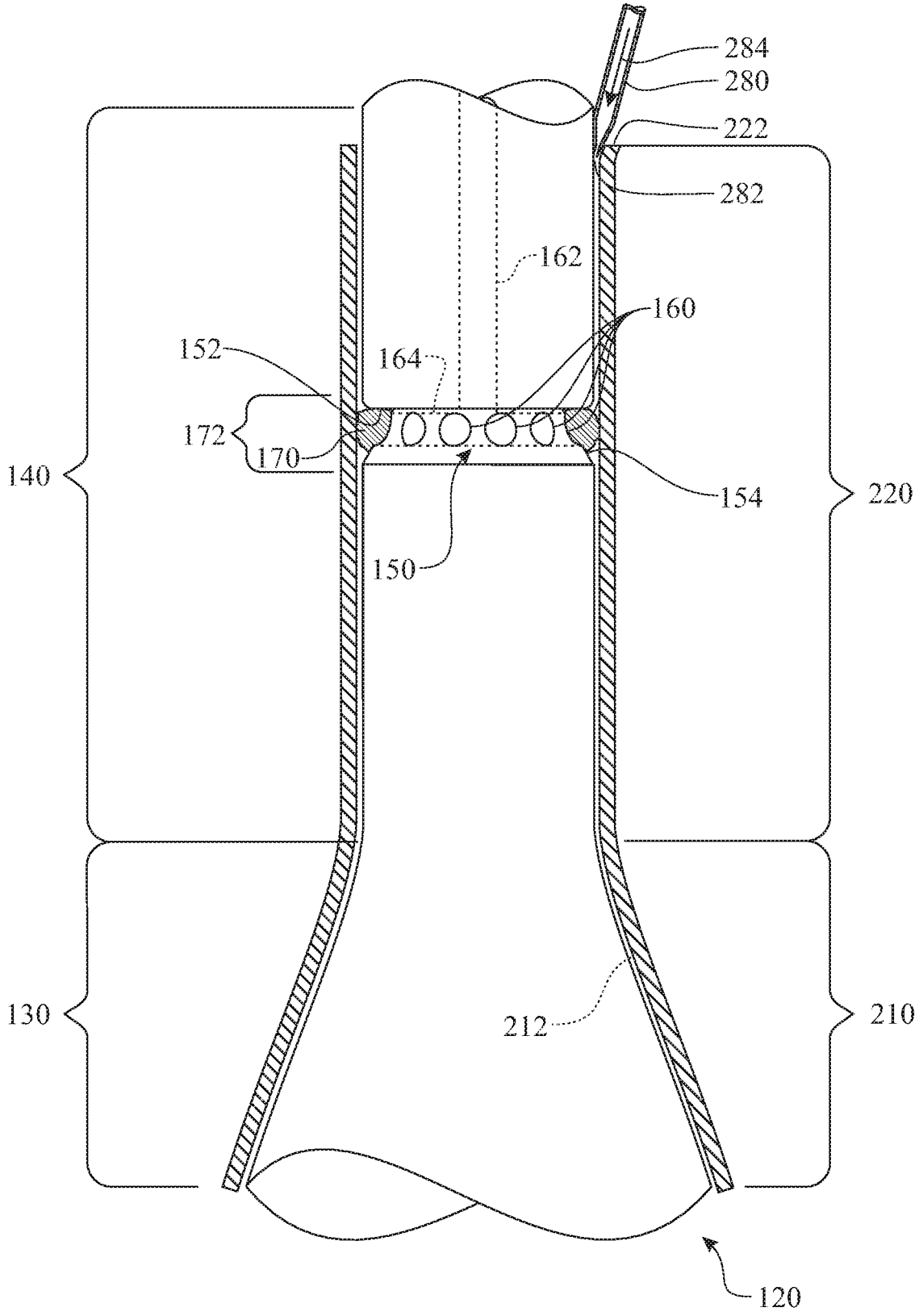
FIG. 4 presents a partially sectioned elevation view detailing the exemplary adhesive dispensing segment as shown in FIG. 3, the illustration introducing a coating of a balloon material applied to the balloon form member.

A volume of adhesive material is dispensed through the manifold, where the material is separated into each of the adhesive primary delivery conduit 162. The adhesive material continues through the adhesive primary delivery conduit 162, where it is disbursed into each of the adhesive distribution delivery conduits 164 and dispensed through the plurality of adhesive dispensing apertures 160. In a first embodiment, the adhesive material is dispensed prior to coating the balloon form member 120 with the balloon material as illustrated in FIG. 3. In a second embodiment, the adhesive material is dispensed subsequent to coating the balloon form member 120 with the balloon material as illustrated in FIG. 4. In this embodiment, the balloon material aids in retaining and forming the dispensed adhesive roll 170. The process allows for a curing step, where the balloon material is at least partially cured prior to continuing with the fabrication process.

The self sealing balloon 200 is subjected to a continuous flow of steps to form an adhesive staging segment 172 partially or completely encapsulating the dispensed adhesive roll 170 presented in the exemplary embodiments illustrated in FIGS. 5 through 8. In the exemplary embodiment, one or more adhesive staging segment rollers 190 applies a friction to an exterior surface of the tubular balloon neck segment 220, causing the adhesive staging segment 172 to extend and roll downward, towards the balloon gas retaining expansion cavity 210. The one or more adhesive staging segment rollers 190 are positioned about a circumference of the tubular balloon neck segment 220. The rolling process collects the dispensed adhesive roll 170 and entraps the dispensed adhesive roll 170 within the adhesive staging segment 172. In the exemplary embodiment, the adhesive dispensing segment 150 is shaped to include a base adhesive control surface 152 and an angled adhesive control surface 154. The base adhesive control surface 152 ensures the dispensed adhesive roll 170 is directed towards the balloon gas retaining expansion cavity 210. The angled adhesive control surface 154 aids in transferring the dispensed adhesive roll 170 from the adhesive dispensing segment 150 into the adhesive staging segment 172. In a scenario where the dispensed adhesive roll 170 is placed upon an outer surface of the balloon neck mold segment 140, the rolling process naturally transfers the dispensed adhesive roll 170 into the adhesive staging segment 172.

Figure 5:
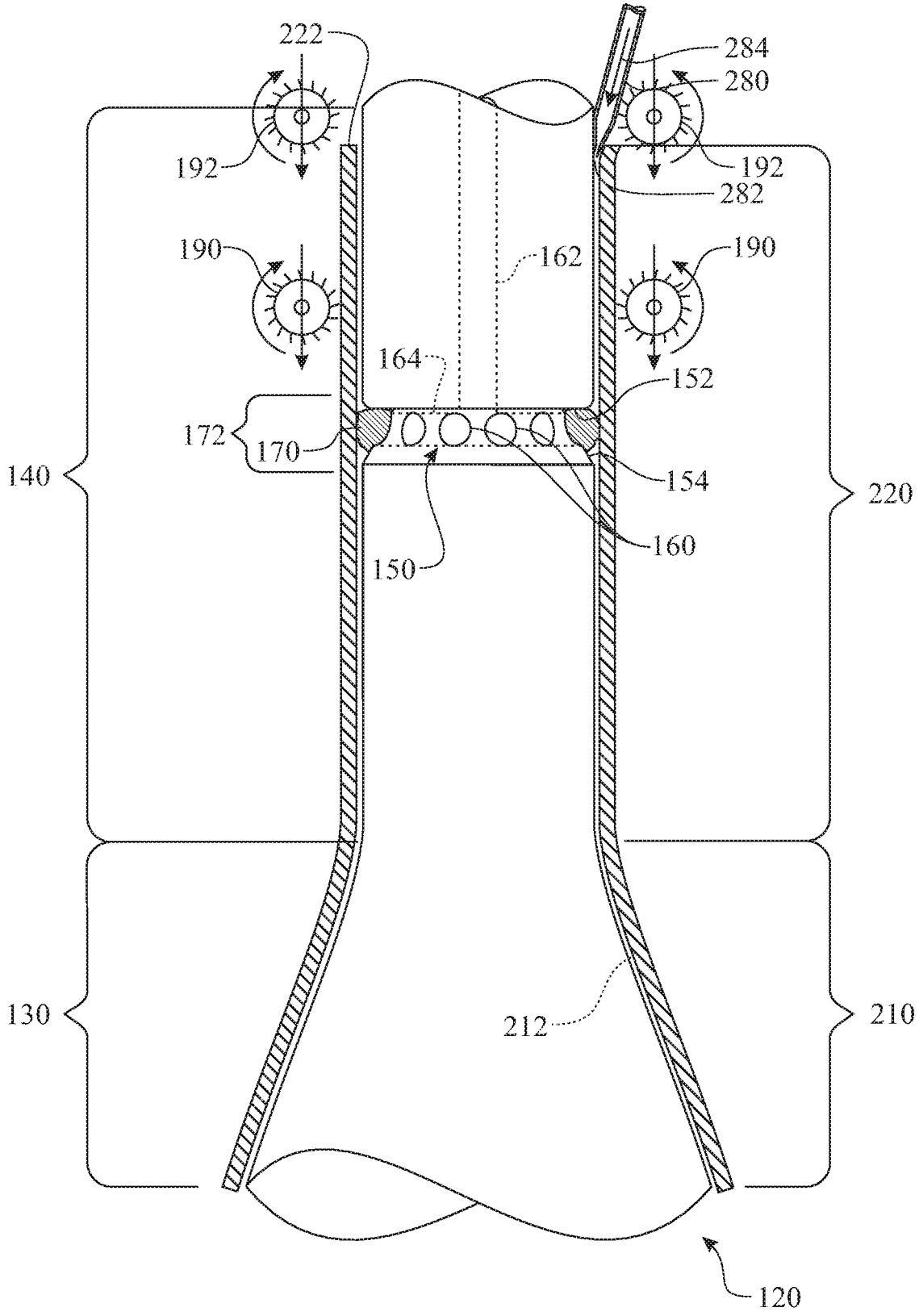
FIG. 5 presents a partially sectioned elevation view of the balloon neck mold segment detailing the exemplary adhesive dispensing segment as shown in FIG. 4, the illustration introducing various balloon feature forming rollers.
Figure 6:
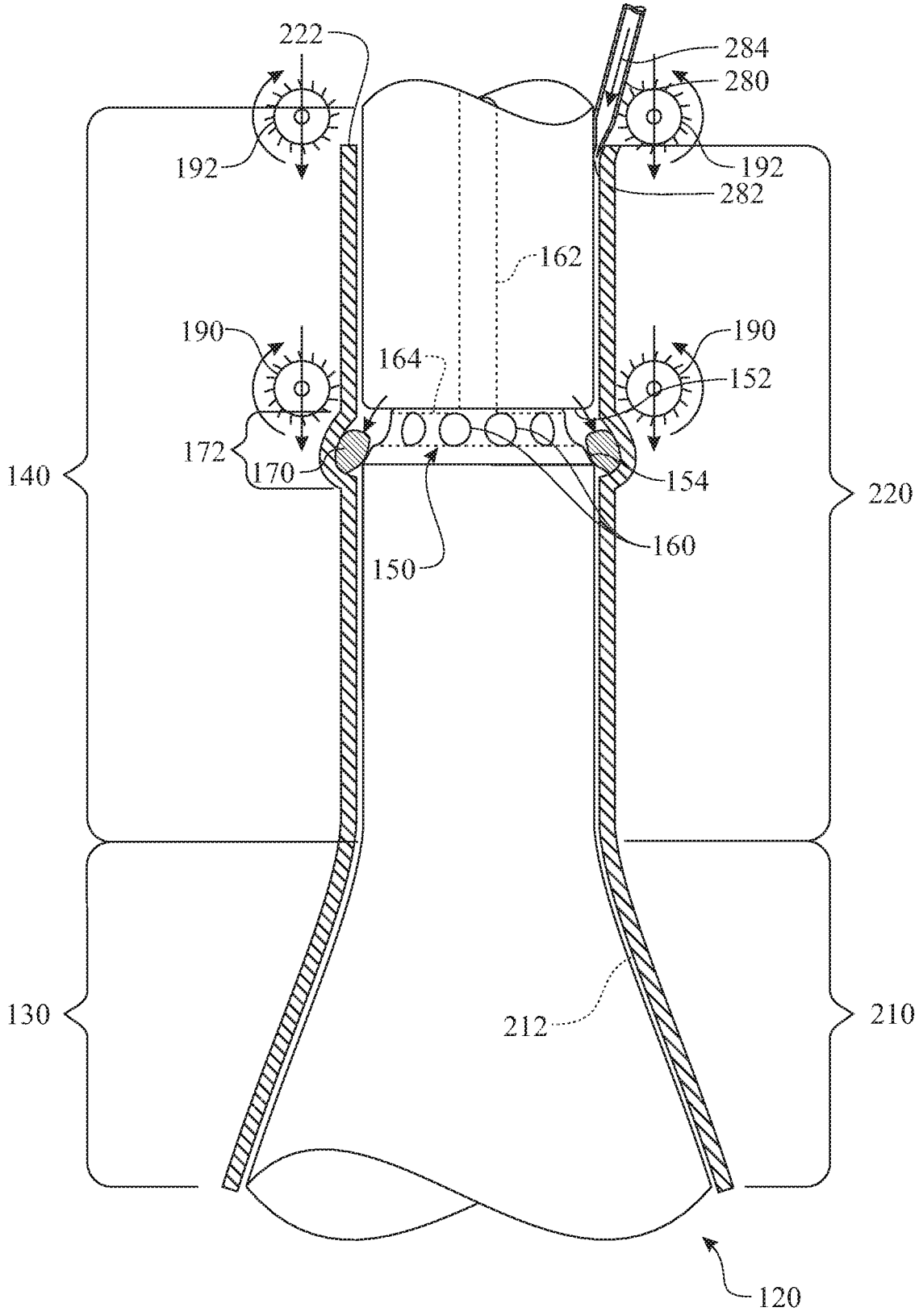
FIG. 6 presents a partially sectioned elevation view of the balloon neck mold segment illustrating an exemplary first step for forming an adhesive staging loop, wherein the first step removes the dispensed adhesive roll form the an adhesive dispensing segment of the form.
Figure 7:
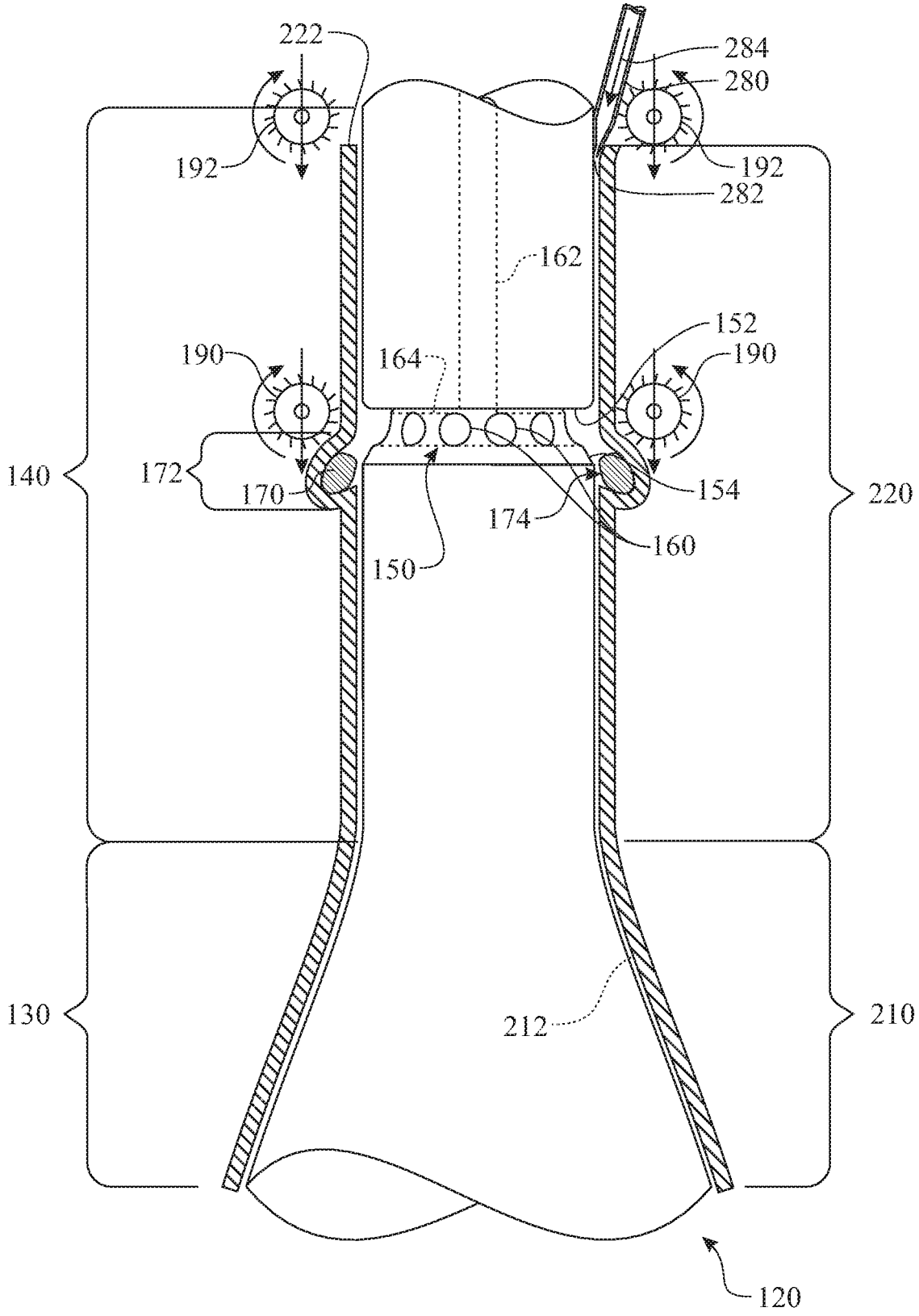
FIG. 7 presents a partially sectioned elevation view of the balloon neck mold segment illustrating an exemplary second step for forming an adhesive staging loop, wherein the second step partially encases the dispensed adhesive roll into an adhesive staging segment of the tubular balloon neck segment.

Initially, the rollers 190 apply a frictional force to the exterior surface of the tubular balloon neck segment 220, causing the adhesive staging segment 172 to extend and begin rolling downward, towards the balloon gas retaining expansion cavity 210 as illustrated in FIG. 5. The motion of the adhesive staging segment rollers 190 extracts the dispensed adhesive roll 170 from the adhesive dispensing segment 150 (when applicable), placing the dispensed adhesive roll 170 into the adhesive staging segment 172, as illustrated in FIG. 6. The dispensed adhesive roll 170 inhibits the downward motion of the adhesive staging segment 172, where when the collection of the dispensed adhesive roll 170 placing inside the adhesive staging segment 172 causes the adhesive staging segment 172 to roll when subjected to the continuing rolling and downward motion of the adhesive staging segment roller 190, as illustrated in FIG. 7. The process continues until the adhesive staging segment 172 is formed into an envelope substantially or completely circumscribing the dispensed adhesive roll 170. The looped dispensed adhesive roll 170 forms two transitional nodes or ends, which can define an adhesive staging segment gap 174. The adhesive staging segment gap 174 or relationship between the nodes can be configured where the nodes butt against one another, have a small spatial relation therebetween, or overlap.

The adhesive staging segment 172 can be defined as having two segments: an unfinished edge adhesive staging segment 182 and an expansion cavity adhesive staging segment 184. The unfinished edge adhesive staging segment 182 can be defined as a portion of the adhesive staging segment 172 extending from a midline of the dispensed adhesive roll 170 towards the balloon unfinished edge 222. The expansion cavity adhesive staging segment 184 can be defined as a portion of the adhesive staging segment 172 extending from a midline of the dispensed adhesive roll 170 towards the balloon body segment 210.

Although the balloon neck mold segment 140 is illustrated having parallel sides, the balloon neck mold segment 140 can have a taper, where the diameter or circumference proximate the fabrication manifold 110 is smaller than the diameter or circumference proximate the balloon body mold segment 130. The tapered configuration can aid in forming the adhesive staging segment 172.

The balloon unfinished edge 222 can be finished either prior to forming the adhesive staging segment 172, parallel to forming the adhesive staging segment 172, or subsequent to forming the adhesive staging segment 172. The balloon unfinished edge 222 is finished by rolling the free end of the tubular balloon neck segment 220 using at least one lip bead roller 192. The one or more lip bead rollers 192 are positioned about a circumference of the tubular balloon neck segment 220. The lip bead roller 192 frictionally engages with the interior surface 212 of the tubular balloon neck segment 220 causing the free end of the tubular balloon neck segment 220 to roll outward forming a lip bead 224.

The adhesive staging segment rollers 190 and/or the lip bead roller 192 can have a rubber or other friction enhancing coating applied to the surface to help aid in gripping the material of the balloon 200. The roller can be fabricated of a base material that can be rigid or flexible. Examples of suitable base materials for the rollers include metal, plastic, nylon, rubber and the like. Non-rubber based rollers can be coated with a rubber or other friction enhancing coating. The coating can be permanently fixed upon the surface of the rollers. Alternatively, the coating can be provided as a formed component that can be assembled to and removed from the rollers. The coating can be formed to include multiple fingers, such as those illustrated in FIGS. 5-9. The fingers can be rigid or pliant. Each finger can extend radially from an exterior surface of the roller 190, 192, or extend outward at an angle from radially, where a distal end of each roller finger trails a connected end of the respective roller finger in a direction of rotation. This places a front surface of the roller finger against the surface of the material of the balloon 200.

The rollers can be considered as a wear item. The machine can be designed enabling easy servicing and/or replacement of each roller. This can include easy access to each roller. This can also include easy removal and reinstallation or replacement of each roller. In one consideration, the friction enhancing coating material can be fabricating having a shape enabling the friction enhancing coating material to be removable and replaceable.

The rolling processes can be enhanced by the introduction of an airflow 284 directed to a point that is located between the balloon 200, more specifically, the balloon unfinished lip 222 of the balloon 200 and the exterior surface of the balloon form member 120. The airflow 284 can be provided by a neck release air delivery system 280, as introduced in FIG. 4. The neck release air delivery system 280 includes a neck release air delivery nozzle 282 at a distal or dispensing end.

The neck release air delivery nozzle 282 can be in a non-contacting arrangement respective to the balloon material and the balloon form. Alternatively, the neck release air delivery nozzle 282 can be in a contacting arrangement respective to the balloon material and the balloon form. In either arrangement, the neck release air delivery nozzle 282 can be fixed or moveable along a direction parallel to an elongated axis of the balloon form member 120.

The neck release air delivery nozzle 282 can be shaped having a radius that is substantially similar to a radius of the exterior surface of the balloon form member 120. The neck release air delivery system 280 can be fixed respective to the balloon form member 120. The term substantially defines tolerances where the radius of the nozzle 282 and the radius of the exterior surface of the balloon form member 120 are essentially the same, with some fabrication tolerances. By fabricated the nozzle 282 and the exterior surface of the balloon form member 120 with like radii, the nozzle 282 is significantly less likely to damage the material of the balloon 200.

In an enhanced variant, the neck release air delivery system 280 can be moveable respective to the balloon form member 120. The neck release air delivery system 280 can be moveable respective to the balloon form member 120 in an axial direction. Movement of the neck release air delivery system 280 respective to the balloon form member 120 can be accomplished using any mechanical movement system known by those skilled in the art. In the variant where the neck release air delivery system 280 can be moveable respective to the balloon form member 120, a designer might consider wear at contacting surface between the neck release air delivery system 280 and the balloon form member 120. The designer would determine which component is to be serviced. In one example, the material used to fabricate the neck release air delivery system 280 would be of a softer hardness compared to the material used to fabricate the balloon form member 120. In this example, the neck release air delivery system 280 would wear at a significantly higher rate compared to the balloon form member 120, thus directing servicing or replacement of the neck release air delivery system 280 over servicing or replacement of the balloon form member 120.

In one application, airflow 284 would be initiated prior to the rolling processes. In a second application, airflow 284 would be initiated during to the rolling processes. In another application, airflow 284 would be initiated prior to the rolling processes and continue during the rolling processes. The airflow 284 can be applied during the process of forming the lip bead 224, the process of encapsulating the dispensed adhesive roll 170 within the dispensed adhesive roll 170, or both. Introduction of the airflow 284 releases the material of the balloon 200 from the surface of the balloon form member 120, thus easing the rolling process. This is particularly helpful during the process of encapsulating the dispensed adhesive roll 170 within the dispensed adhesive roll 170.

Although the nozzle 282 is shown as a small portion of a circumference about the balloon neck mold segment 140, it is recognized that the nozzle 282 can be shaped to circumscribe a larger portion of the circumference about the balloon neck mold segment 140 or even completely circumscribe the circumference about the balloon neck mold segment 140.

The airflow 284 would be ceased once fabrication of the balloon is completed. Alternatively, the airflow 284 could be continued until the self sealing balloon 200 is removed from the balloon form member 120.

Once completed, the self sealing balloon 200 is removed from the balloon form member 120 using any common balloon fabrication separation procedure.

Figure 10:
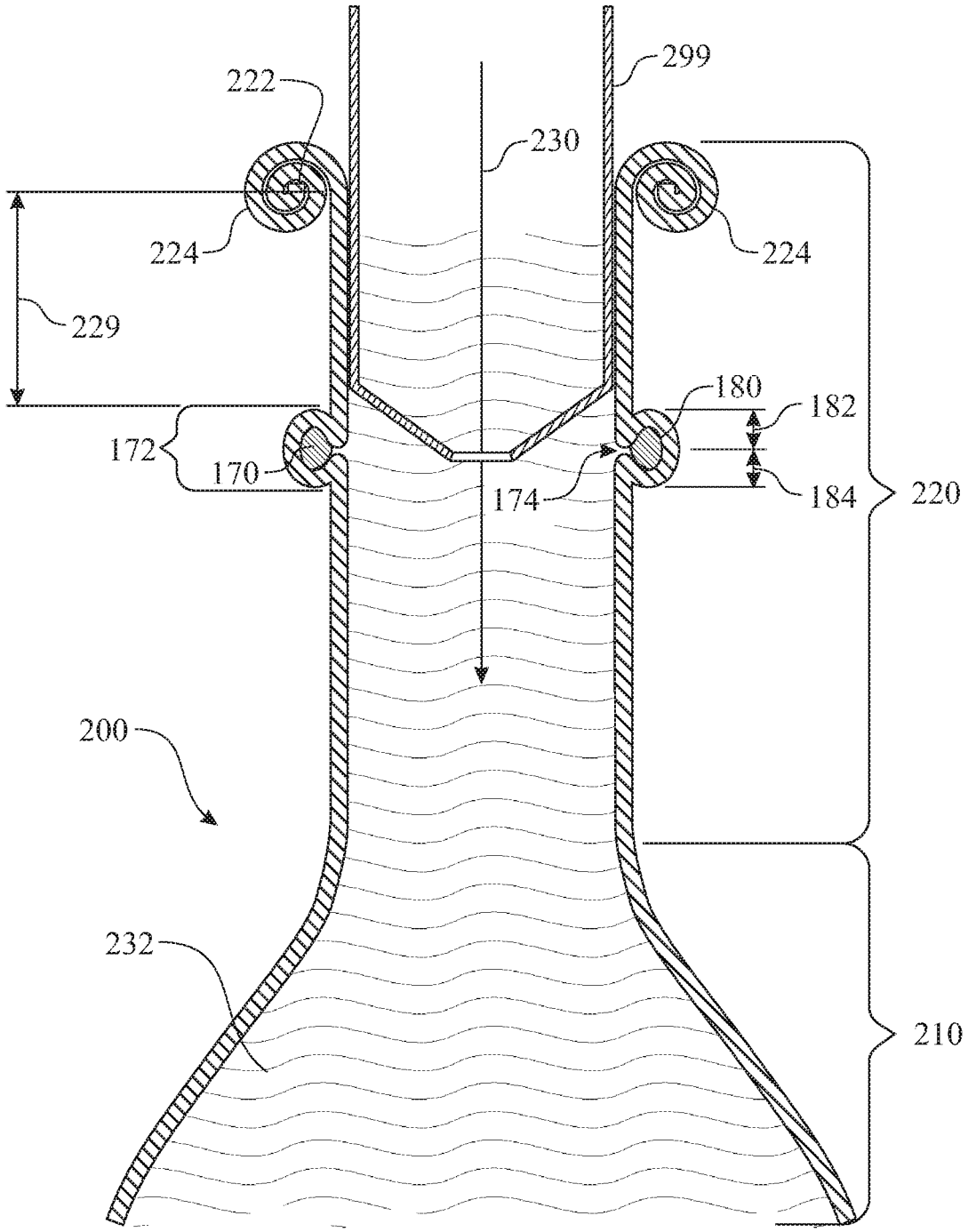
FIG. 10 presents a sectioned elevation view of the tubular balloon neck segment illustrating a first balloon filling step.
Figure 11:
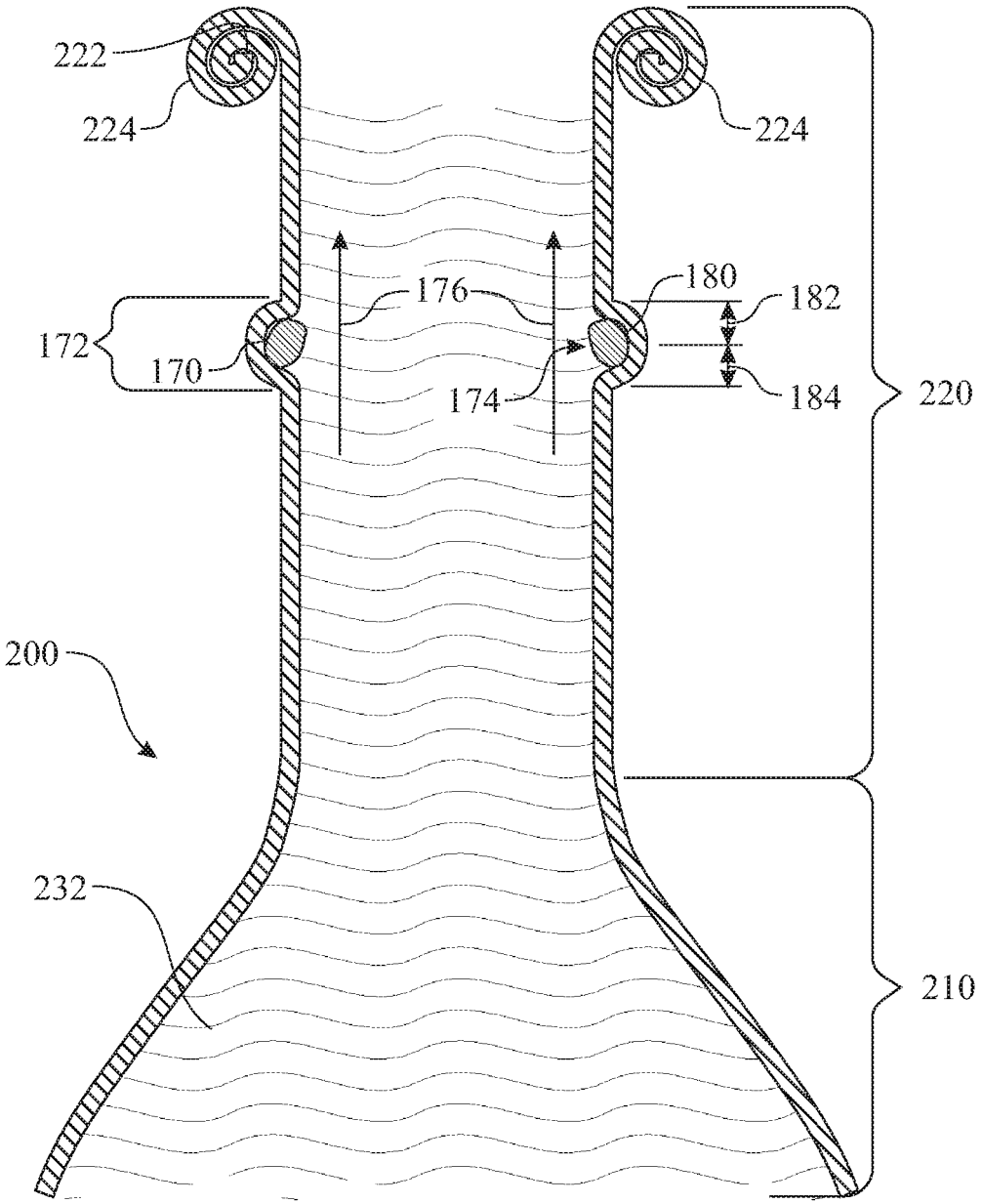
FIG. 11 presents a sectioned elevation view of the tubular balloon neck segment illustrating a first balloon sealing step.
Figure 12:
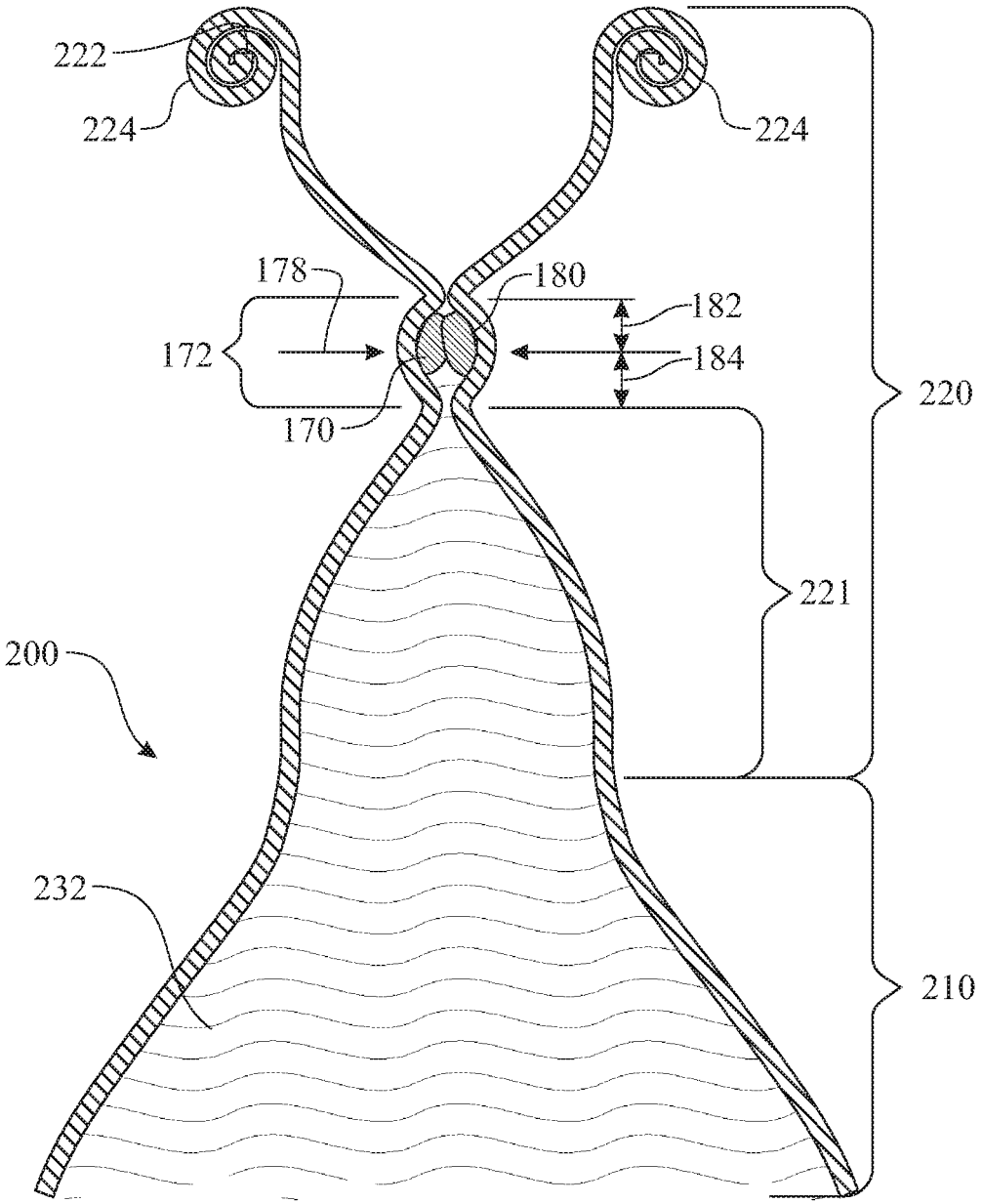
FIG. 12 presents a sectioned elevation view of the tubular balloon neck segment illustrating a second balloon sealing step.

In use, the self sealing balloon 200 is inflated by inserting pressurized inflating gas 230 into the balloon gas retaining expansion cavity 210, as illustrated in FIG. 10. The pressurized inflating gas 230 can be provided by any suitable inflating source, including a person, a pressurized gas supply through a compressed gas delivery nozzle 299, or any other suitable gas source. The gas can be air, helium, nitrogen, or any other desired gas. It is also understood that liquids may be used in place of the gas, such as water to create a water balloon. The pressurized inflating air 230 causes the balloon gas retaining expansion cavity 210 to expand to a desired size. Balloons 200 are commonly designed where the tubular balloon neck segment 220 begins to inflate when the balloon gas retaining expansion cavity 210 approaches maximum inflation. Once the balloon gas retaining expansion cavity 210 is inflated to the desired size, the balloon inflator would apply an adhesive exposing tensile force 176 to the tubular balloon neck segment 220, as illustrated in FIG. 11. The adhesive exposing tensile force 176 unrolls the adhesive staging segment 172, separating the nodes, which exposes the dispensed adhesive roll 170. The tubular balloon neck segment 220 is commonly held shut during the process of applying the adhesive exposing tensile force 176. The adhesive exposing tensile force 176 also tends to draw the internal circumferential edge of the dispensed adhesive roll 170 together. The balloon inflator would subsequently or simultaneously apply an adhesive bonding force 178 to the adhesive staging segment 172 as illustrated in FIG. 12. The adhesive bonding force 178 would collapse the dispensed adhesive roll 170, which would subsequently seal the tubular balloon neck segment 220. The adhesive material is preferably of a consistency resembling clay, putty, or the like. The compression generated by the adhesive bonding force 178 molds the adhesive material from a ring shape into a single, sealing blob. Once sealed, the adhesive bonding force 178 retains entrapped air 232 within the balloon gas retaining expansion cavity 210.

Any individual can deflate the self sealing balloon 200 by pulling the adhesive staging segment 172 open; separating the blob of adhesive material to form a venting passageway. The entrapped air 232 would be released through the venting passageway, deflating the balloon gas retaining expansion cavity 210. The deflated self sealing balloon 200 can be re-inflated and resealed if desired. It is noted that the re-inflation process can require additional finesse, as the dispensed adhesive roll 170 is no longer entrapped within the adhesive staging segment 172.

Figure 13:
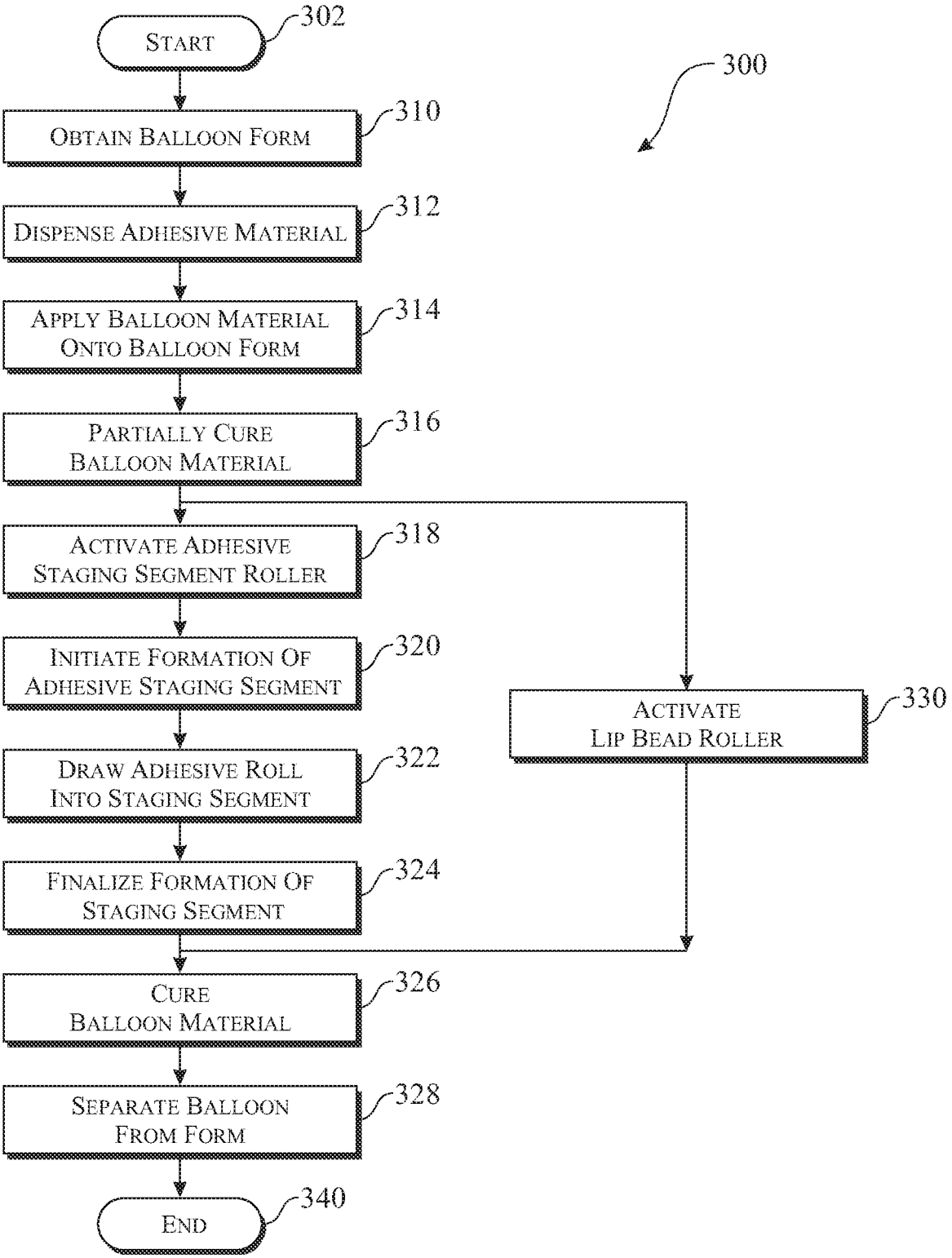
FIG. 13 presents a flow diagram detailing a first exemplary balloon fabrication process.
Figure 14:
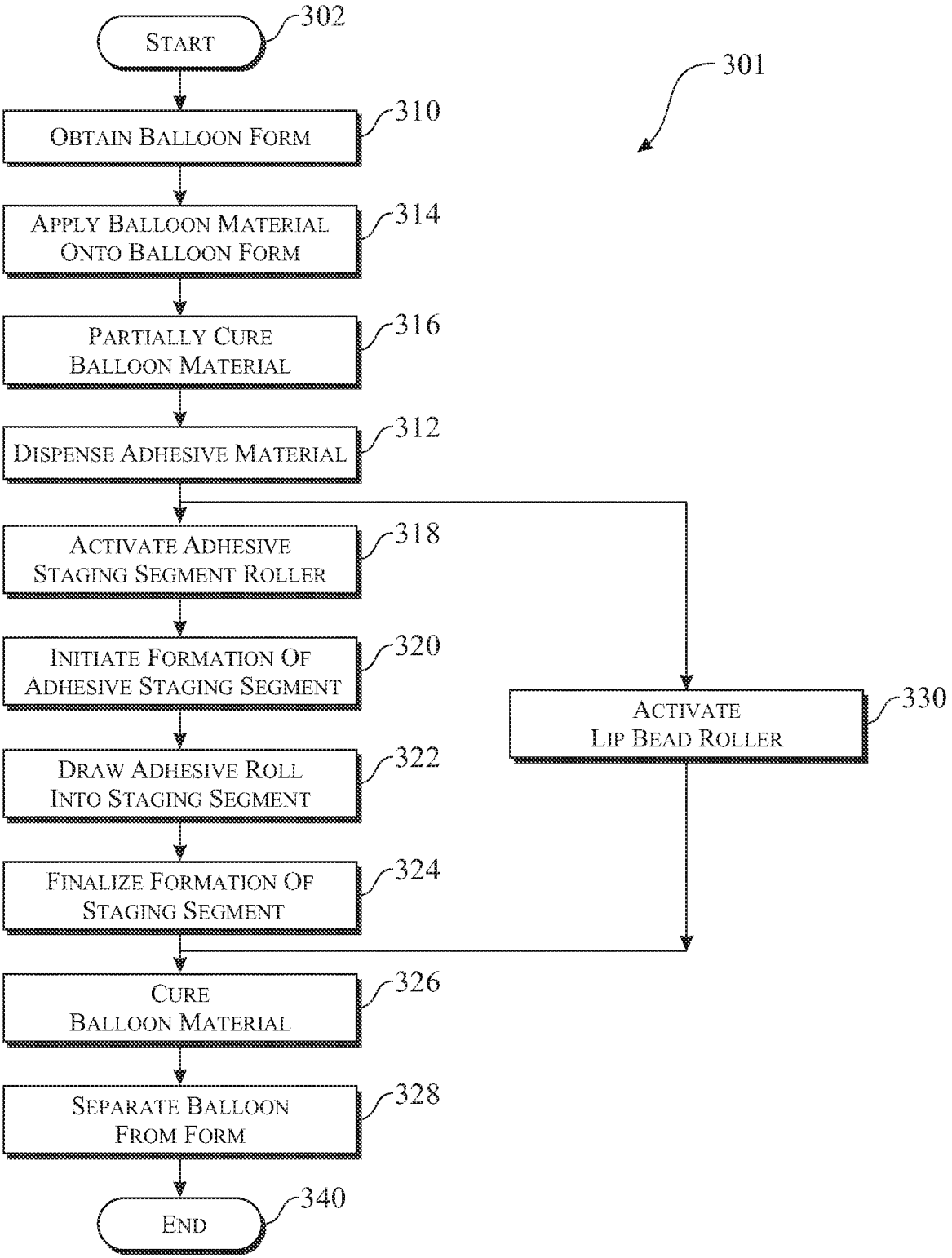
FIG. 14 presents a flow diagram detailing a second exemplary balloon fabrication process.

The self sealing balloon 200 can be fabricated in accordance with a variety of processes, including a first exemplary self-sealing balloon fabrication flow diagram 300 presented in FIG. 13 and a second exemplary self-sealing balloon fabrication flow diagram 301 presented in FIG. 14. The first exemplary self-sealing balloon fabrication flow diagram 300 initiates at a start step (block 302). A quick seal balloon fabrication form 100 is obtained in accordance with an obtain balloon form step 310. The quick seal balloon fabrication form 100 can be assembled to an automated device for automating the self-sealing balloon fabrication process. Adhesive material is dispensed into the adhesive dispensing segment 150 (block 312). The adhesive material can be dispensed from a remotely located adhesive material reservoir by a pump, a positive pressure displacement system, and the like. An optional, removable form can be placed about the adhesive dispensing segment 150 to aid in shaping the adhesive material into a dispensed adhesive roll 170. In the first exemplary self-sealing balloon fabrication flow diagram 300, balloon material is applied to the balloon form member 120 (block 314). The balloon material can be applied to the balloon form member 120 using any suitable application process, including dipping, spray, brush, rolling, and the like. During the process, the applied balloon material is at least partially cured (block 316).

The first exemplary self-sealing balloon fabrication flow diagram 300 and second exemplary self-sealing balloon fabrication flow diagram 301 differ wherein in the first exemplary self-sealing balloon fabrication flow diagram 300, the step of dispensing the adhesive material upon the adhesive dispensing segment 150 (block 312) is accomplished prior to the step of applying the balloon material onto the balloon form member 120 (block 314) and in the second exemplary self-sealing balloon fabrication flow diagram 301, the step of dispensing the adhesive material upon the adhesive dispensing segment 150 (block 312) is accomplished subsequent to the step of applying the balloon material onto the balloon form member 120 (block 314) and preferably after the balloon material is at least partially cured (block 316). In the second exemplary self-sealing balloon fabrication flow diagram 301, the balloon material can act as the optional, removable form.

The dispensed adhesive roll 170 is encased within an adhesive staging segment 172 by at least one adhesive staging segment roller 190 (blocks 318 through 324). The encasing process initiates by activating the at least one adhesive staging segment roller 190 (block 318). The at least one adhesive staging segment roller 190 frictionally engages with the exterior surface of the tubular balloon neck segment 220 to begin stretching the material to form the adhesive staging segment 172 (block 320). The at least one adhesive staging segment roller 190 continues to draw the section of the tubular balloon neck segment 220, where the interior surface of the tubular balloon neck segment 220 grips the dispensed adhesive roll 170 and draws the dispensed adhesive roll 170 into the adhesive staging segment 172 (block 322). The forming process continues until the adhesive staging segment 172 is formed into the desired shape, finalizing the formation of the adhesive staging segment 172 (block 324).

At any suitable point during the process, at least one lip bead roller 192 is activated and proceeds in forming a lip bead 224 at the balloon unfinished edge 222 of the tubular balloon neck segment 220 (block 330). It is understood that any known process can be utilized to form the lip bead 224.

If the balloon material is not yet cured, the process finalizes the curing of the balloon material (block 326). The self sealing balloon 200 is removed from the balloon form member 120 using any suitable separation process (block 328). At any suitable point in the process, an image can be applied to an exterior surface of the self sealing balloon 200. This image can be printed thereon, sprayed thereon, and the like. The self sealing balloon 200 can be fabricated of a single colored balloon material, a balloon material comprising a swirl of multiple colors, dipped at different levels into different vats of balloon material, each vat comprising a different balloon material color, and the like to create unique balloons 200. The self sealing balloon 200 may be tested to ensure against defects prior to packaging and shipping to a distributor, retailer, and the like, thus terminating the process (block 340).

Figure 15:
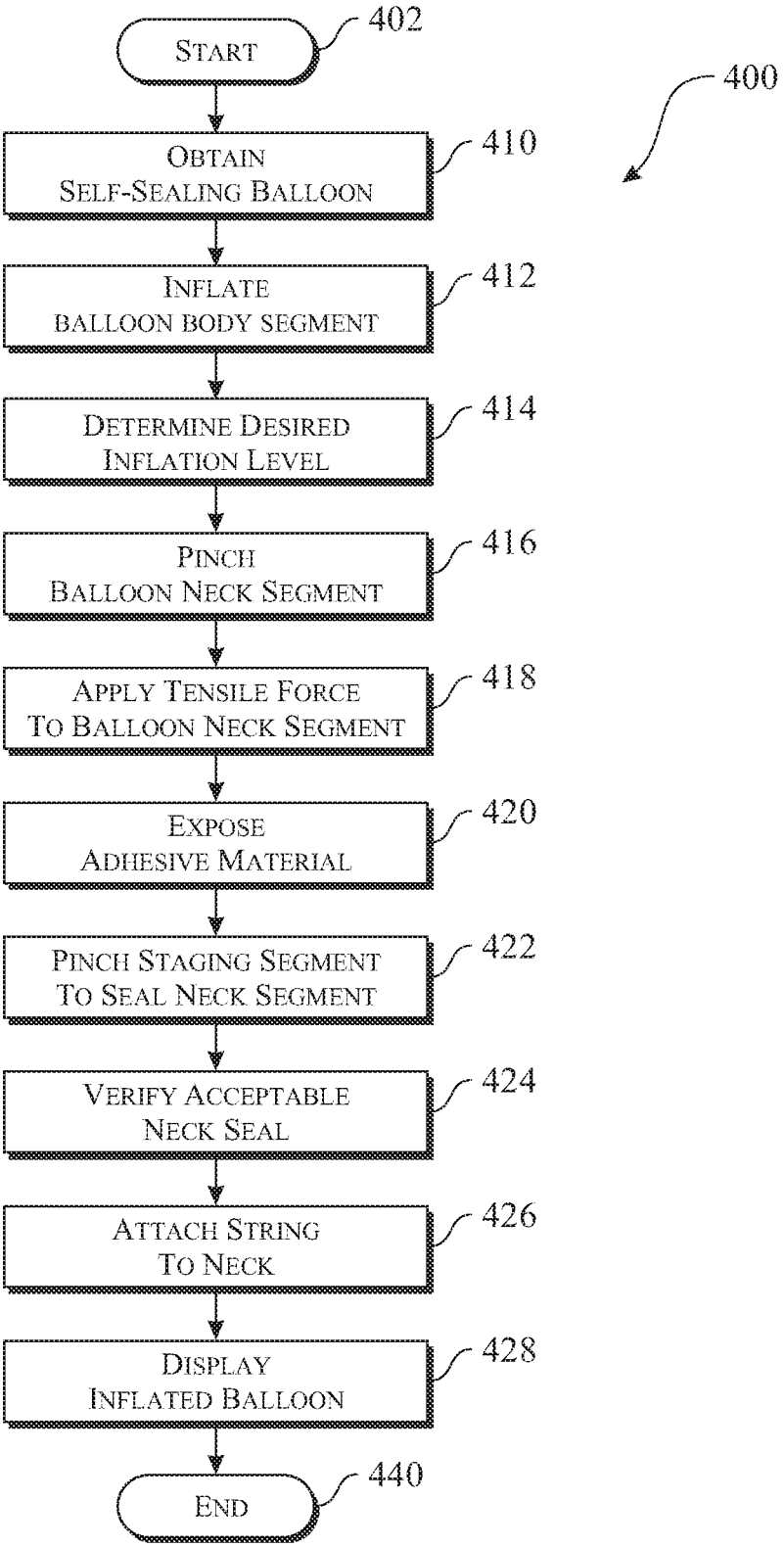
FIG. 15 presents a flow diagram detailing an exemplary balloon fill and sealing process.

The self sealing balloon 200 can be inflated in accordance with a variety of processes, with an exemplary self-sealing balloon inflation flow diagram 400 being presented in FIG. 15. The self-sealing balloon inflation flow diagram 400 initiates at a start step (block 402). A self sealing balloon 200 is obtained in accordance with an obtain a self-sealing balloon step 410. The balloon gas retaining expansion cavity 210 is inflated by passing pressurized inflating air 230 through the tubular balloon neck segment 220, causing the balloon gas retaining expansion cavity 210 to expand (block 412). The inflation step continues until the balloon gas retaining expansion cavity 210 is inflated to a desired fill level (block 414). The maximum inflation is commonly identified when the tubular balloon neck segment 220 begins to expand. When the balloon gas retaining expansion cavity 210 reaches the desired inflation level, the tubular balloon neck segment 220 is pinched to retain the entrapped air 232 therein (block 416). An adhesive exposing tensile force 176 is applied to the tubular balloon neck segment 220 in a direction parallel with the longitudinal axis thereof. (block 418). The adhesive exposing tensile force 176 unrolls the adhesive staging segment 172, exposing the dispensed adhesive roll 170 (block 420). A compression force or an adhesive bonding force 178 is applied to the area containing the exposed dispensed adhesive roll 170 to seal the tubular balloon neck segment 220 (block 422). The seal is inspected to determine if the seal is adequately retaining the entrapped air 232 within the balloon gas retaining expansion cavity 210 and a sealed, air entrapped neck segment 221 of the tubular balloon neck segment 220 (block 424). A thin, balloon supporting material, such as a string, a ribbon, and the like can be attached to the tubular balloon neck segment 220 of the self sealing balloon 200 (block 426). The thin, balloon supporting material is particularly useful for mooring balloons 200 that are filled with lighter than air gases, such as helium. The self sealing balloon 200 or multiple balloons 200 are displayed in accordance with the desired presentation (block 428), thus terminating the process (block 440).

Figure 16:
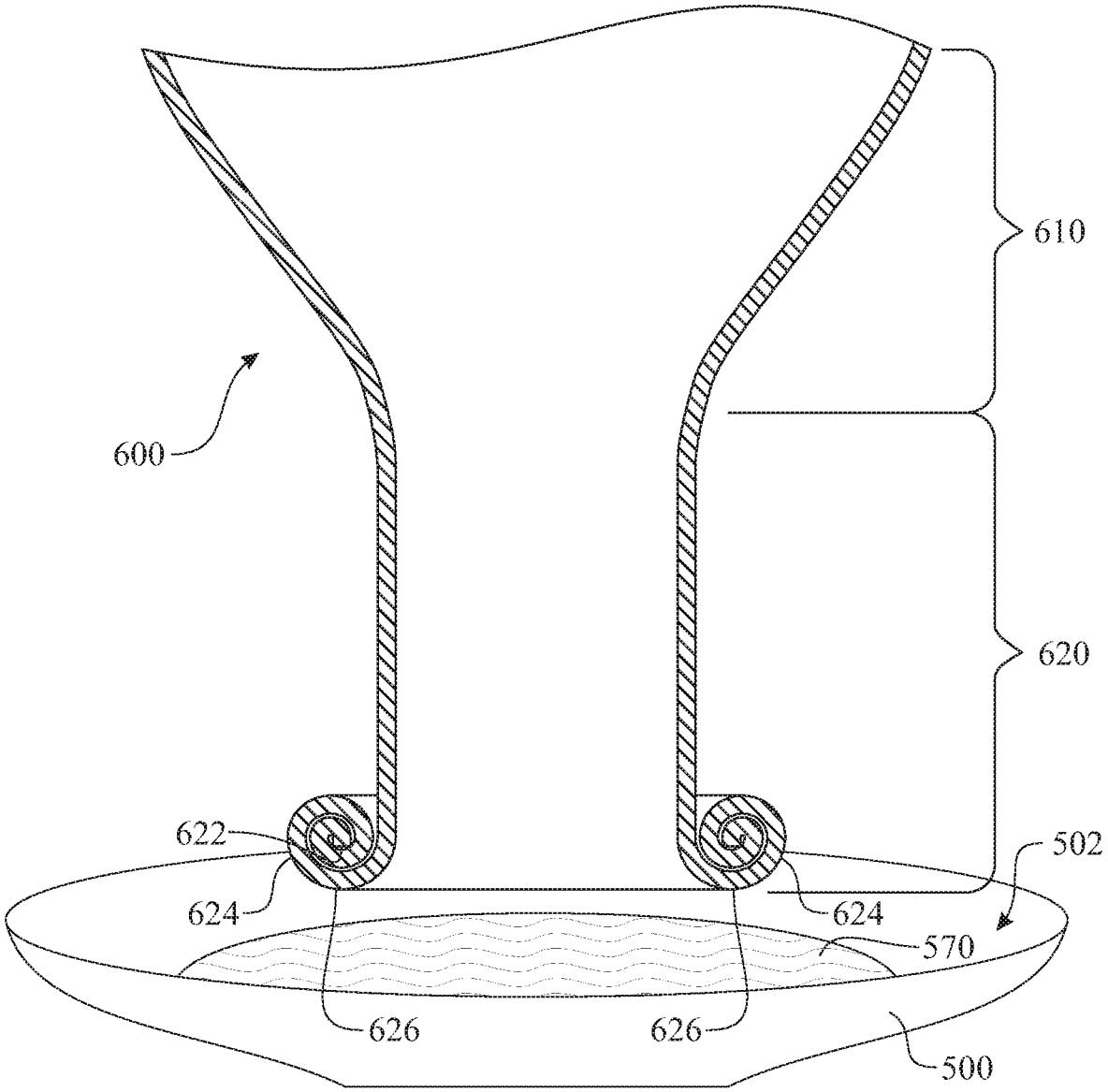
FIG. 16 presents a cross sectional elevation view of a neck section of an exemplary balloon prepared for a step of applying an adhesive bead to an exposed surface of a balloon lip bead.
Figure 17:
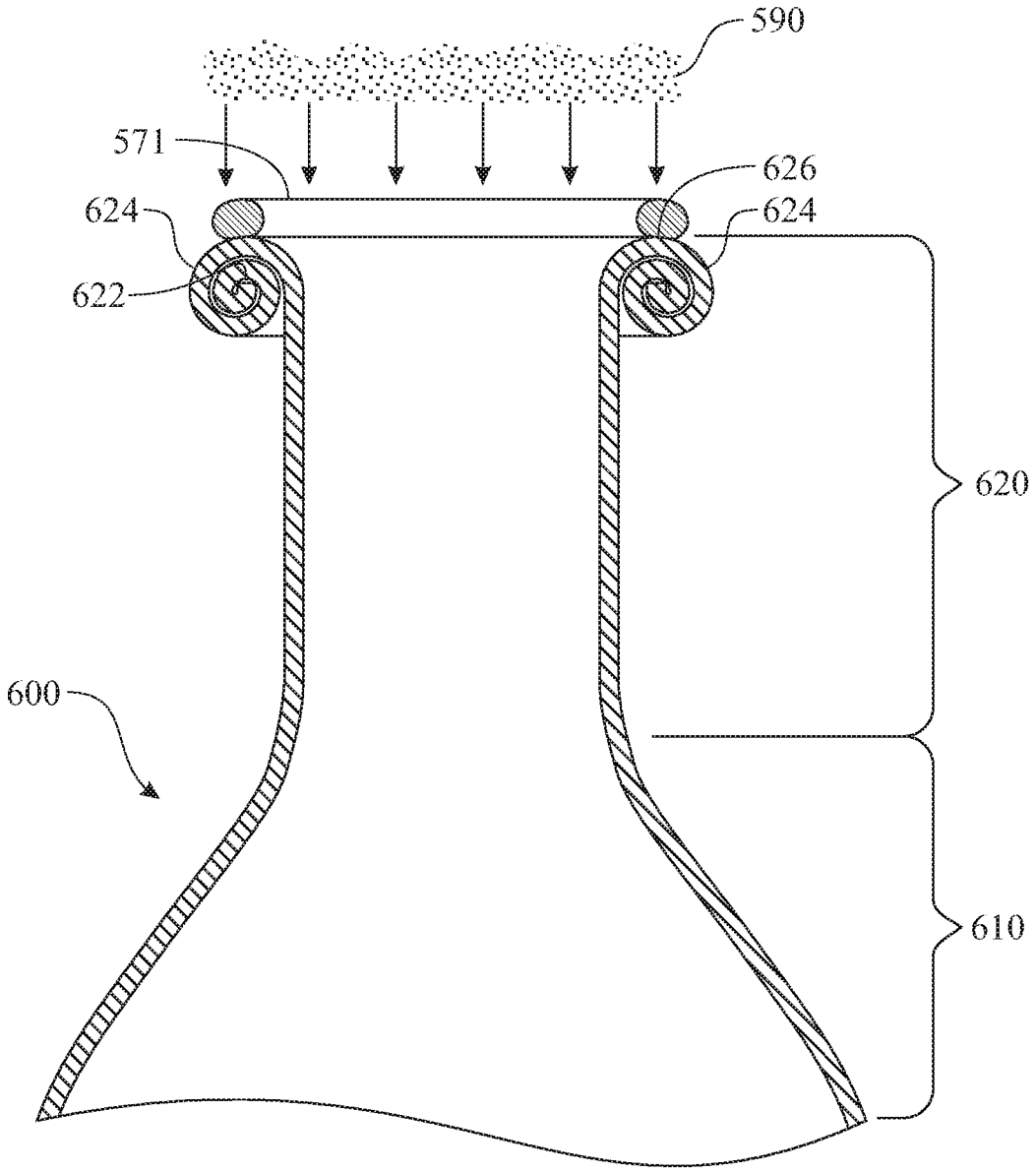
FIG. 17 presents a cross sectional elevation view of the neck section of the exemplary balloon subsequent to the preparation step presented in FIG. 16, wherein a protective talc power is being applied to the adhesive bead.
Figure 18:
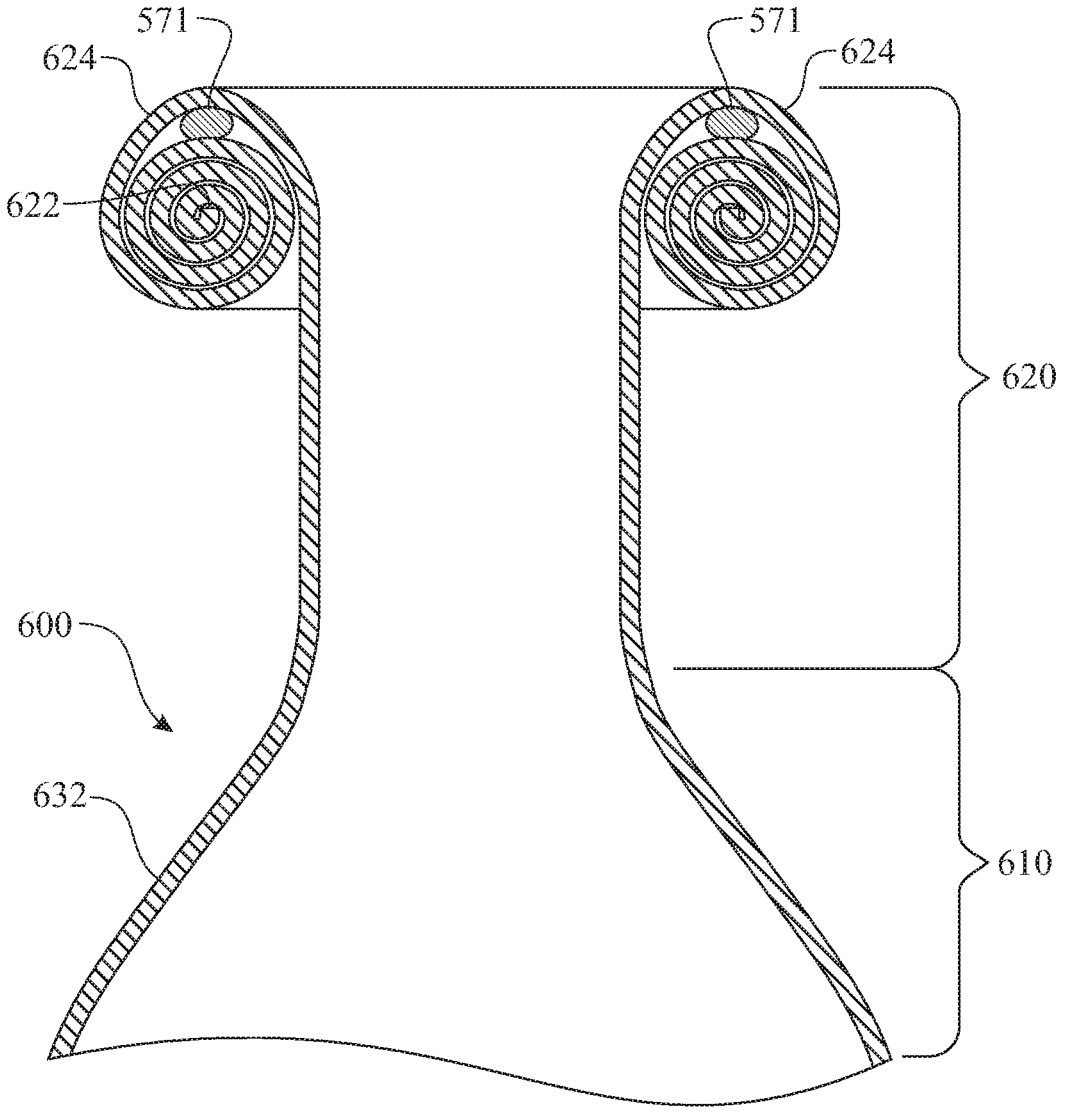
FIG. 18 presents a cross sectional elevation view of the neck section of the exemplary balloon having the adhesive bead rolled into the balloon lip bead.

The previously described balloon forming processes utilize a custom balloon form member 120 to fabricate the self sealing balloon 200. A self-sealing balloon 600, as illustrated in FIGS. 16 through 18, introduces an alternative embodiment for applying and encapsulating a moldable adhesive composition bead 571. The moldable adhesive composition bead 571 is created from a moldable adhesive composition 570 placed into an adhesive composition containing surface 502 of an adhesive composition presentation container 500. The self-sealing balloon 600 is similar to the self sealing balloon 200, with like elements of the self-sealing balloon 600 being numbered in a similar manner as the self-sealing balloon 600, with a prefix of the numeral "6". A lip bead adhesive receiving surface 626 of the lip bead 624 is inserted into the moldable adhesive composition 570 standing within the adhesive composition containing surface 502 of the adhesive composition presentation container 500. The moldable adhesive composition bead 571 is formed and adhered to the lip bead adhesive receiving surface 626 by adhesive properties of the moldable adhesive composition 570. An adhesive coating powder 590 can be applied to the exposed surface of the moldable adhesive composition bead 571 to aid in controlling undesired adhesion between the moldable adhesive composition bead 571 and the surface of the lip bead 624. Following the application of the adhesive coating powder 590 onto the moldable adhesive composition bead 571, the end of the lip of the self-sealing balloon 600 is rolled further encapsulating the moldable adhesive composition bead 571 within the lip bead 624, as illustrated in FIG. 18. The adhesive coating powder 590 aids in controlling a limited adhesion between the moldable adhesive composition bead 571 and the interior surface of the lip bead 624. In use, the self-sealing balloon 600 would be inflated, the tubular balloon neck segment 620 would be stretched and the lip bead 624 would be partially unrolled, exposing the moldable adhesive composition bead 571. The exposed moldable adhesive composition bead 571 would be compressed against itself, creating a gaseous seal. The moldable adhesive composition bead 571 would be of a formable material, enabling a simple sealing step compared to a tape adhesive, which could generate a leak if not bonded in a planar manner.

Figure 19:
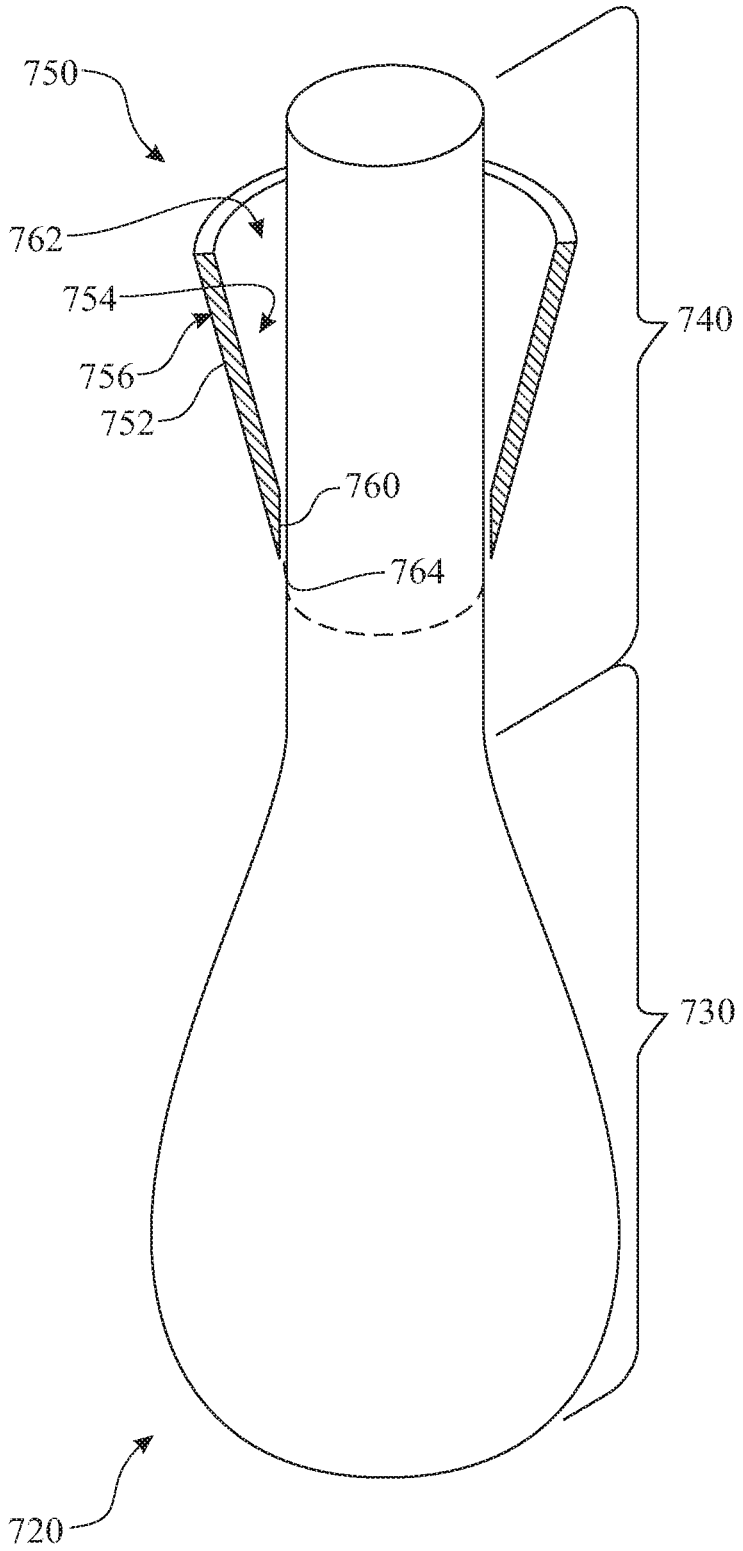
FIG. 19 presents a partial cross sectional elevation view of a balloon form introducing an adhesive dispensing adapter positioned thereabout.

Each balloon form member 120 requires a custom design, wherein the design is directed towards a fabrication of the self sealing balloon 200 by including the adhesive dispensing segment 150. A first variant is presented in FIGS. 19 through 21, wherein the adhesive dispensing segment 150 is replaced by an adhesive dispensing adapter 750 adapted to a balloon form member 720. The balloon form member 720 is segmented into a balloon body bulb shaped mold segment 730 and a balloon neck mold segment 740. The balloon form member 720 is representative of a currently fabricated balloon form, exclusive of the self sealing adhesive applicator, wherein the adhesive dispensing adapter 750 is adapted to the balloon form member 720, converting the balloon form member 720 a tool for manufacturing commercially available, standard tie-seal balloon to a tool capable of manufacturing a self-sealing balloon. This reduces the costs of converting existing tooling throughout an established balloon fabrication factory. The adhesive dispensing adapter 750 includes a frustum shaped adapter body 752 having an adhesive adapter interior surface 754 facing a surface of the balloon form member 720 defining an adhesive storage volumetric space 762 and an adhesive adapter exterior surface 756 providing a forming surface used in a fabrication process of forming a self-sealing balloon 800. The self-sealing balloon 800 is similar to the self sealing balloon 200, 600 with like elements of the self-sealing balloon 800 being numbered in a similar manner as the self-sealing balloon 200, 600, with a prefix of the numeral "8". An adhesive dispensing edge 760 is formed at a lower edge of the adhesive dispensing adapter 750, wherein the adhesive dispensing edge 760 has a diameter that is preferably slightly greater than a diameter of an adjacent section of the balloon neck mold segment 740 forming an adhesive dispensing passageway 764 therebetween. The adhesive dispensing adapter 750 can be frustum shaped, cylindrical comprising a chamfered transitional edge where the adhesive dispensing adapter 750 meets the balloon form member 720, or any other suitable shape for forming the self-sealing balloon 800, while enabling passage of an moldable adhesive composition 770 through the adhesive storage volumetric space 762 and discharging through the adhesive dispensing passageway 764.

Figure 8:
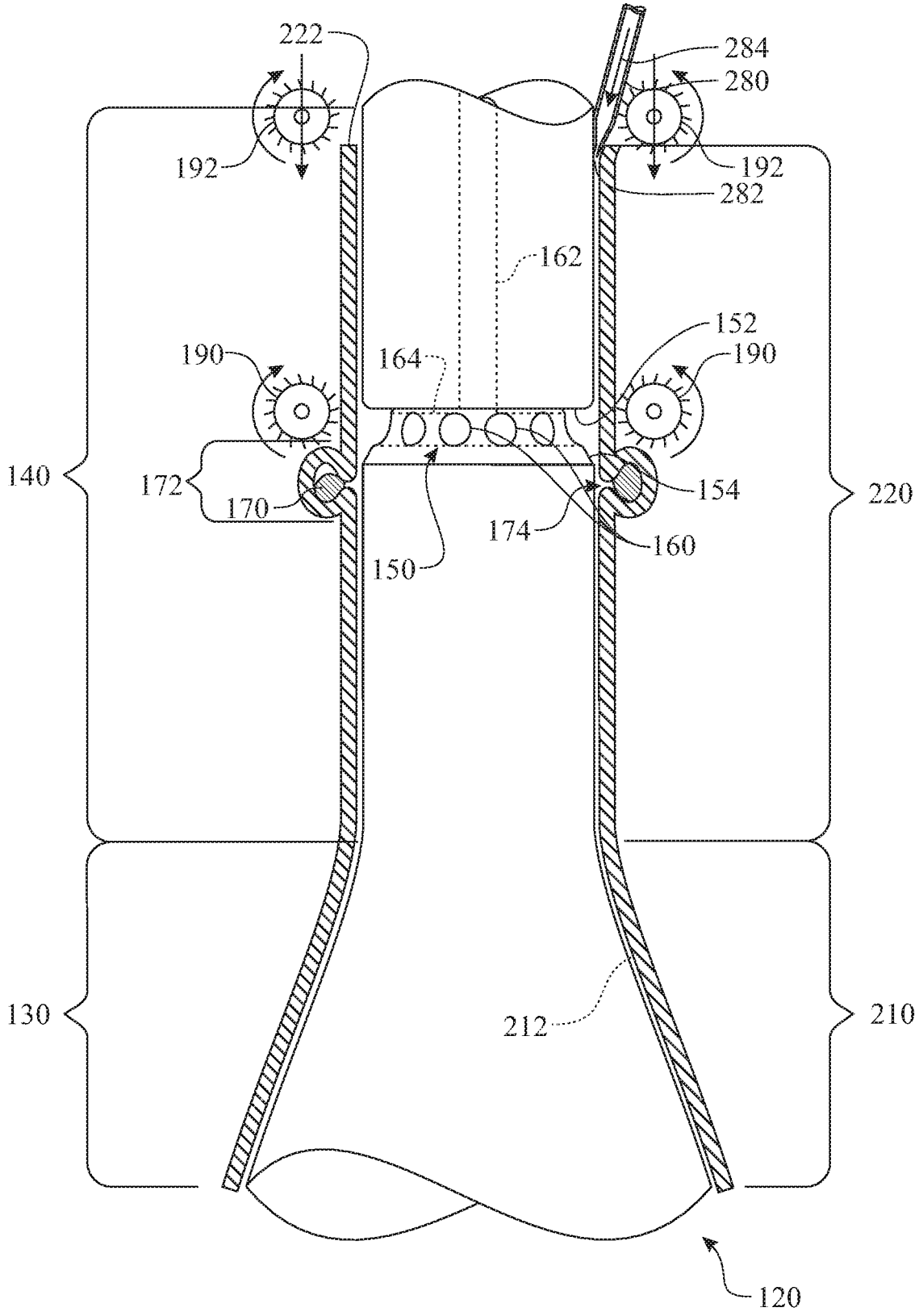
FIG. 8 presents a partially sectioned elevation view of the balloon neck mold segment illustrating an exemplary third step for forming an adhesive staging loop, wherein the third step completely encases the dispensed adhesive roll into the adhesive staging segment.
Figure 9:
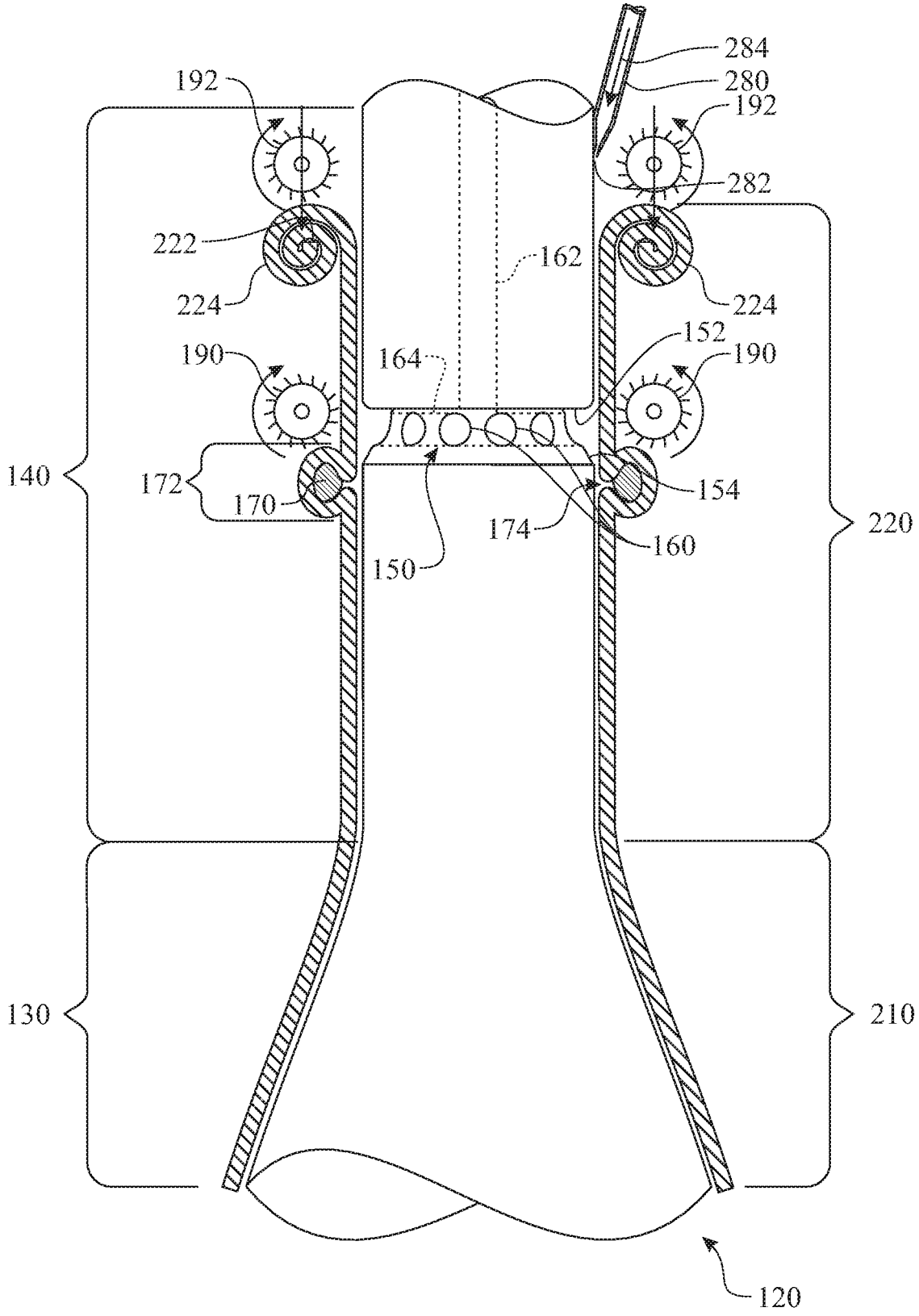
FIG. 9 presents a partially sectioned elevation view of the balloon neck mold segment illustrating an exemplary step of forming a lip bead.
Figure 20:
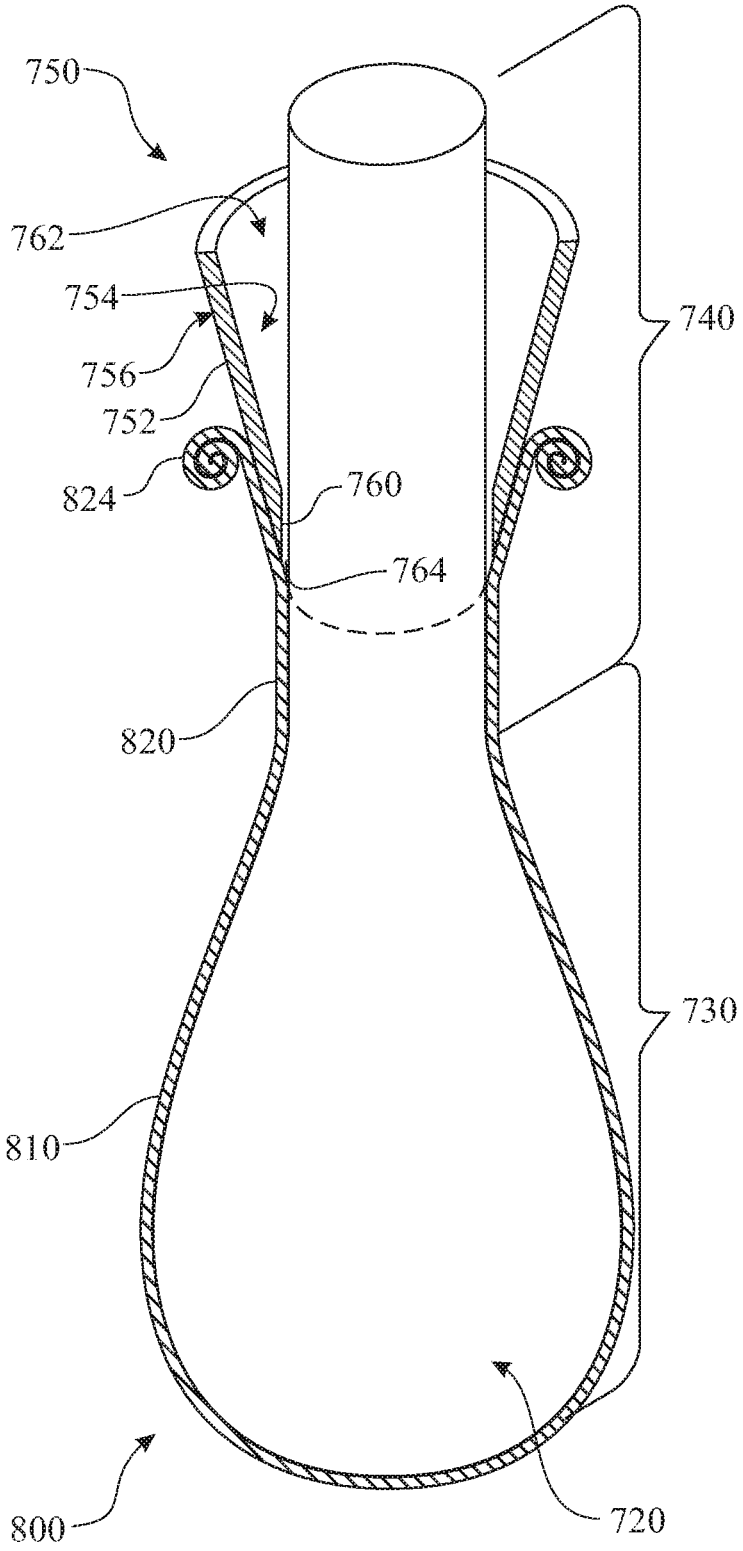
FIG. 20 presents a partial cross sectional elevation view of the balloon form introduced in FIG. 19, illustrating a self-sealing balloon in an initial forming step.
Figure 21:
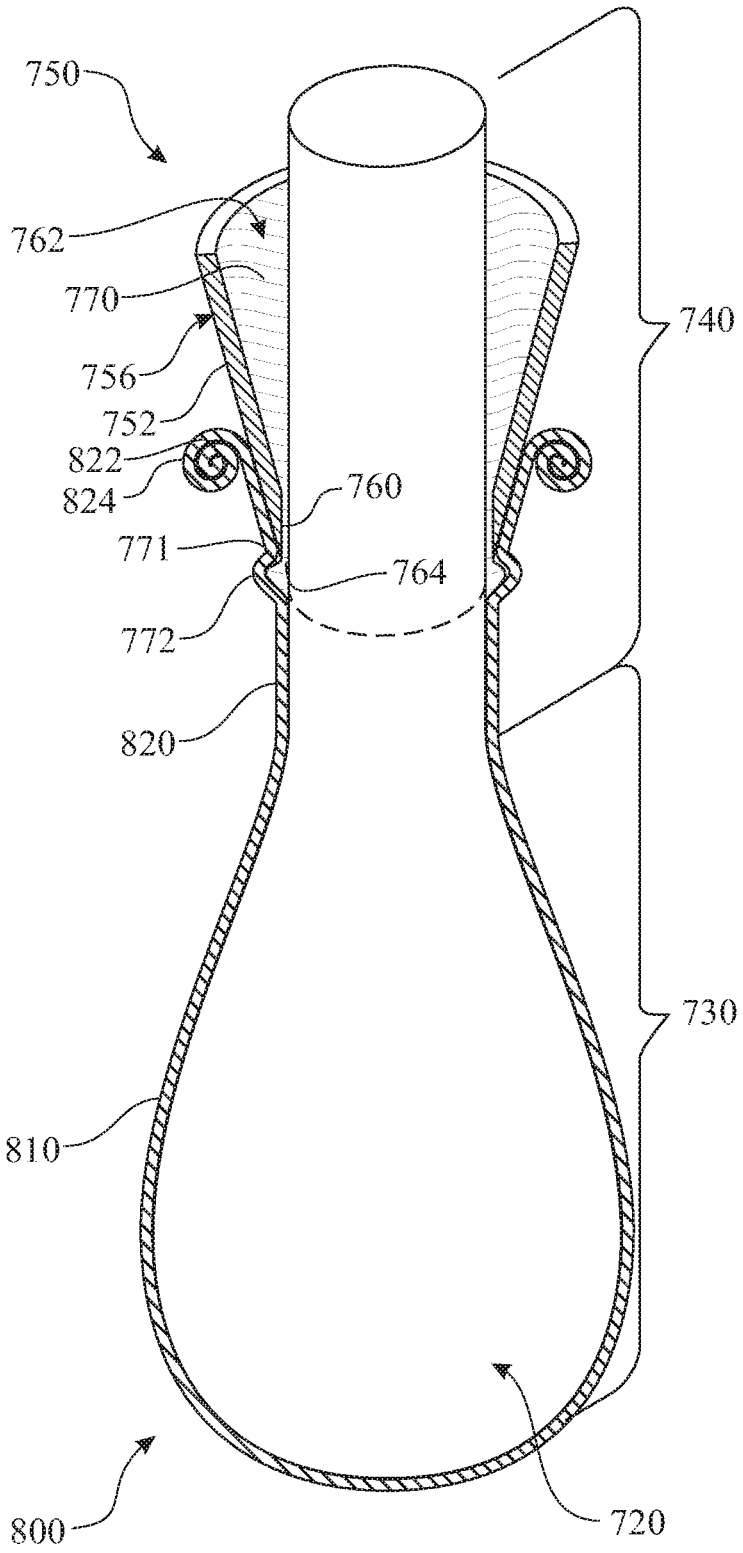
FIG. 21 presents a partial cross sectional elevation view of the balloon form introduced in FIG. 19, illustrating the self-sealing balloon in an adhesive dispensing step.

In practice, balloon forming material, such as latex, in liquid form, is applied to an exterior surface of the balloon form member 720 and the adhesive adapter exterior surface 756 as illustrated in FIG. 20. The balloon forming material is partially cured. A moldable adhesive composition 770 is dispensed into the adhesive storage volumetric space 762 and through the adhesive dispensing passageway 764 creating an applied moldable adhesive composition 771 as illustrated in FIG. 21. The applied moldable adhesive composition 771 displaces a section of the tubular balloon neck segment 820 forming an adhesive staging segment 772. The adhesive staging segment 772 is subsequently processed similar to the adhesive staging segment 172, as illustrated in FIG. 8. The advantage of the adhesive dispensing adapter 750 is the ability to fabricate the self-sealing balloon 800 while retaining the original balloon form member 720, thus avoiding significant retooling costs.

Figure 22:
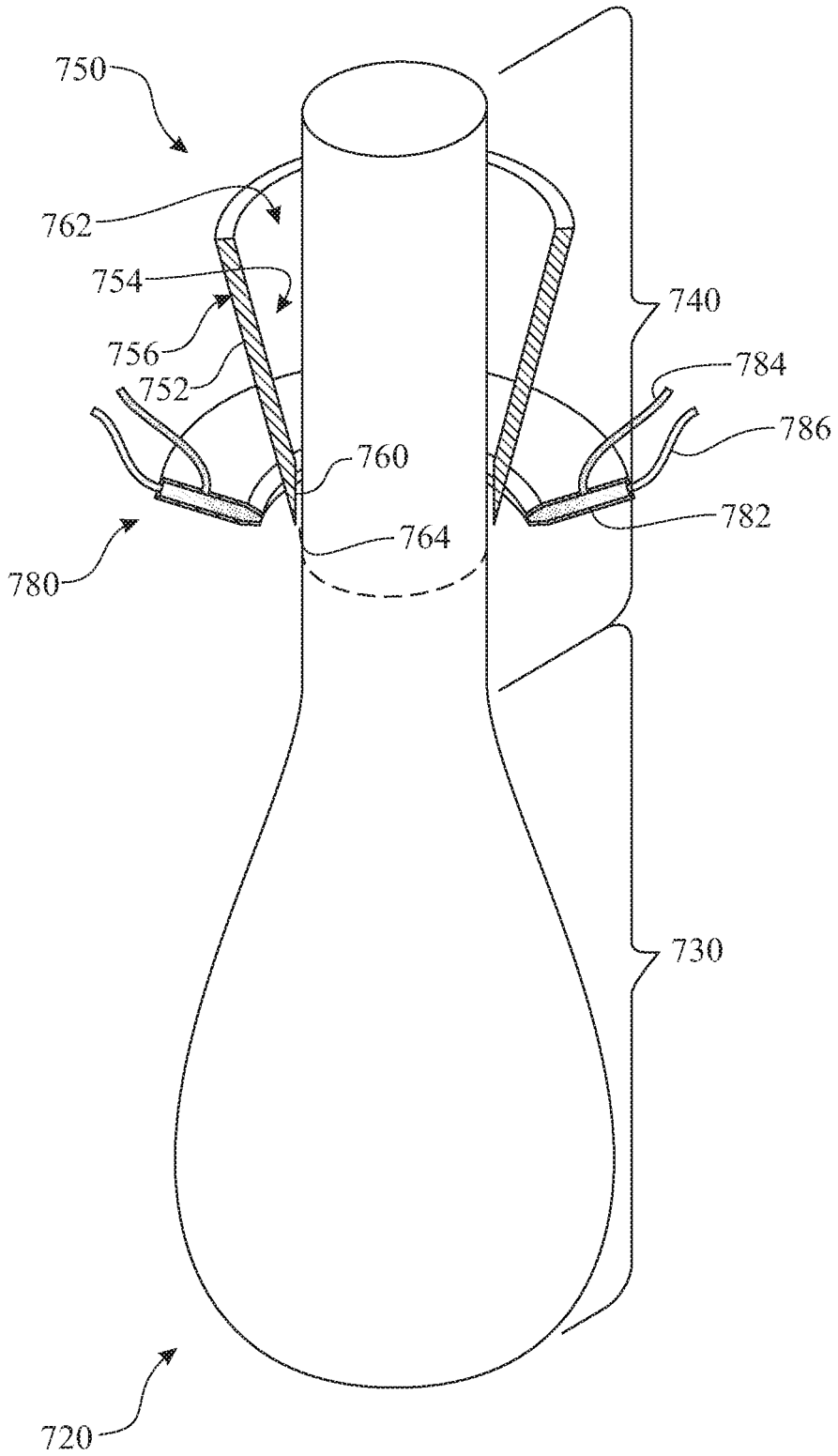
FIG. 22 presents a partial cross sectional elevation view of another exemplary balloon form comprising the same features as the balloon form presented in FIG. 19, introducing an exemplary power dispensing subsystem.
Figure 23:
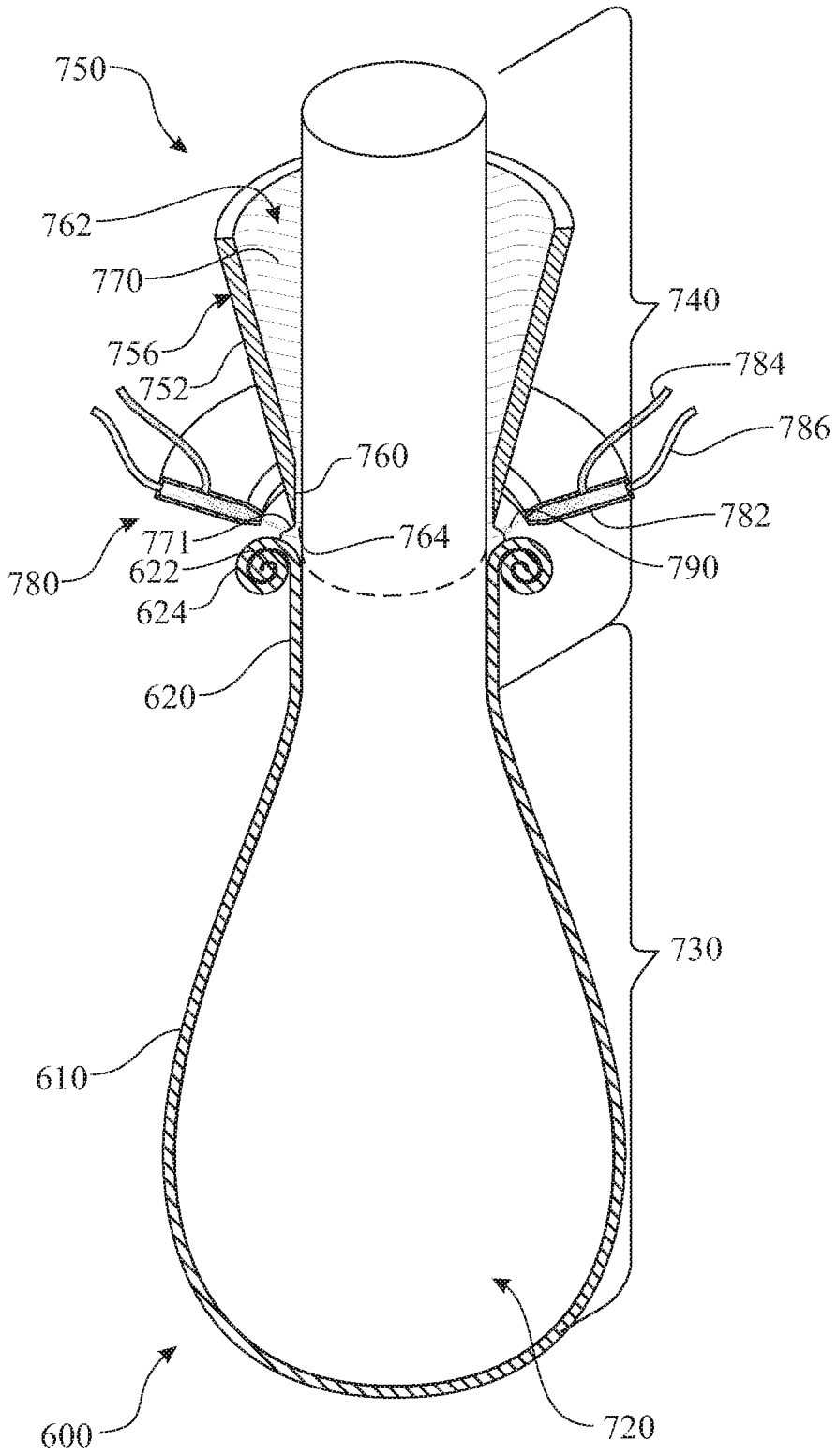
FIG. 23 presents a partial cross sectional elevation view of the balloon form introduced in FIG. 22, illustrating another exemplary self-sealing balloon in an adhesive dispensing and a powder application step.
Figure 24:
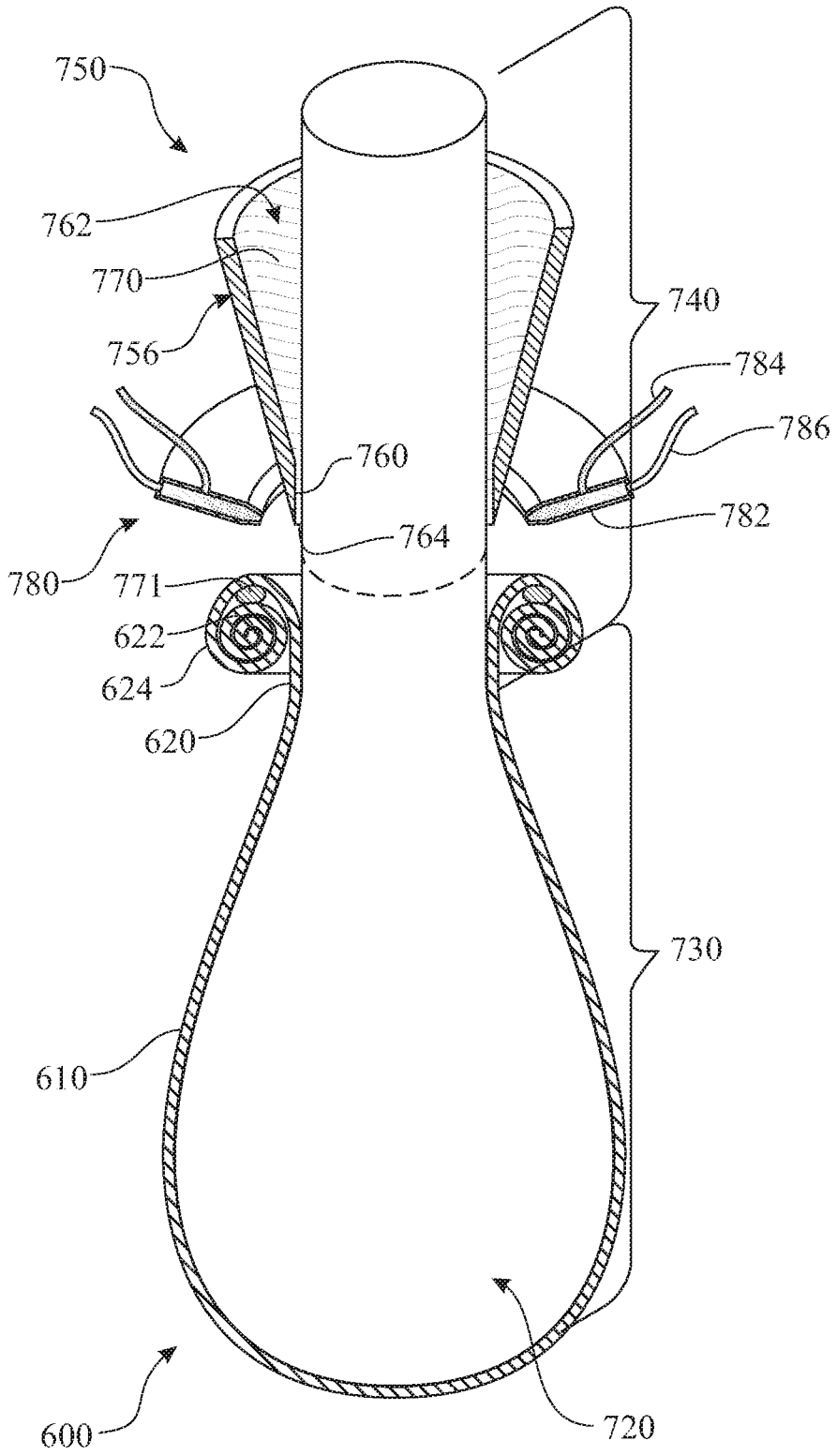
FIG. 24 presents a partial cross sectional elevation view of the balloon forming process introduced in FIG. 23, wherein the balloon lip bead is rolled encapsulating the dispensed adhesive.

The balloon fabrication process can be modified to introduce a powder applying subassembly 780 for application of a surface protecting powder 790 onto the applied moldable adhesive composition 771, as illustrated in FIGS. 22 through 24. The powder applying subassembly 780 is one exemplary system for dispensing the surface protecting powder 790 onto the applied moldable adhesive composition 771. The powder applying subassembly 780 comprises a powder applying mixing chamber 782 formed as a ring circumscribing the balloon neck mold segment 740 at a location proximate the adhesive dispensing passageway 764 and directed towards the applied moldable adhesive composition 771. The powder applying mixing chamber 782 is hollowed, creating a mixing chamber for combining the surface protecting powder 790 and flow of air or other propellant. The surface protecting powder 790 is sourced through a powder supply conduit 784. The flow of air or other propellant is sourced through a propellant supply conduit 786. As the air or other propellant flows through the hollowed interior of the powder applying mixing chamber 782, the air draws the surface protecting powder 790 into the hollowed interior of the powder applying mixing chamber 782 and propels the surface protecting powder 790 through a discharge port directed towards the applied moldable adhesive composition 771, as illustrated in FIG. 23. Like the adhesive dispensing adapter 750, the powder applying subassembly 780 is designed to be retrofitted onto the balloon form member 720. It is understood that the surface protecting powder 790 can be applied to the applied moldable adhesive composition 771 using any suitable system. The powder applying subassembly 780 would be designed to avoid any interference with the balloon dipping and forming process. The powder applying subassembly 780 can be segmented into two or more sections, enabling separation from the circumference of the balloon neck mold segment 740, providing unencumbered dipping of the balloon form member 720 into a vat of latex or other balloon forming material, then subsequently during a step of forming the lip bead 624.

Upon completion of the application of the surface protecting powder 790, the process would continue rolling the lip bead 624, entrapping the power coated applied moldable adhesive composition 771 therein as illustrated in FIG. 24.

Figure 25:
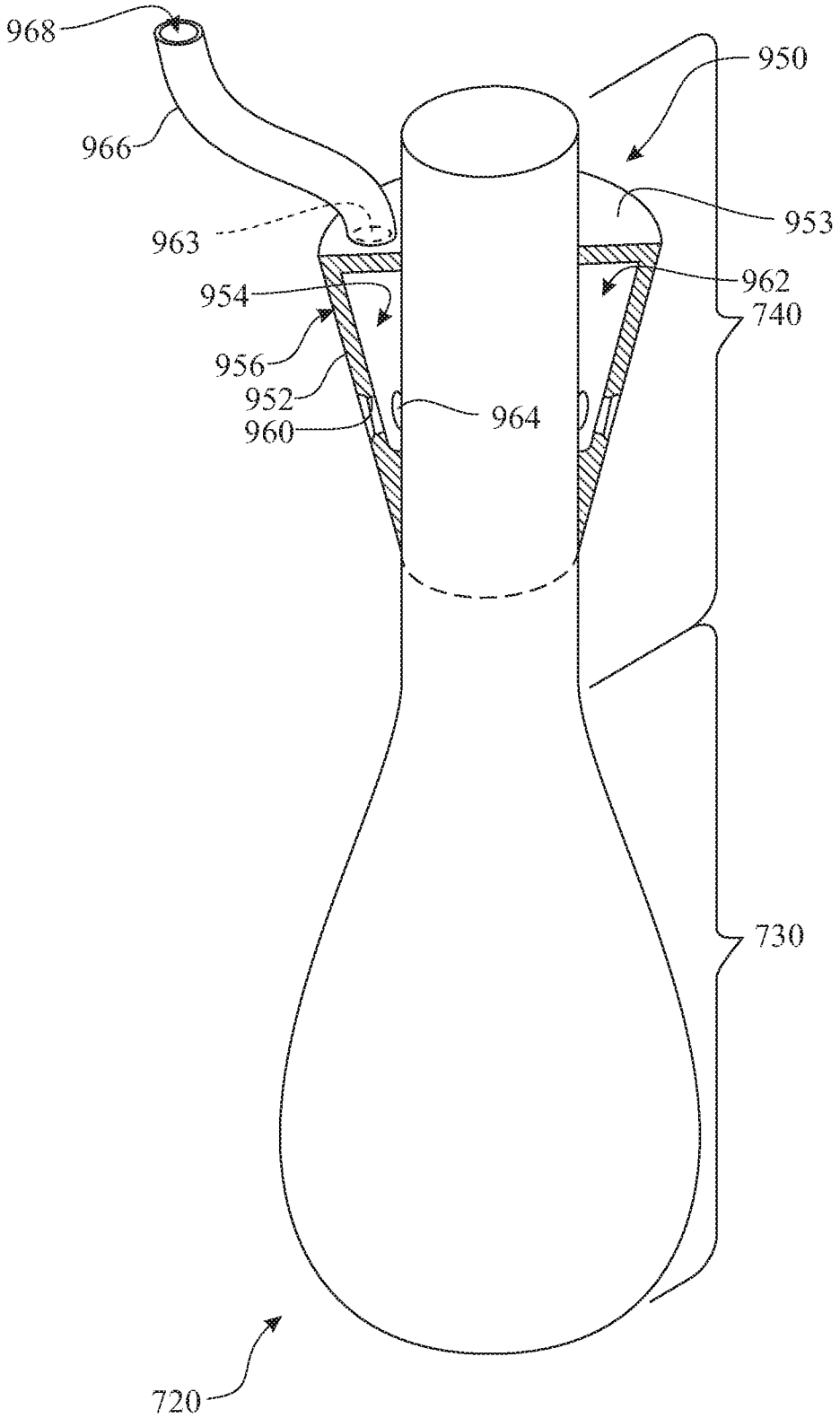
FIG. 25 presents a partial cross sectional elevation view of another exemplary balloon form comprising a variant of the adhesive dispensing subassembly introduced in FIG. 19, wherein the exemplary adhesive dispensing subassembly dispenses adhesive using applied pressure.
Figure 26:
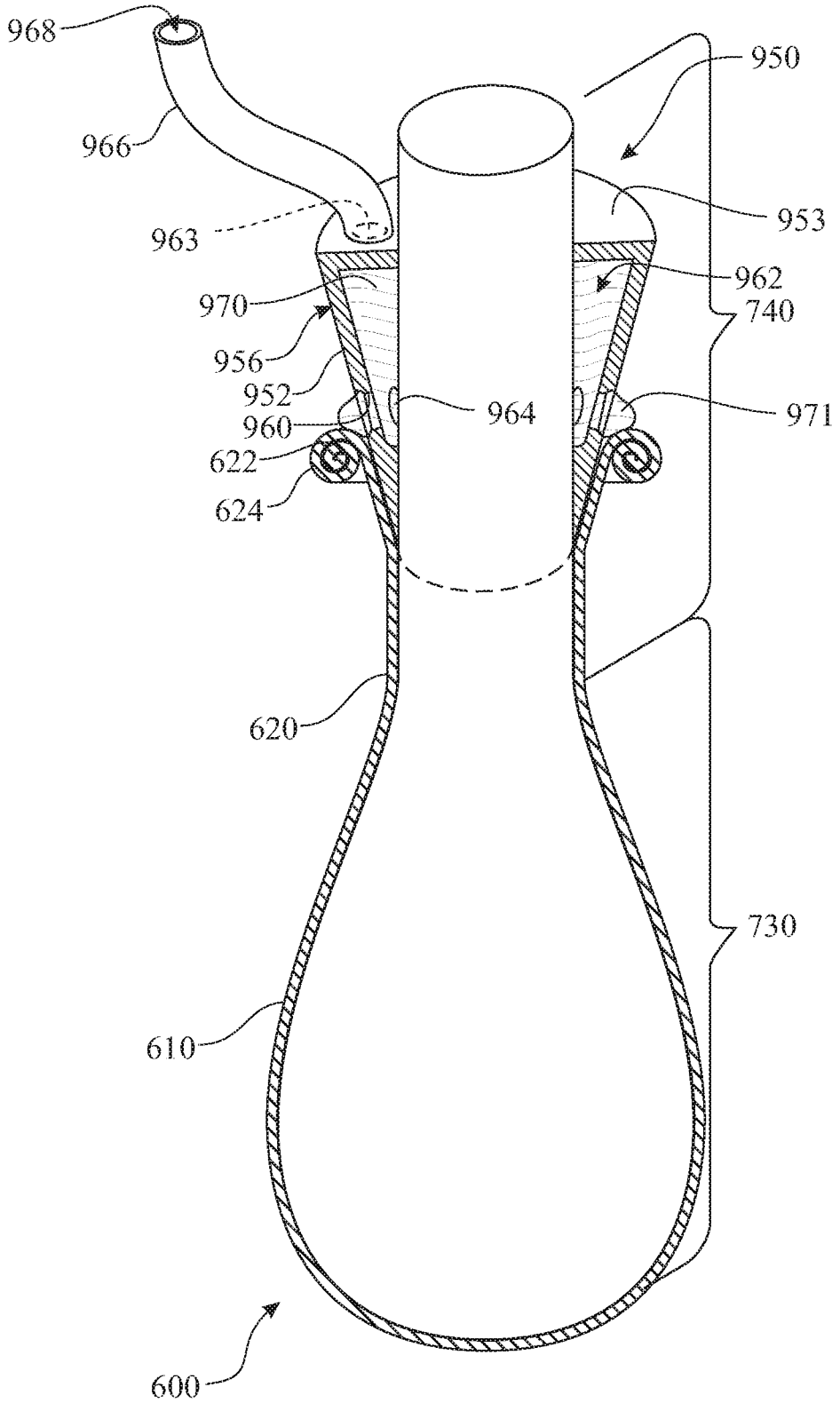
FIG. 26 presents a partial cross sectional elevation view of the balloon form introduced in FIG. 25, illustrating the exemplary self-sealing balloon in an alternative adhesive dispensing step.

Another variant of an adhesive applicator is an adhesive dispensing adapter 950, which is illustrated in FIGS. 25 and 26. The adhesive dispensing adapter 950 is a sealed, pressure operated variant of the adhesive dispensing adapter 750. The adhesive dispensing adapter 950 includes a frustum shaped adapter body 952 having an adhesive adapter interior surface 954 facing a surface of the balloon form member 720 defining an adhesive storage volumetric space 962 and an adhesive adapter exterior surface 956 providing a forming surface used in a fabrication process of forming the self-sealing balloon 600. A frustum shaped adapter body top panel 953 provides a seal across an upper edge of the frustum shaped adapter body 952 of the adhesive dispensing adapter 750. In the exemplary embodiment, a lower edge of the frustum shaped adapter body 952 of the adhesive dispensing adapter 950 seals against the exterior surface of the balloon form member 720. A volume of moldable adhesive composition 970 is fed into and/or disposed within the adhesive storage volumetric space 962. In the exemplary embodiment, the moldable adhesive composition 970 is dispensed through one or more adhesive dispensing passageways 964, each adhesive dispensing passageway 964 being defined by a respective adhesive dispensing orifice 960. The one or more adhesive dispensing passageways 964 are preferably located through the frustum shaped adapter body 952 of the adhesive dispensing adapter 950 proximate the lower edge. Like the adhesive dispensing adapter 750, the adhesive dispensing adapter 950 can be frustum shaped, cylindrical comprising a chamfered transitional edge where the adhesive dispensing adapter 950 meets the balloon form member 720, or any other suitable shape for forming the self-sealing balloon 600.

In use, a pressure would be applied to the adhesive storage volumetric space 962. The pressure into the adhesive storage volumetric space 962 can be provided by a flow of moldable adhesive composition 970, airflow, a piston, or any other suitable pressure forming source. In the exemplary embodiment, the moldable adhesive composition 970 is supplied to the adhesive storage volumetric space 962 through a propellant/adhesive supply conduit passageway 968 of a propellant/adhesive supply conduit 966. A supply line orifice 963 is formed through the frustum shaped adapter body top panel 953, providing fluid communication between the propellant/adhesive supply conduit passageway 968 and the adhesive storage volumetric space 962. The sourced moldable adhesive composition 970 provides the volume of material and the associated pressure for dispensing the moldable adhesive composition 970 to form the applied moldable adhesive composition 971. The formation of the applied moldable adhesive composition 971 would be controlled by the volume supplied through the propellant/adhesive supply conduit 966 and the time duration of the distribution (application of pressure). The process can optionally include the powder applying subassembly 780 for application of the surface protecting powder 790. Upon completion of the dispensing and formation of the applied moldable adhesive composition 771, the process would continue rolling the lip bead 624, entrapping the applied moldable adhesive composition 971 therein as illustrated in FIG. 24. The rolling process extrudes and distributes the applied moldable adhesive composition 971 evenly to accommodate any differences between adjacent adhesive dispensing orifices 960.

Figure 27:
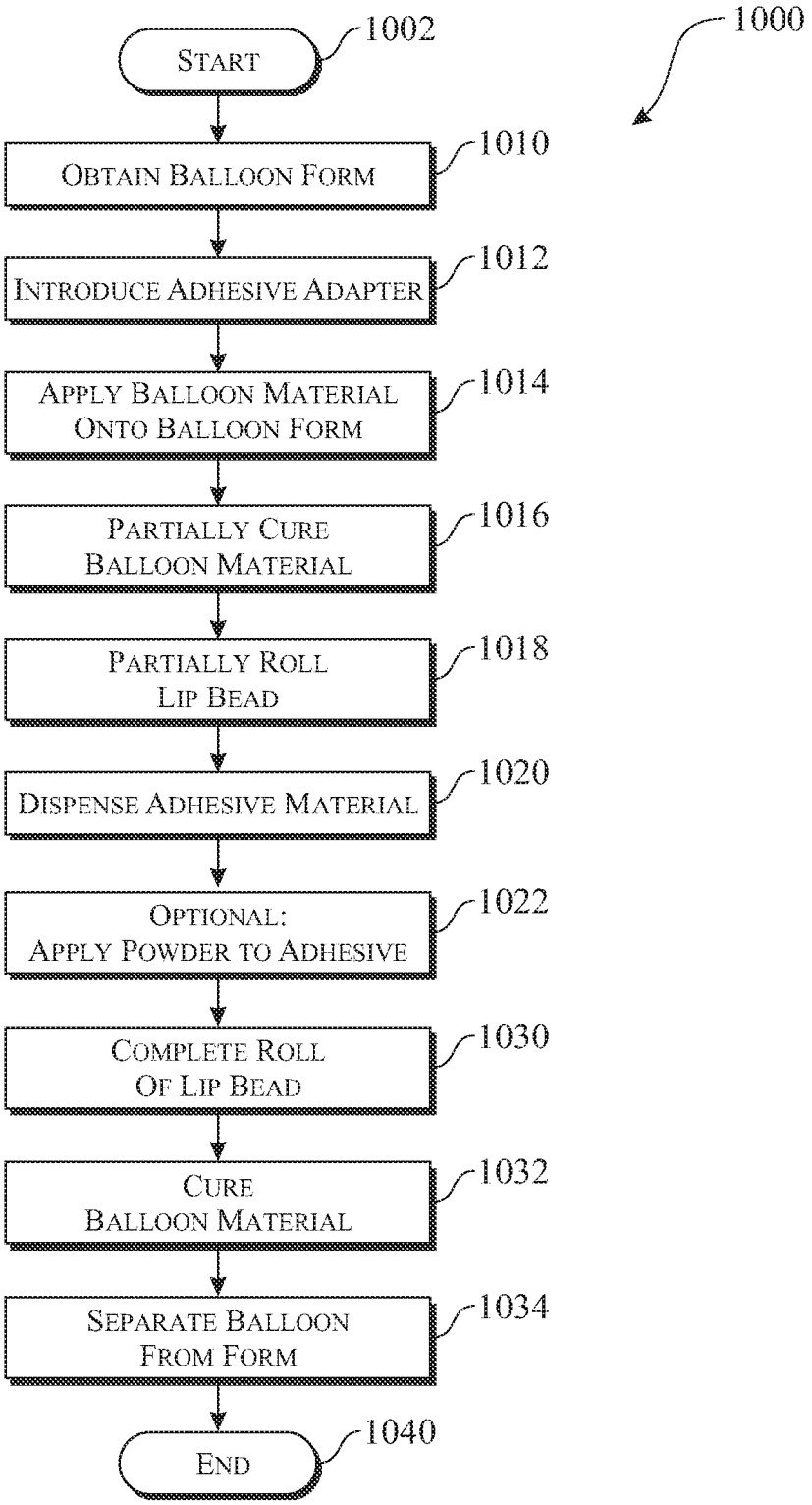
FIG. 27 presents a flow diagram detailing another exemplary balloon fabrication process.

The self sealing balloon 600 can be fabricated in accordance with a variety of processes, including a third exemplary self-sealing balloon fabrication flow diagram 1000 presented in FIG. 27. The third exemplary self-sealing balloon fabrication flow diagram 1000 initiates at a start step (block 1002). A balloon form member 720 is obtained in accordance with an obtain balloon form step 1010. The balloon form member 720 can be assembled to an automated device for automating the self-sealing balloon fabrication process. The adhesive dispensing adapter 750, 950, or a similar device is either preassembly or subsequently assembled to the balloon form member 720 in accordance with an introduction of the adhesive dispensing adapter 750, 950 step (block 1012). In the exemplary self-sealing balloon fabrication flow diagram 1000, balloon material is applied to the balloon form member 720, continuing up onto a lower portion of the adhesive dispensing adapter 750, 950 (block 1014). The balloon material can be applied to the balloon form member 720 and the adhesive dispensing adapter 750, 950 using any suitable application process, including dipping, spray, brush, rolling, and the like. During the process, the applied balloon material is at least partially cured (block 1016). The balloon forming process continues by partially rolling the balloon unfinished lip 622 along the tubular balloon neck segment 620 forming the lip bead 624. The rolling process would roll the lip bead 624 to a position proximate to, while exposing the adhesive dispensing passageway 764 as shown in FIG. 23 or below the series of adhesive dispensing orifice 960, as shown in FIG. 26.

Adhesive material is dispensed onto the lip bead adhesive receiving surface 626 by adhesive dispensing adapter 750, 950 (block 1020) as illustrated in FIGS. 23 and 26. The adhesive material can be supplied to the adhesive dispensing adapter 750, 950 from a remotely located adhesive material reservoir by a pump, a positive pressure displacement system, and the like. It is also understood that the process described herein is partially applicable to the dipping process described in FIGS. 16 through 18. The exemplary self-sealing balloon fabrication flow diagram 1000. An optional step of applying a powder 790, such as a talc powder, to the exposed surface of the applied moldable adhesive composition 771, 971 can be accomplished using the powder applying subassembly 780 or a similar powder dispensing system (block 1022). The surface protecting powder 790 manages adhesion between the applied moldable adhesive composition 771 and the surface of the self-sealing balloon 600, within the lip bead 624 (or alternatively within the adhesive staging segment 172 when the applied moldable adhesive composition 771 is entrapped therein). The process continues rolling the lip bead 624 in accordance with a completion of rolling the lip bead step (block 1030). It is understood that any known process can be utilized to form the lip bead 224. If the balloon material is not yet cured, the process finalizes the curing of the balloon material (block 1032). The self sealing balloon 200 is removed from the balloon form member 120 using any suitable separation process (block 1034). At any suitable point in the process, an image can be applied to an exterior surface of the self sealing balloon 600. This image can be printed thereon, sprayed thereon, and the like. The self sealing balloon 600 can be fabricated of a single colored balloon material, a balloon material comprising a swirl of multiple colors, dipped at different levels into different vats of balloon material, each vat comprising a different balloon material color, and the like to create unique balloons 600. The self sealing balloon 600 may be tested to ensure against defects prior to packaging and shipping to a distributor, retailer, and the like, thus terminating the process (block 1040).

Figure 28:
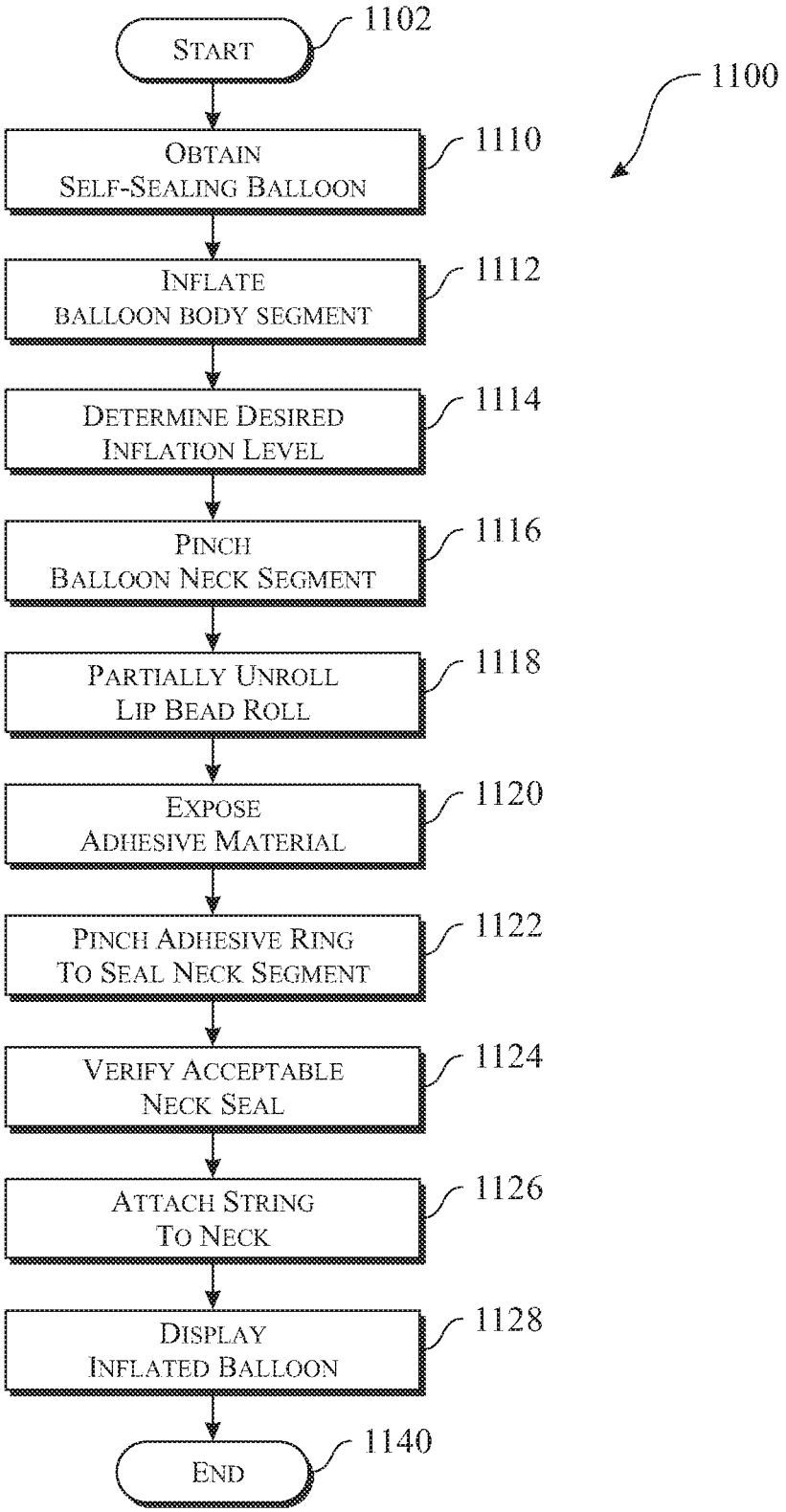
FIG. 28 presents a flow diagram detailing another exemplary balloon fill and sealing process.

The self sealing balloon 600 can be inflated in accordance with a variety of processes, with an exemplary self-sealing balloon inflation flow diagram 1100 being presented in FIG. 28. The self-sealing balloon inflation flow diagram 1100 initiates at a start step (block 1102). A self sealing balloon 600 is obtained in accordance with an obtain a self-sealing balloon step 1110. The balloon gas retaining expansion cavity 610 is inflated by passing pressurized inflating air through the tubular balloon neck segment 620, causing the balloon gas retaining expansion cavity 610 to expand (block 1112). The inflation step continues until the balloon gas retaining expansion cavity 610 is inflated to a desired fill level (block 1114). The maximum inflation is commonly identified when the tubular balloon neck segment 620 begins to expand. When the balloon gas retaining expansion cavity 610 reaches the desired inflation level, the tubular balloon neck segment 620 is pinched to retain entrapped air therein (block 1116). The lip bead 624 would then be unrolled (block 1118) until the applied moldable adhesive composition 771 is exposed (block 1120). The moldable adhesive ring would then be pinched or compressed together forming a gas impervious seal across the tubular balloon neck segment 620 (block 1122). The seal is inspected to determine if the seal is adequately retaining air entrapped within the balloon gas retaining expansion cavity 610 and a sealed, air entrapped neck segment of the tubular balloon neck segment 620 (block 1124). A thin, balloon supporting material, such as a string, a ribbon, and the like can be attached to the tubular balloon neck segment 620 of the self sealing balloon 600 (block 1126). The thin, balloon supporting material is particularly useful for mooring balloons 600 that are filled with lighter than air gases, such as helium. The self sealing balloon 600 or multiple self sealing balloons 600 are displayed in accordance with the desired presentation (block 1128), thus terminating the process (block 1140).

In a portion of the above exemplary methods for applying the sealing adhesive to the neck of the balloon initially applies the sealing adhesive to a balloon form prior to an application of liquid latex upon the balloon form to manufacture the balloon. A second portion of the above exemplary methods for applying the sealing adhesive to the neck of the balloon initially applies the sealing adhesive to a prefabricated balloon, wherein the balloon neck is partially rolled. The process comprises a step of dipping the rolled portion of the balloon neck into a volume of sealing adhesive.

Another exemplary method of applying a sealing adhesive to an interior surface of a balloon neck is illustrated in a series of steps presented in FIGS. 29 through 36. The exemplary process illustrated in FIGS. 29 through 36 details an alternate process for applying the sealing adhesive to a prefabricated balloon.

The process employs a sealing adhesive applicator assembly 1300 for aiding the process for applying the sealing adhesive to a prefabricated balloon. The sealing adhesive applicator assembly 1300 includes an adhesive applicator balloon neck sleeve element 1350 slideably assembled to a sealing adhesive applicator balloon neck support element 1310. The sealing adhesive applicator balloon neck support element 1310 includes an elongated, tubular structure preferably formed having a balloon neck support element, frustum shaped lead-in segment 1312 located at a free end of the sealing adhesive applicator balloon neck support element 1310. A section of the sealing adhesive applicator balloon neck support element 1310 extending rearward from the balloon neck support element, frustum shaped lead-in segment 1312 is preferably formed having a continuous cross section shape and size. The sealing adhesive applicator balloon neck support element 1310 can include distance indicators, such as a balloon neck support element, distal segment indicator 1315 and a balloon neck support element, proximal segment indicator 1317. A segment of the sealing adhesive applicator balloon neck support element 1310 extending between the rearward end of the balloon neck support element, frustum shaped lead-in segment 1312 and the balloon neck support element, distal segment indicator 1315 is identified as a balloon neck support element, distal parallel shaped segment 1314. A segment of the sealing adhesive applicator balloon neck support element 1310 extending between the balloon neck support element, distal segment indicator 1315 and the balloon neck support element, proximal segment indicator 1317 is identified as a balloon neck support element, central adhesive applicator segment 1316. The balloon neck support element, distal segment indicator 1315 and the balloon neck support element, proximal segment indicator 1317 are used as references when placing a neck portion of a prefabricated balloon onto the sealing adhesive applicator balloon neck support element 1310.

The adhesive applicator balloon neck sleeve element 1350 is designed to define a balloon neck sleeve element, interior cavity 1356. The balloon neck sleeve element, interior cavity 1356 would be accessible through an opening defined by a free end of the balloon neck sleeve element, frustum shaped lead-in segment 1352. An inner boundary of the balloon neck sleeve element, interior cavity 1356 is defined by an exterior surface of the sealing adhesive applicator balloon neck support element 1310. The adhesive applicator balloon neck sleeve element 1350 is slideably assembled to the sealing adhesive applicator balloon neck support element 1310. The sliding interface created between the adhesive applicator balloon neck sleeve element 1350 and the sealing adhesive applicator balloon neck support element 1310 can be provided by any suitable design. The exemplary illustration includes a pair of radially arranged support elements 1362, 1364 extending inward from an interior surface of the balloon neck sleeve element, distal parallel shaped segment 1354. Each of the radially arranged support elements 1362, 1364 includes a balloon neck sleeve support surface 1363, 1365. The balloon neck sleeve support surfaces 1363, 1365 are designed to slideably engage with the exterior surface of the sealing adhesive applicator balloon neck support element 1310. At least one stop can be integral with the exterior surface of the sealing adhesive applicator balloon neck support element 1310, wherein one stop can be located to limit a sliding motion of the adhesive applicator balloon neck sleeve element 1350 in a first direction and a second stop can be located to limit a sliding motion of the adhesive applicator balloon neck sleeve element 1350 in a second, or opposite direction. Each at least one stop can be any suitable formation, such as a bossed feature extending outward from the exterior surface of the sealing adhesive applicator balloon neck support element 1310, a flange extending outward from the exterior surface of the sealing adhesive applicator balloon neck support element 1310, and the like. In an enhanced version, the sliding elements can include a sliding bearing, a linear slide bearing, a bearing sleeve, and the like.

The sealing adhesive applicator assembly 1300 preferably includes an automated or semi-automated sealing adhesive applicator, such as an adhesive dispenser assembly 1380. The adhesive dispenser assembly 1380 can be of any suitable dispensing design capable of applying the sealing adhesive 1390 onto the prefabricated balloon or the sealing adhesive applicator balloon neck support element 1310. The sealing adhesive 1390 is delivered to an adhesive dispenser 1382 by an adhesive supply conduit 1384. The delivery system can also provide sufficient pressure to dispense the adhesive 1390 onto a target surface, such as an interior surface of the balloon neck. An adhesive dispensing orifice 1386 is formed through adhesive dispenser 1382, wherein the adhesive dispensing orifice 1386 is designed to transfer the adhesive 1390 from the adhesive dispenser 1382 to the target surface. The adhesive dispensing orifice 1386 can include a single orifice or dispensing passage (as shown) or a series of dispensing passages. The adhesive dispenser 1382 can be formed to include a nozzle shape leading to the adhesive dispensing orifice 1386. The exemplary adhesive dispenser assembly 1380 includes an adhesive dispenser assembly 1380 that is preferably positionably adjustable to stage to and retract from a dispensing position. The movements of the adhesive dispenser assembly 1380 can be accomplished by employing any of a variety of manual and/or automated movement mechanisms. The adhesive dispenser assembly 1380 can employ a pressure system, a screw drive system, a piston drive system or any other suitable mechanism for dispensing the adhesive 1390 from the adhesive dispenser assembly 1380.

The sealing adhesive applicator assembly 1300 is designed to aid in an application of a bead of adhesive 1390 onto an interior surface 1426 of a balloon neck 1420 of a prefabricated self-sealing balloon 1400. The prefabricated self-sealing balloon 1400 is similar to the self-sealing balloon 200, 600. The self-sealing balloon 1400 is similar to the self sealing balloons 200, 600 with like elements of the self-sealing balloon 1400 being numbered in a similar manner as the self-sealing balloon 200, 600, with a prefix of the numeral "14".

Figure 37:
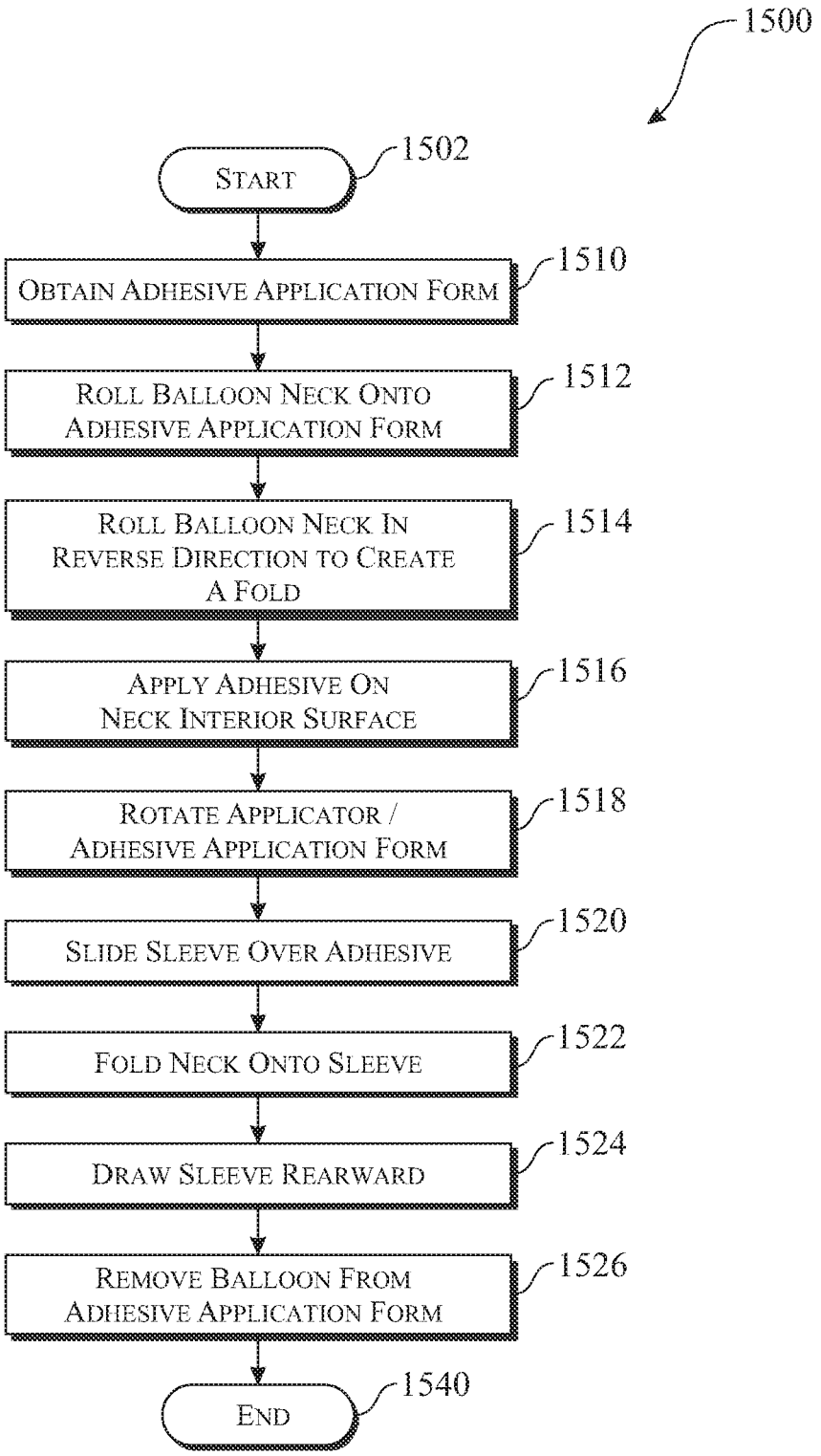
FIG. 37 presents a flow diagram of an exemplary method of applying the sealing adhesive to the prefabricated balloon.

An exemplary method for applying the adhesive 1390 onto the prefabricated self-sealing balloon 1400 is outlined in a fourth exemplary self-sealing balloon fabrication flow diagram 1500 presented in FIG. 37. The process initiates with a step of obtaining the sealing adhesive applicator assembly 1300 (step 1510).

The fourth exemplary self-sealing balloon fabrication flow diagram 1500 initiates at a start step (block 1402). A sealing adhesive applicator assembly 1300 is obtained in accordance with an obtain adhesive applicator form step 1502. The sealing adhesive applicator assembly 1300 can be assembled to or integrated with an automated device for automating the adhesive application process. During the same acquisition step, a plurality of prefabricated self-sealing balloons 1400 would be supplied for receiving of the adhesive 1390.

Figure 29:
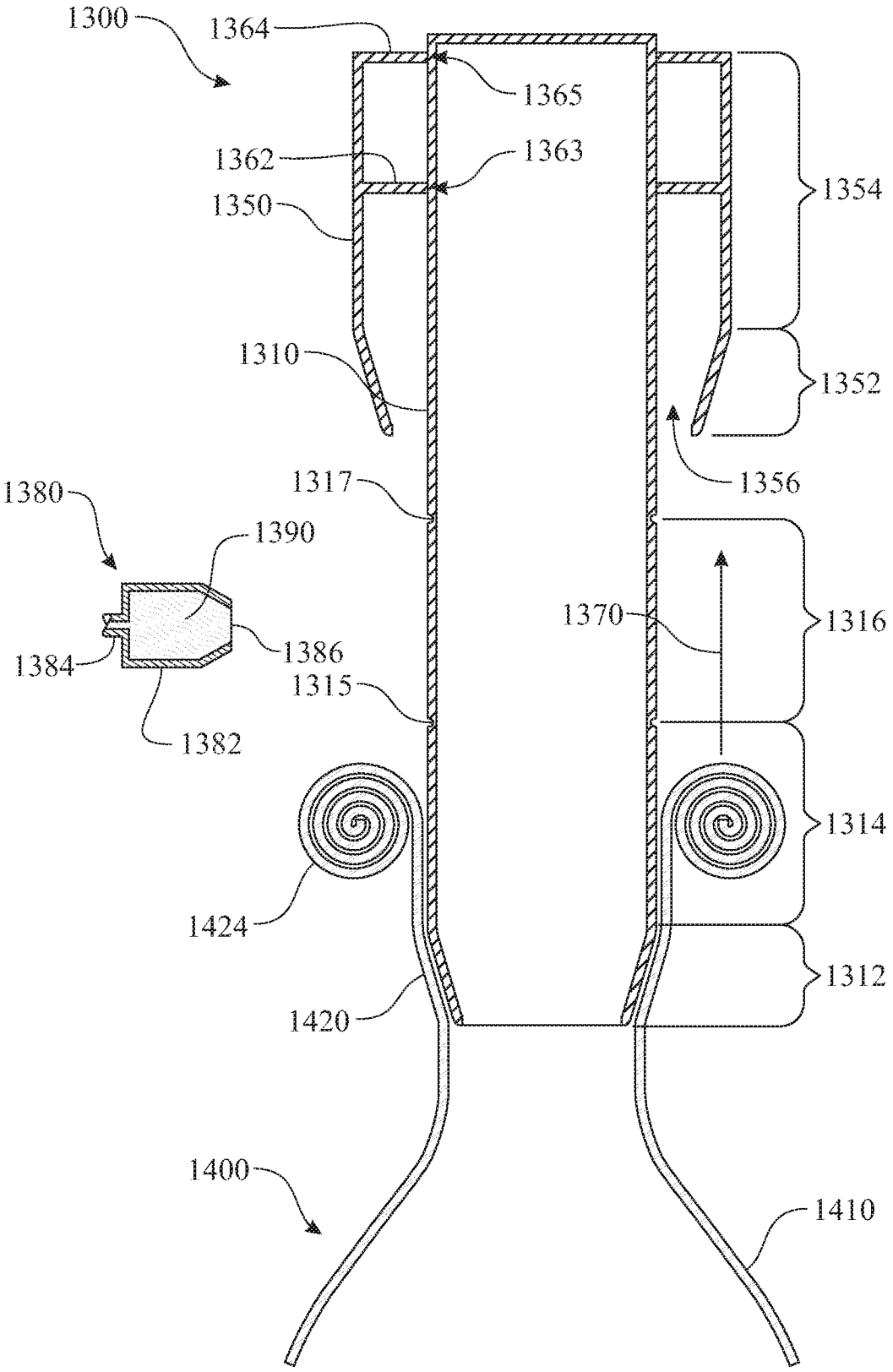
FIG. 29 presents a cross sectional elevation view of an exemplary balloon sealing adhesive applicator form assembly having a design to assist in an application of sealing adhesive onto a prefabricated balloon neck, the illustration presenting a step of placing the neck of the balloon onto the sealing adhesive applicator form.

The prefabricated self-sealing balloon 1400 would be mounted onto the sealing adhesive applicator balloon neck support element 1310. The balloon neck support element, frustum shaped lead-in segment 1312 is designed to aid in the process of mounting the tubular balloon neck segment 1420 of the prefabricated self-sealing balloon 1400 onto the sealing adhesive applicator balloon neck support element 1310. The free end of the balloon neck support element, frustum shaped lead-in segment 1312 is preferably of a size and shape that is proximate to the size and shape of the opening of the tubular balloon neck segment 1420 of the prefabricated self-sealing balloon 1400, thus easing or simplifying the mounting process by avoiding or minimizing any initial stretching of the tubular balloon neck segment 1420 process. The free, rolled end of the tubular balloon neck segment 1420 is placed upon the balloon neck support element, frustum shaped lead-in segment 1312, as shown in FIG. 29.

Figure 30:
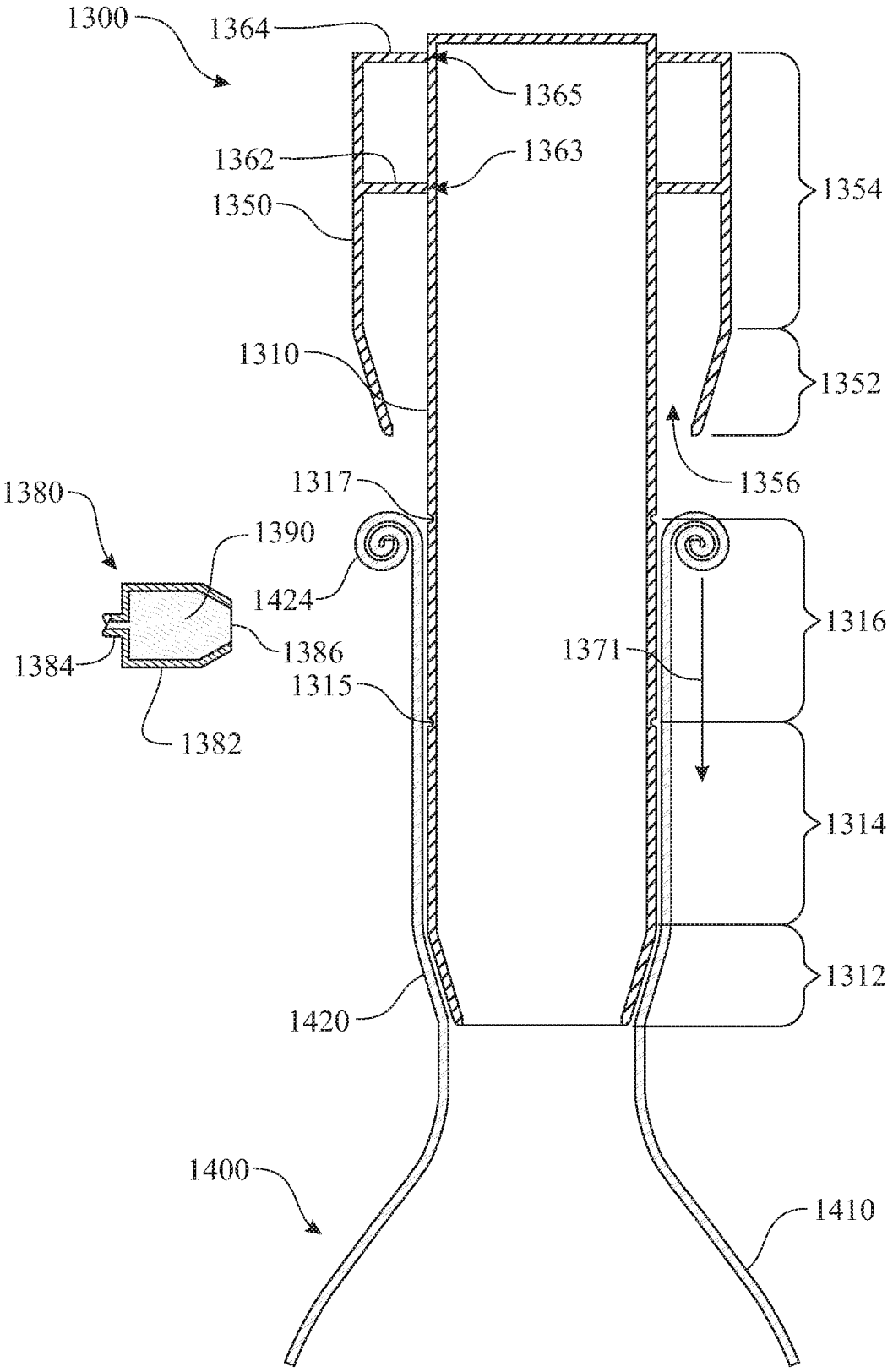
FIG. 30 presents a cross sectional elevation view of the exemplary balloon sealing adhesive applicator form assembly originally introduced in FIG. 29, the illustration presenting a step of partially unrolling the neck of the balloon inward, onto the sealing adhesive applicator form.
Figure 31:
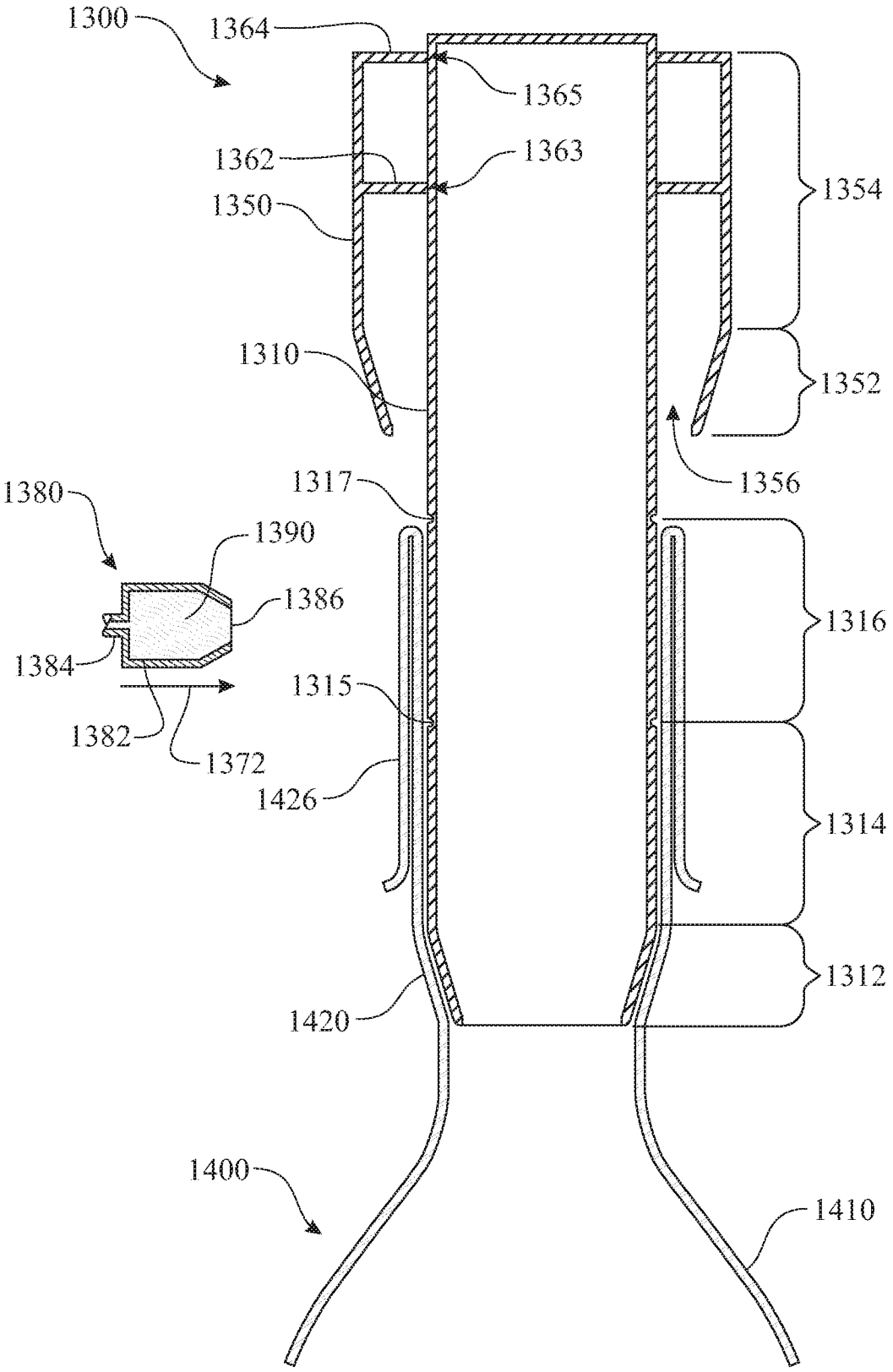
FIG. 31 presents a cross sectional elevation view of the exemplary balloon sealing adhesive applicator form assembly originally introduced in FIG. 29, the illustration presenting a step of continuing the unrolling the neck of the balloon in a reverse, outward direction, overlapping the balloon neck upon the partially unrolled portion.

A lip bead 1424 is formed at a free end of the tubular balloon neck segment 1420. The lip bead 1424 is partially unrolled rearward, from the free end of the sealing adhesive applicator balloon neck support element 1310, mounting the tubular balloon neck segment 1420 onto the balloon neck support element, frustum shaped lead-in segment 1312 and continuing along the balloon neck support element, distal parallel shaped segment 1314 of the sealing adhesive applicator balloon neck support element 1310, as referenced by an unrolling neck upward motion 1370 illustrated in FIG. 29 (step 1512). The process continues until the lip bead 1424 approaches the balloon neck support element, proximal segment indicator 1317, where the tubular balloon neck segment 1420 covers the balloon neck support element, central adhesive applicator segment 1316, as shown in FIG. 30. The unrolling direction is then reversed, as referenced by an unrolling neck downward motion 1371, where the lip bead 1424 is unrolled, overlapping the partially unrolled section and exposing the lip bead adhesive receiving surface 1426, as illustrated in FIG. 31 (step 1514). It is noted that the lip bead 1424 may be partially unrolled or completely unrolled (as shown), based upon the length of the tubular balloon neck segment 1420 and the lengths of the balloon neck support element, frustum shaped lead-in segment 1312, balloon neck support element, distal parallel shaped segment 1314, and balloon neck support element, central adhesive applicator segment 1316.

Figure 32:
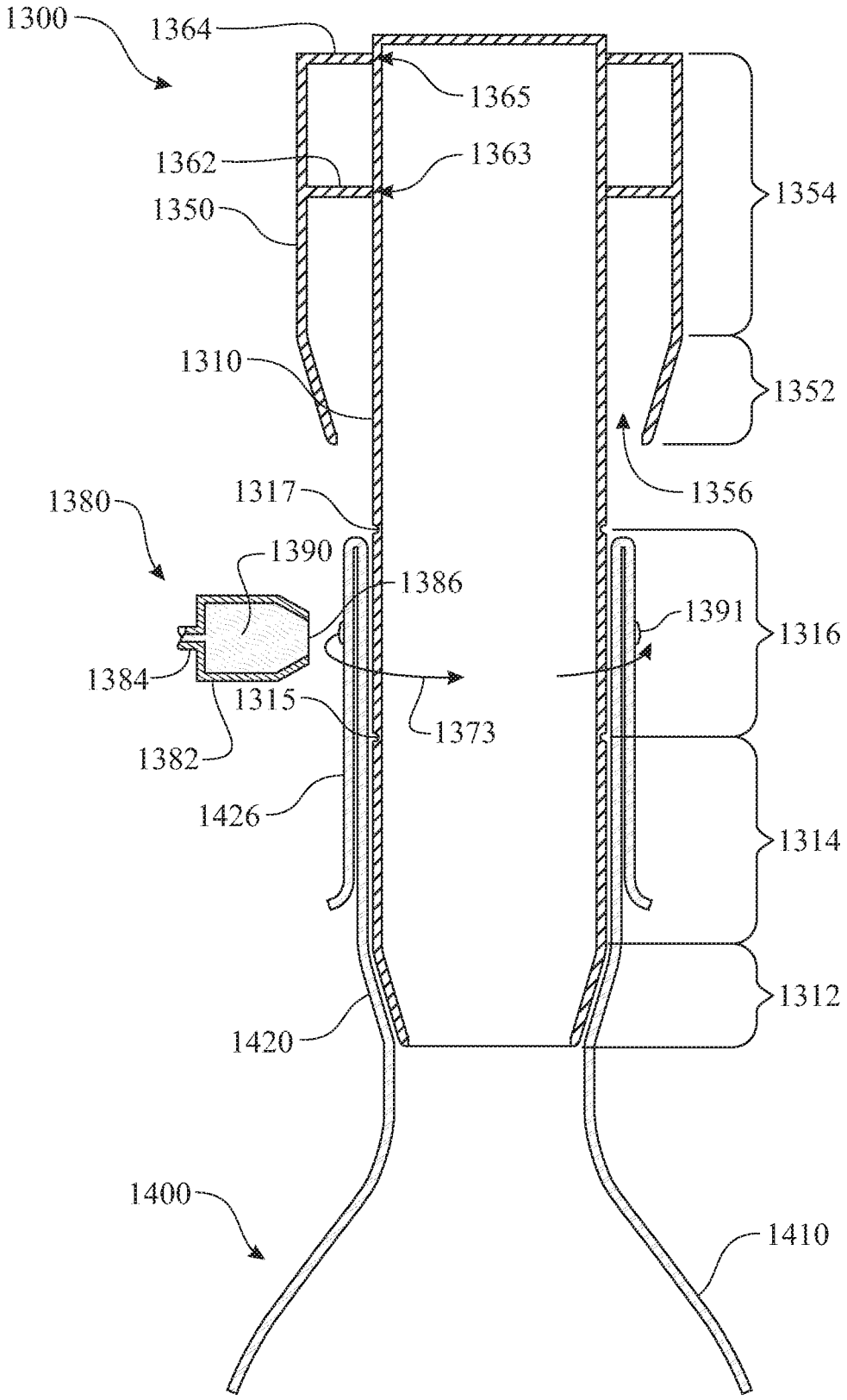
FIG. 32 presents a cross sectional elevation view of the exemplary balloon sealing adhesive applicator form assembly originally introduced in FIG. 29, the illustration presenting a step of applying the sealing adhesive to the interior surface of the balloon neck.

The adhesive dispenser assembly 1380 is moved into a staging or application position as shown in FIG. 32, the movement being referenced as an applicator staging motion 1372 in FIG. 31. The adhesive dispenser assembly 1380 would be positioned proximate to or in contact with the lip bead adhesive receiving surface 1426; close enough to apply the adhesive 1390 onto the lip bead adhesive receiving surface 1426 without the adhesive dispenser 1382 interfering with the application process. The adhesive 1390 is dispensed from the adhesive dispenser 1382, through the adhesive supply conduit 1384 and applied onto the lip bead adhesive receiving surface 1426 of the tubular balloon neck segment 1420. The adhesive dispenser 1382 can be rotated about the sealing adhesive applicator balloon neck support element 1310, the sealing adhesive applicator balloon neck support element 1310 can rotate about a central axis, with the adhesive dispenser 1382 remaining stationary, or both the adhesive dispenser 1382 and the sealing adhesive applicator balloon neck support element 1310 can rotate respective to one another. The rotation is referenced by a balloon neck support rotational motion 1373 in FIG. 32. The sealing adhesive application process (step 1516) dispenses a volume of adhesive 1390 from the adhesive dispenser 1382 onto the lip bead adhesive receiving surface 1426, forming a dispensed adhesive 1391. The dispensed adhesive 1391 is formed during the rotation of the sealing adhesive applicator balloon neck support element 1310 and the adhesive dispenser 1382 respective to one another (step 1518). The sealing adhesive applicator assembly 1300 can include inspection equipment to ensure that the dispensed adhesive 1391 is of a proper size and shape, and completely circumscribes the lip bead adhesive receiving surface 1426. The inspection equipment can include a feedback function, enabling direction to the sealing adhesive applicator assembly 1300 to repair any defects in the dispensed adhesive 1391, alert an operator of a defect, or both.

Figure 33:
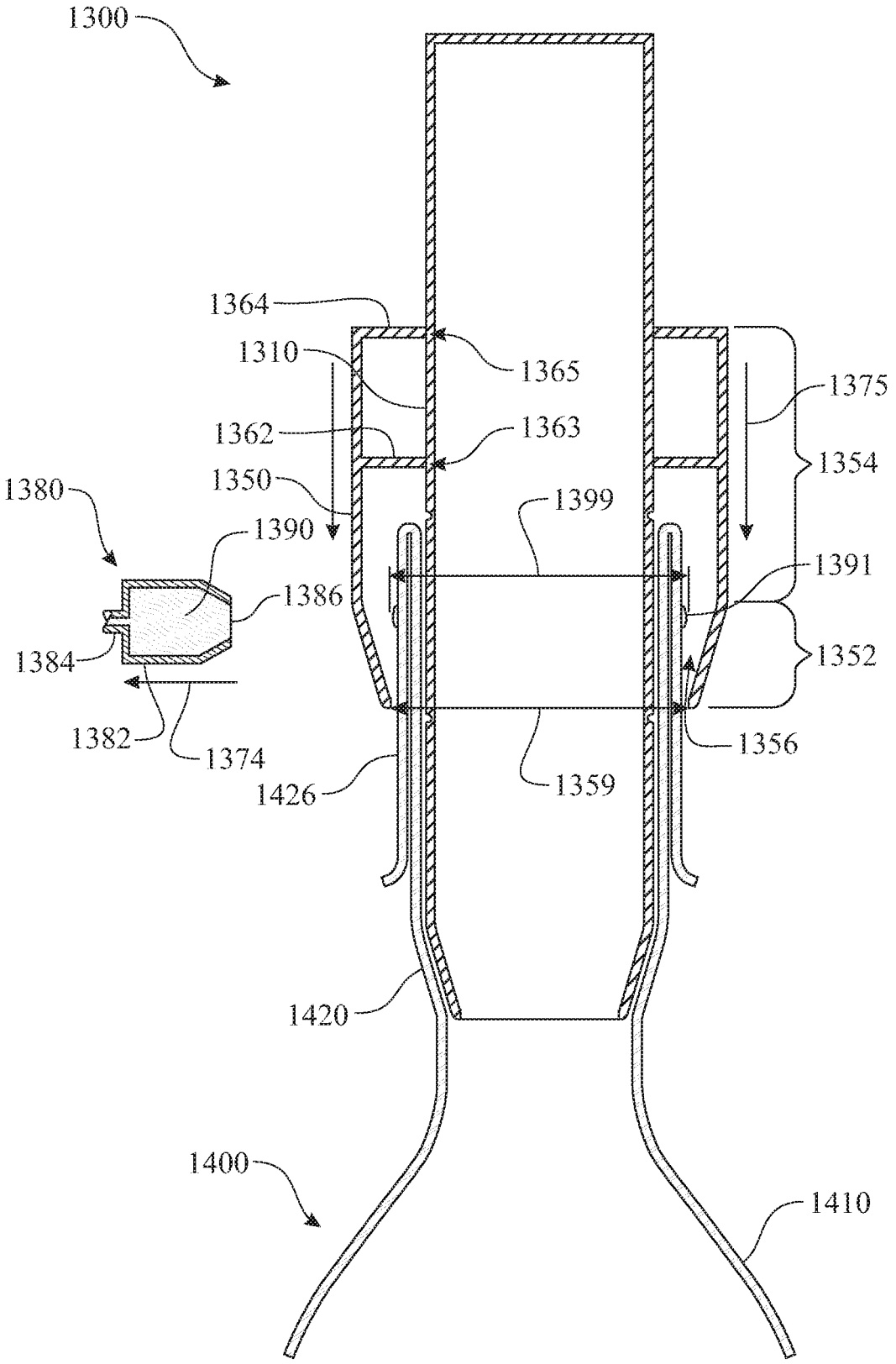
FIG. 33 presents a cross sectional elevation view of the exemplary balloon sealing adhesive applicator form assembly originally introduced in FIG. 29, the illustration presenting a step of staging a sleeve element of the exemplary balloon sealing adhesive applicator form assembly.

Once the dispensed adhesive 1391 is applied and inspected, the adhesive dispenser 1382 is retracted into a stored position, as referenced by an applicator retraction motion 1374, and illustrated in FIG. 33. The adhesive dispenser 1382 is positioned enabling the adhesive applicator balloon neck sleeve element 1350 to slide forward into a position covering the previously applied dispensed adhesive 1391, as referenced by a sleeve staging motion 1375, as illustrated in FIG. 33.

In an alternate configuration, the adhesive dispenser assembly 1380 can be integrated into the adhesive applicator balloon neck sleeve element 1350. When using this configuration, the adhesive applicator balloon neck sleeve element 1350 would be slideably positioned into a location to dispense the adhesive 1390, forming the dispensed adhesive 1391 on the lip bead adhesive receiving surface 1426 of the tubular balloon neck segment 1420. The process would then continue by dispensing the adhesive 1390, forming the dispensed adhesive 1391 on the lip bead adhesive receiving surface 1426 of the tubular balloon neck segment 1420. The balloon neck sleeve element, interior cavity opening span 1359 would be designed to accommodate the largest dispensed adhesive span 1399 of an acceptable dispensed volume of adhesive 1390.

The adhesive applicator balloon neck sleeve element 1350 is slid forward, towards the free end of the sealing adhesive applicator balloon neck support element 1310 (step 1520). The opening at the free end of the balloon neck sleeve element, frustum shaped lead-in segment 1352 is designed having a balloon neck sleeve element, interior cavity opening span 1359. The balloon neck sleeve element, frustum shaped lead-in segment 1352 would be located at a working end of a balloon neck sleeve element, distal parallel shaped segment 1354. The applied dispensed adhesive 1391 has a dispensed adhesive span 1399. The balloon neck sleeve element, interior cavity opening span 1359 is greater than the dispensed adhesive span 1399, enabling the adhesive applicator balloon neck sleeve element 1350 to pass over the dispensed adhesive 1391 without contacting with the dispensed adhesive 1391.

Figure 34:
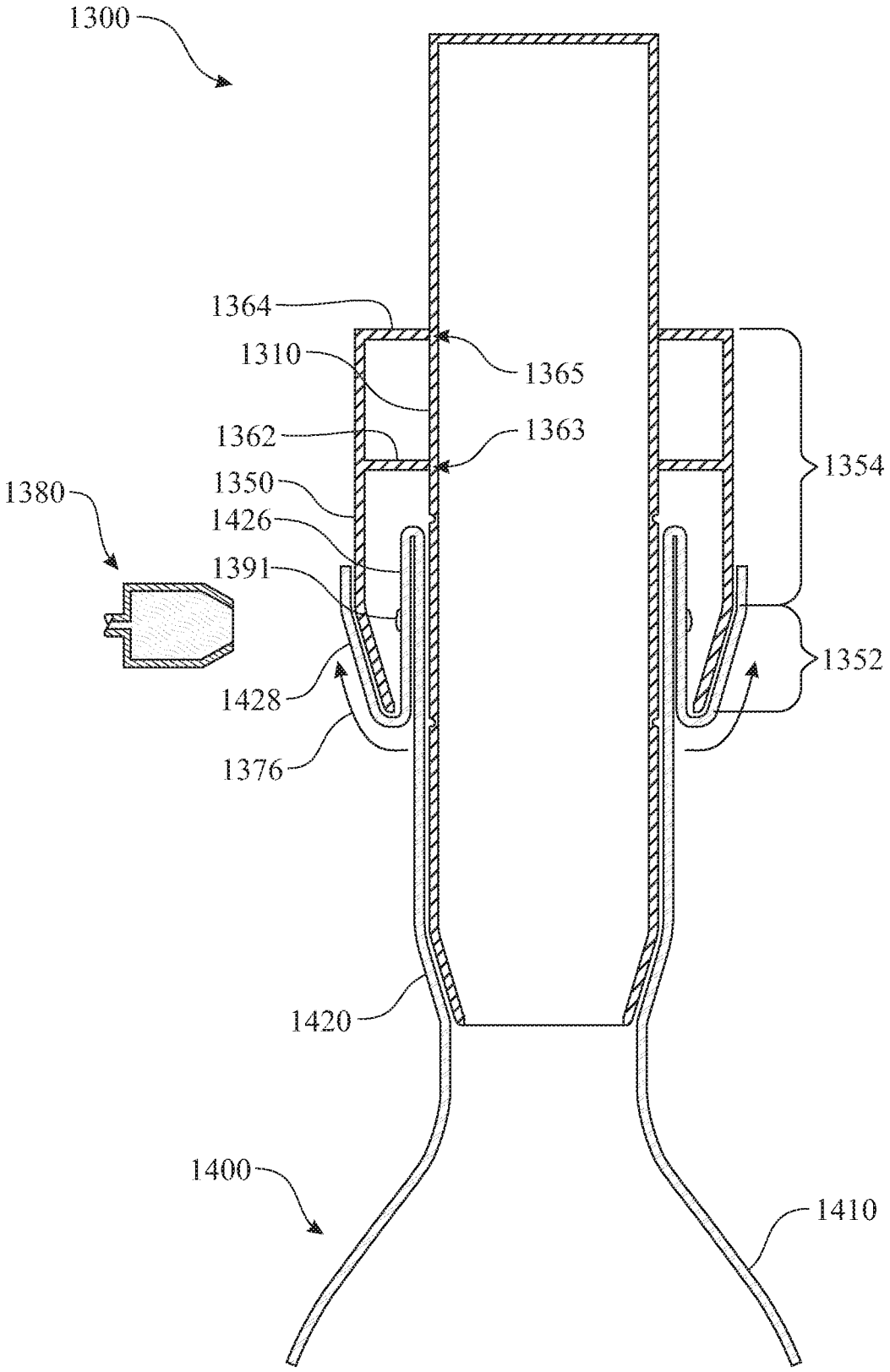
FIG. 34 presents a cross sectional elevation view of the exemplary balloon sealing adhesive applicator form assembly originally introduced in FIG. 29, the illustration presenting a step of folding a distal end of the balloon neck onto the sleeve element.

The dispensed adhesive 1391 is preferably applied proximate the return curve formed in the tubular balloon neck segment 1420, the return curve being located proximate the balloon neck support element, proximal segment indicator 1317. The free end of the balloon neck sleeve element, frustum shaped lead-in segment 1352 would be positioned proximate the balloon neck support element, distal segment indicator 1315, as illustrated in FIG. 33. This positioning provides sufficient geometry for creating a lip bead adhesive covering neck segment 1428 of the tubular balloon neck segment 1420, wherein the lip bead adhesive covering neck segment 1428 is utilized to encapsulate the dispensed adhesive 1391. The lip bead adhesive covering neck segment 1428 is a segment of the tubular balloon neck segment 1420, which is folded rearward and placed upon the balloon neck sleeve element, frustum shaped lead-in segment 1352, as referenced by a balloon neck end sleeve seating motion 1376 (step 1522), as shown in FIG. 34.

Figure 35:
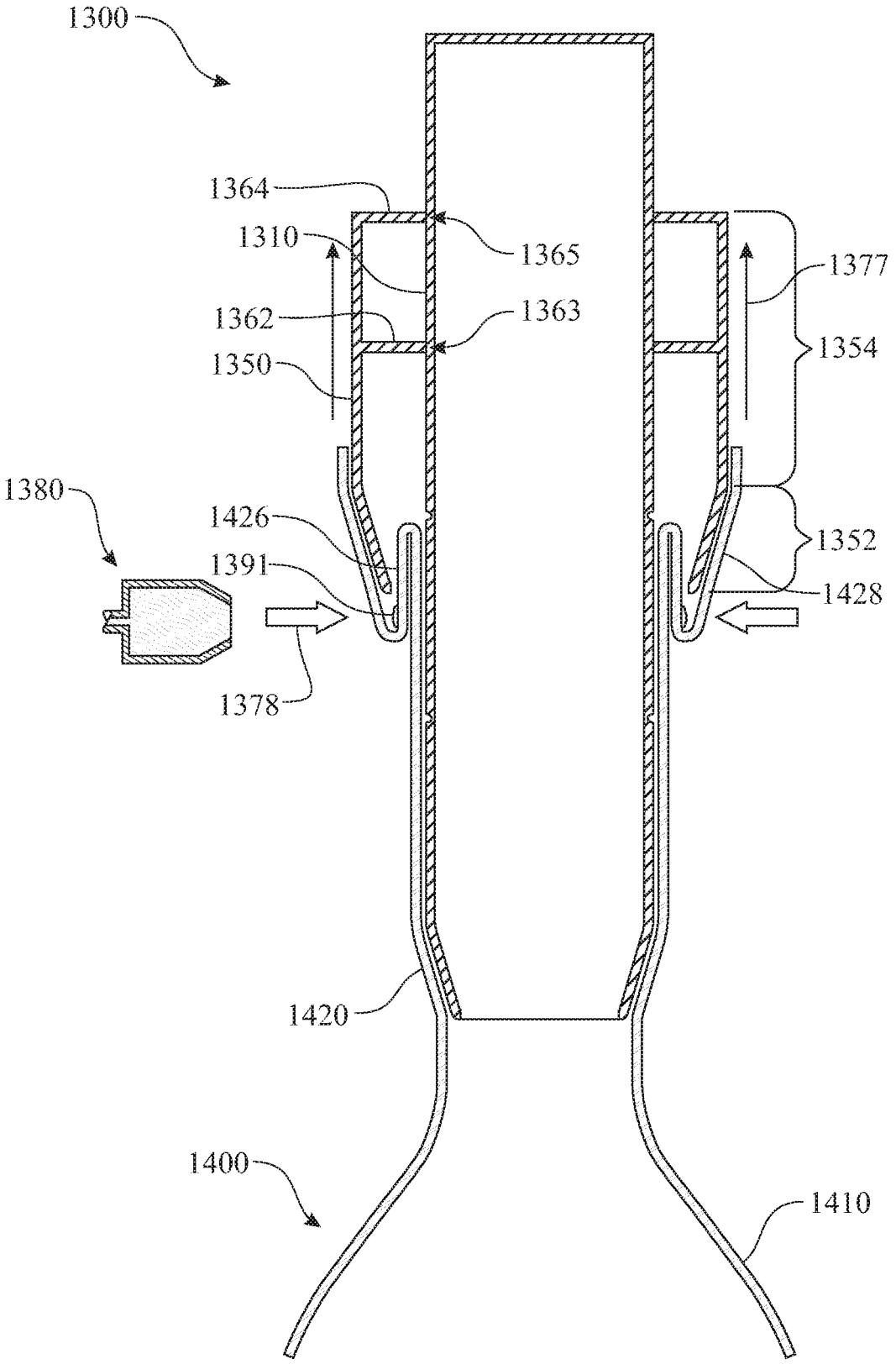
FIG. 35 presents a cross sectional elevation view of the exemplary balloon sealing adhesive applicator form assembly originally introduced in FIG. 29, the illustration presenting a step of drawing the sleeve element rearward to locate the distal end of the balloon neck over the applied sealing adhesive.
Figure 36:
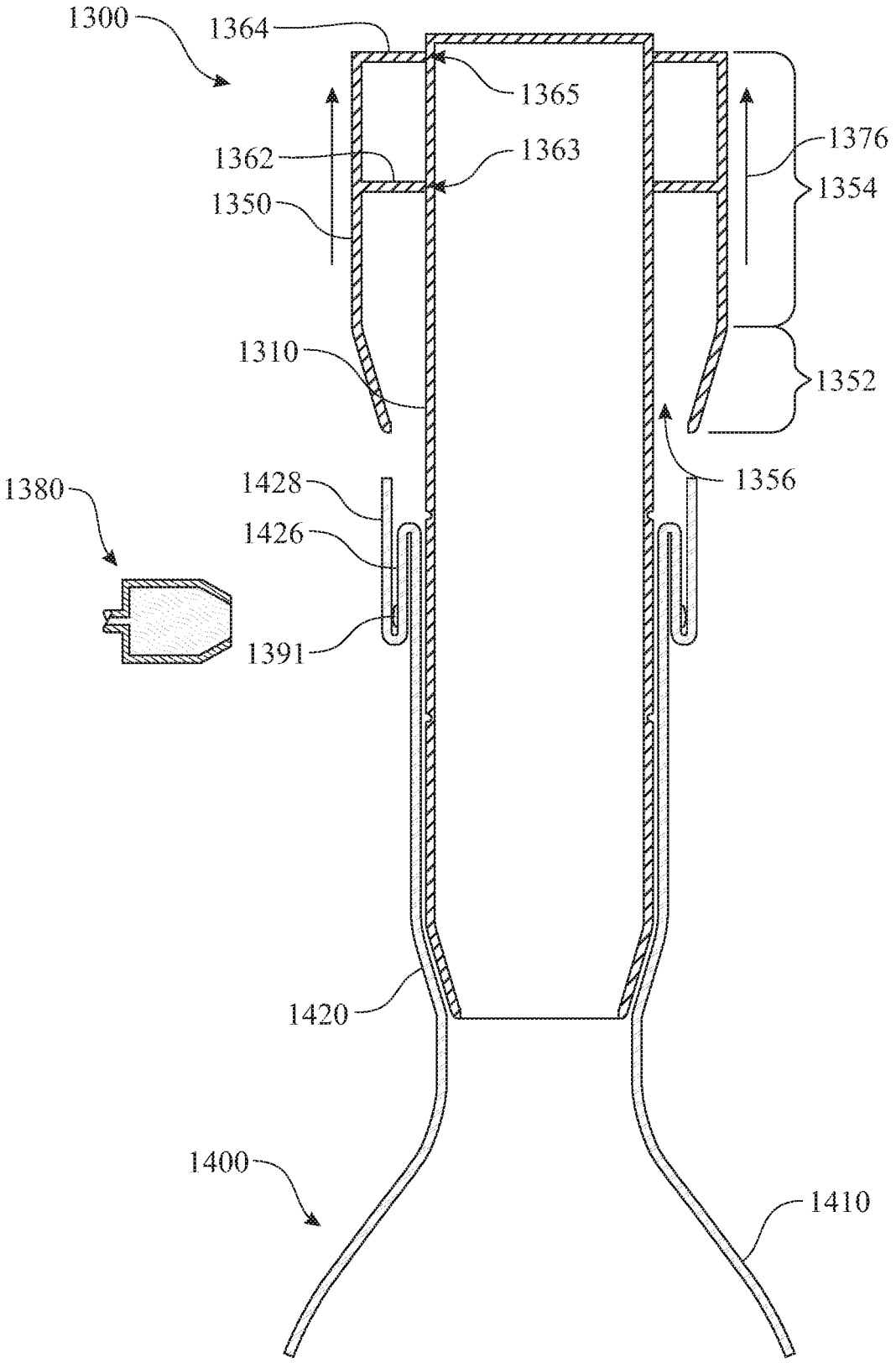
FIG. 36 presents a cross sectional elevation view of the exemplary balloon sealing adhesive applicator form assembly originally introduced in FIG. 29, the illustration presenting a step of separating the distal end of the balloon neck from the sleeve element encapsulating the sealing adhesive within an interior of the balloon neck.

The adhesive applicator balloon neck sleeve element 1350 is drawn rearward, away from the free end of the sealing adhesive applicator balloon neck support element 1310, as referenced by an initial sleeve retraction motion 1377 (step 1524), which draws the lip bead adhesive covering neck segment 1428 rearward. When the curve defining the lip bead adhesive covering neck segment 1428 approached the dispensed adhesive 1391, an encasing formation balloon neck retention force 1378 is applied to the region proximate the dispensed adhesive 1391, as illustrated in FIG. 35. The applied encasing formation balloon neck retention force 1378 restrains the lip bead adhesive covering neck segment 1428 from moving with the adhesive applicator balloon neck sleeve element 1350, thus pulling and sliding the lip bead adhesive covering neck segment 1428 off the exterior surface of the adhesive applicator balloon neck sleeve element 1350 as the adhesive applicator balloon neck sleeve element 1350 continues to move away from the free end of the sealing adhesive applicator balloon neck support element 1310, as referenced by a continued sleeve retraction motion 1379. The resulting process separates the lip bead adhesive covering neck segment 1428 from the sealing adhesive applicator balloon neck support element 1310, which allows the lip bead adhesive covering neck segment 1428 to contract against the inner folds, encasing the dispensed adhesive 1391 within the respective folded region, as shown in FIG. 36. Upon completion of the preparation of the sealing adhesive segment of the prefabricated self-sealing balloon 1400, the prefabricated self-sealing balloon 1400 is removed from the sealing adhesive applicator balloon neck support element 1310 (Step 1526). The removal can be accomplished using any suitable method. In one example, air can be introduced into an interior of the sealing adhesive applicator balloon neck support element 1310. The introduced air forces the prefabricated self-sealing balloon 1400 from the sealing adhesive applicator balloon neck support element 1310. In another example, the tubular balloon neck segment 1420 is slideably removed from the sealing adhesive applicator balloon neck support element 1310. The self sealing balloon 1400 may be tested to ensure against defects prior to packaging and shipping to a distributor, retailer, and the like, thus terminating the process (block 1440).

A number of variants of apparatuses and method of applying a sealing adhesive to an interior surface of a self-sealing balloon were described above. Several optional features can be included in the adhesive dispenser assemblies. The optional features are introduced in the exemplary illustration presented in FIG. 38.

The adhesive dispenser assembly 1680 would operate in the same manner as the adhesive dispenser assembly 1380. Like elements of the adhesive dispenser assembly 1680 and the adhesive dispenser assembly 1380 are numbered the same, except being preceded by the numeral "16". In the exemplary illustrated implementation, a balloon sealing adhesive applicator assembly 1600 is representative of any suitable sealing adhesive applicator assembly described herein.

In the balloon sealing adhesive applicator assembly 1600, the adhesive supply conduit 1684 is additionally employed to support the adhesive dispenser 1682. The exemplary adhesive dispenser 1382 includes an adhesive dispensing orifice 1386 having a single passageway. The adhesive dispenser 1682 includes a plurality of dispensing passageways 1686. The sealing adhesive 1690 would be applied to a balloon form neck adhesive receiving element 1650 assembled to a balloon form neck segment 1640, forming a dispensed sealing adhesive 1691. One or both of the balloon form neck segment 1640 and/or the adhesive dispenser assembly 1680 would rotate 1688 about a balloon form neck segment rotational axis 1649 during the application process, forming a circumferentially covering dispensed sealing adhesive 1691. The plurality of dispensing passageways 1686 can provide a more consistent application of the sealing adhesive 1690, forming a broader and consistent dispensed sealing adhesive 1691. The dispensed sealing adhesive 1691 would have a substantially consistent depth (or radial thickness) across a wider axial distance. The balloon form neck adhesive receiving element 1650 would have a surface fabricated of a material that aids in a transfer of the dispensed sealing adhesive 1691 from the balloon form neck adhesive receiving element 1650 to the surface of the neck of the balloon. The exemplary balloon form neck adhesive receiving element 1650 is shown to be proud of the surface of the balloon form neck segment 1640. It is understood that the balloon form neck adhesive receiving element 1650 can be proud of the surface of the balloon form neck segment 1640, co-planar with the surface of the balloon form neck segment 1640, recessed within the surface of the balloon form neck segment 1640, or any combination thereof. The exposed annular surface of the balloon form neck adhesive receiving element 1650 can be planar, as shown, convex, concave, or any combination thereof. Although the dispensing formation of the adhesive dispenser 1682 includes one or more passageways 1686, the dispensing formation of the 1682 can employ any of a variety of dispensing configurations, including a brush, a roller, one or more dispensing needles, or any other suitable dispensing configuration. The dispensing configuration can apply a dispensed sealing adhesive 1691 having a smooth exterior surface, a textured exterior surface, a planar exterior surface, a concave exterior surface, a convex exterior surface, a non-porous or gas free interior volume, a porous interior volume, and the like, or any combination thereof. The adhesive dispenser assembly 1680 can have multiple dispensing subassemblies integrated therewith, enabling dispensing of different materials or compositions to form the dispensed sealing adhesive 1691. This can include a configuration for dispensing a two or multiple part mixture simultaneously or sequentially to form the dispensed sealing adhesive 1691. Similarly, the configuration can be used to inject a gas into the dispensed sealing adhesive 1691.

Figure 38:
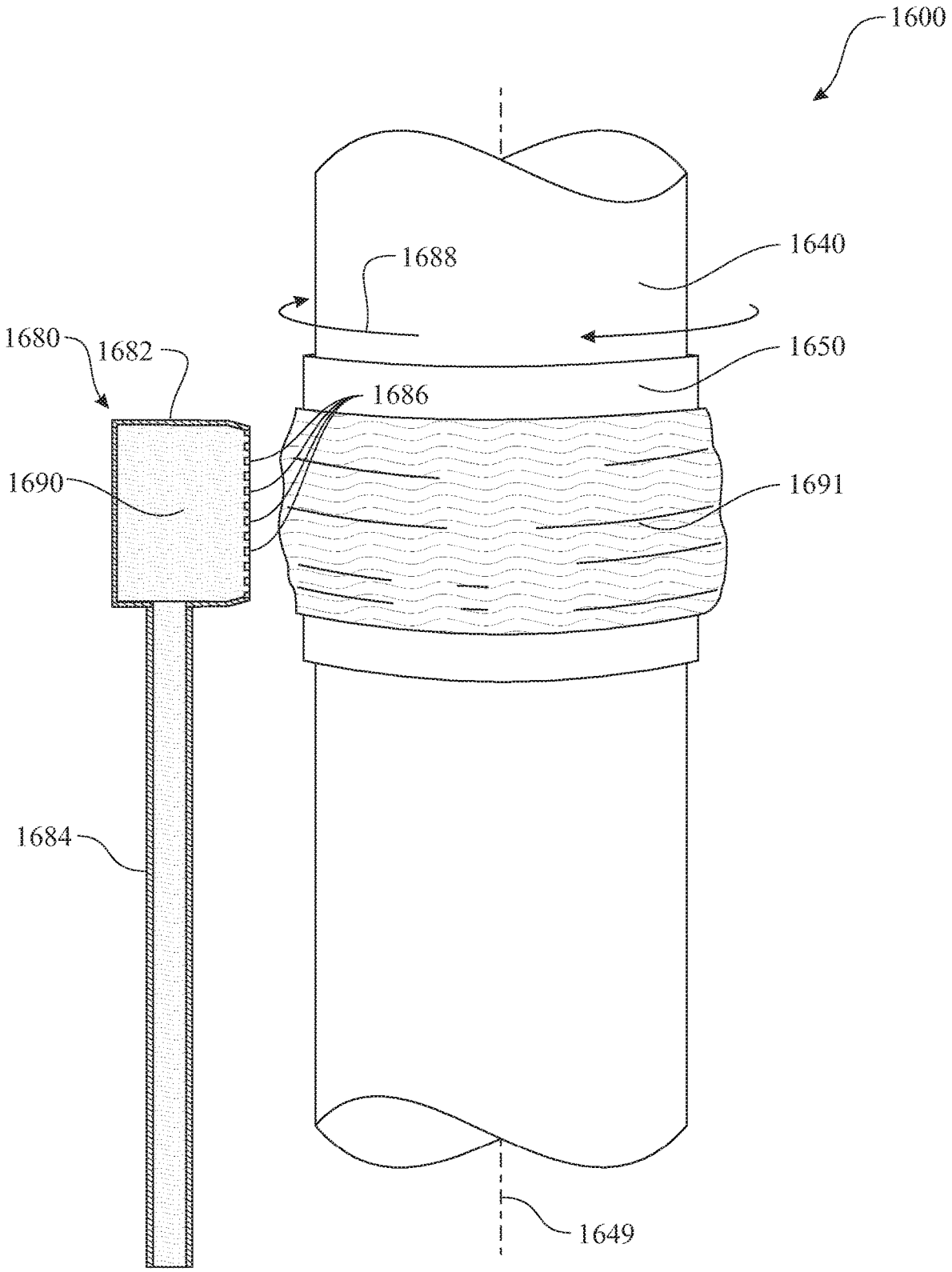
FIG. 38 presents a partial section view of an exemplary variant of the sealing adhesive application system introducing optional features for the sealing adhesive application systems disclosed herein.

The gas injected sealing adhesive can be referred to as undergoing fiberization. The term "fiberization" is used to describe several similar processes. In general, molten plastic or other fiberizable materials are extruded to form a fibrous mass, which is then post-processed through varying methods. The utilization of a series of jets dispensing the adhesive creates the fiberization. In FIG. 38, the nozzle is shown vertically. It is understood that the nozzle can include a single horizontal row or multiple horizontal rows having multiple adhesive dispensing passageways 1686. The single horizontal row or multiple horizontal rows would be in alignment with the groove identified by reference character 150.

Figure 39:
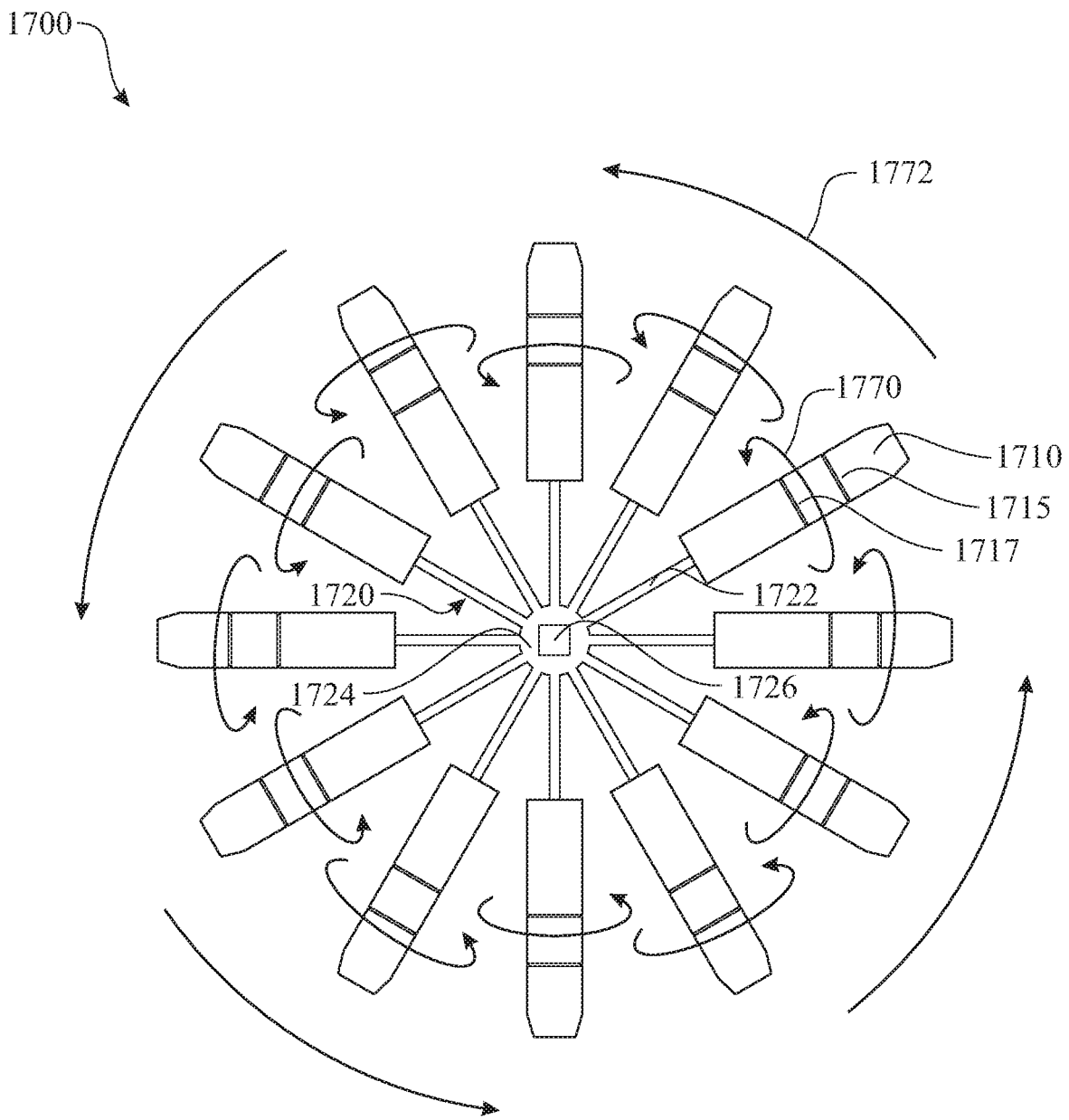
FIG. 39 presents a plan view of an exemplary configuration of a plurality of balloon sealing adhesive applicator assemblies assembled to an adhesive applicator balloon neck support element operating frame.

The sealing adhesive applicator assembly 1300 is illustrated as an independent assembly. A plurality of sealing adhesive applicator assemblies 1300 can be integrated into a single assembly, such as a balloon sealing adhesive applicator assembly 1700, illustrated in FIG. 39. It is noted that the balloon sealing adhesive applicator assembly 1700 can be used in any orientation, including horizontally, vertically, or at any angle therebetween. The balloon sealing adhesive applicator assembly 1700 includes a plurality of adhesive applicator balloon neck support elements 1710, wherein the adhesive applicator balloon neck support element 1710 would replicate the sealing adhesive applicator balloon neck support element 1310 and the respective elements thereof. Like elements of the balloon sealing adhesive applicator assembly 1700 and the sealing adhesive applicator assembly 1300 are numbered the same, except being preceded by the numeral "17". The adhesive applicator balloon neck support elements 1710 can include or exclude the balloon neck support element, distal segment indicator 1715 and/or the balloon neck support element, proximal segment indicator 1717. An adhesive applicator balloon neck support element operating frame 1720 includes a plurality of preferably equally distributed adhesive applicator balloon neck support element operating frame arms 1722 extending radially outward from an adhesive applicator balloon neck support element operating frame hub 1724. The adhesive applicator balloon neck support element operating frame hub 1724 is attached to a rotational axis at an adhesive applicator balloon neck support element operating frame hub aperture 1726. Each adhesive applicator balloon neck support element 1710 would be rotationally assembled to an adhesive applicator balloon neck support element operating frame arm 1722 of an adhesive applicator balloon neck support element operating frame 1720. The rotation of the adhesive applicator balloon neck support element operating frame 1720 can be provided by an automated rotational element, such as a motorized assembly. In this configuration, the adhesive applicator balloon neck support element operating frame hub aperture 1726 would be non-circular. Alternatively, the adhesive applicator balloon neck support element operating frame 1720 can rotate freely on an axle or spindle. In this configuration, the adhesive applicator balloon neck support element operating frame hub aperture 1726 would be circular and preferably include a bushing, a bearing, or any other rotational assisting component. In operation, the adhesive applicator balloon neck support element operating frame 1720 would rotate in accordance with a balloon neck support element operating frame rotational motion 1772 to present an adhesive applicator balloon neck support element 1710 to a respective workstation. The adhesive applicator balloon neck support element 1710 would rotate in accordance with a balloon neck support element rotational motion 1770. The balance of the process would replicate the process presented in FIGS. 29 through 36. The balloon sealing adhesive applicator assembly 1700 can be arranged to rotate about a vertically oriented axis, a horizontally oriented axis, or any other orientation. It is understood that any of the previously presented tooling can be adapted to the adhesive applicator balloon neck support element operating frame 1720.

Figure 40:
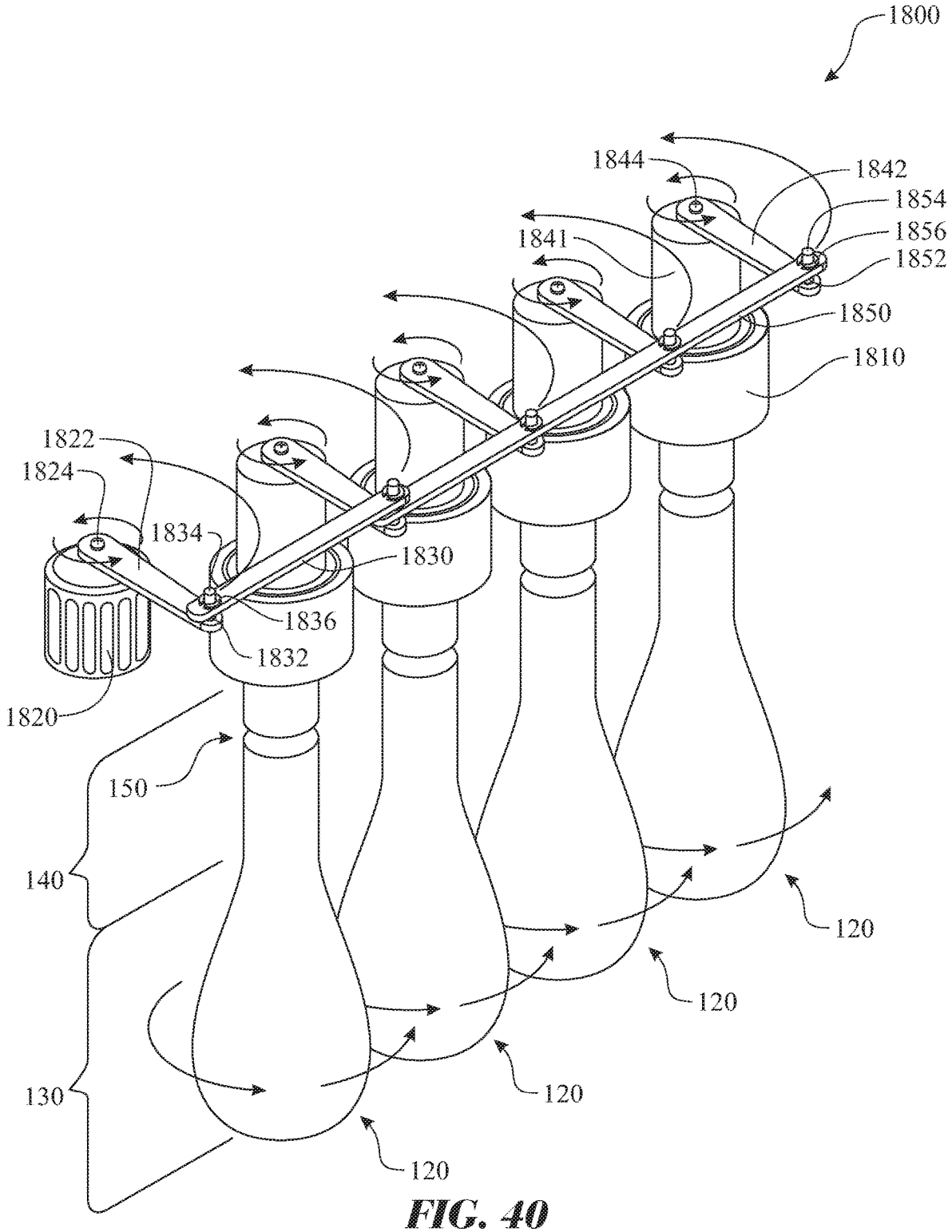
FIG. 40 presents an isometric view of a first exemplary balloon form rotating assembly, wherein the first exemplary balloon form rotating assembly employs a cam arrangement.
Figure 41:
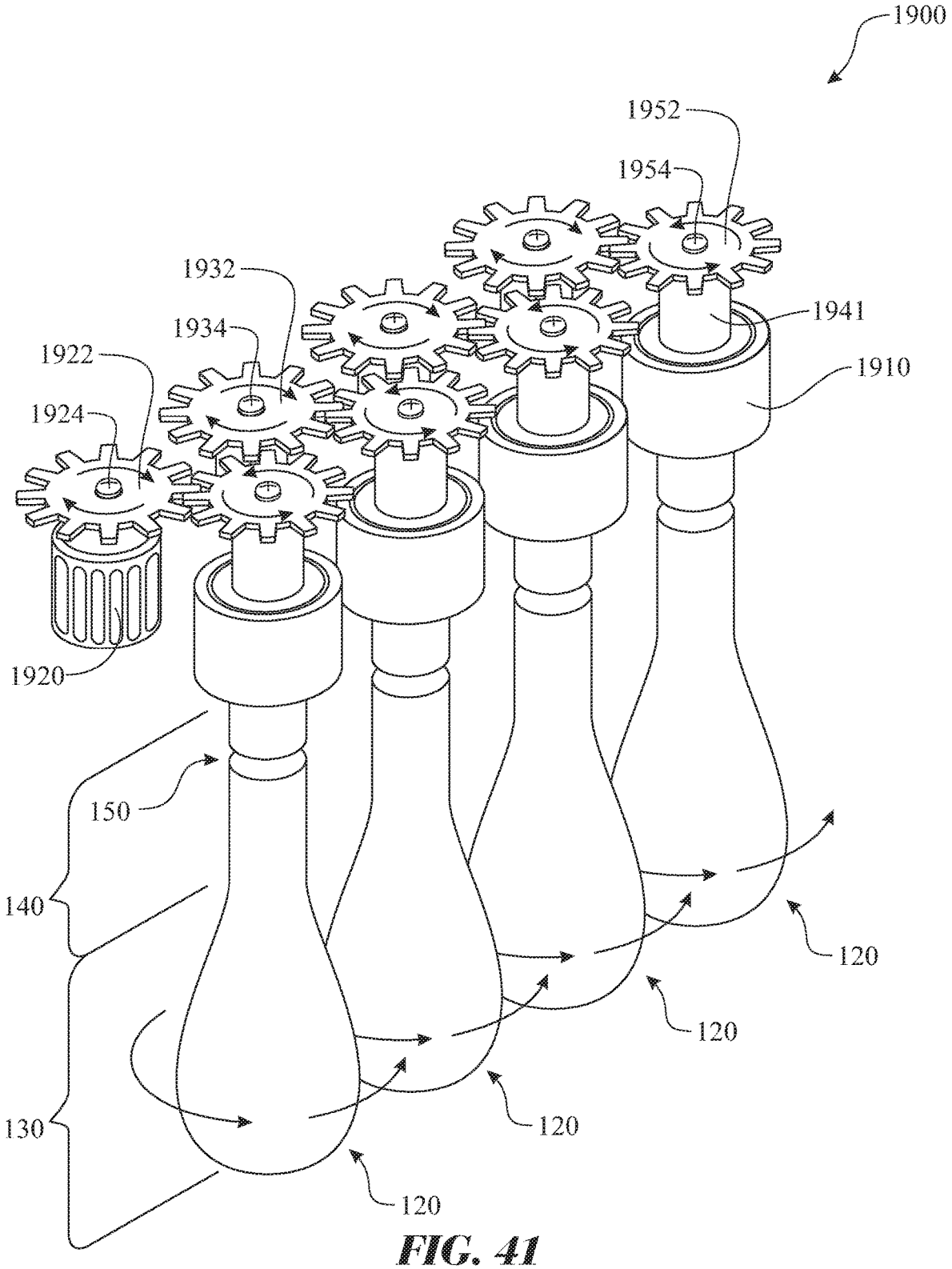
FIG. 41 presents an isometric view of a second exemplary balloon form rotating assembly, wherein the second exemplary balloon form rotating assembly employs a gear arrangement.

The quick seal balloon fabrication form 100, illustrated in FIG. 1, presents a plurality of balloon form members 120. The balloon form members 120 can be fixed or rotating. Two exemplary methods of enabling rotation of each of the balloon form members 120 are shown in FIGS. 40 and 41, respectively. A first exemplary method employs a balloon form cam rotating assembly 1800, introduced in FIG. 40. The balloon form cam rotating assembly 1800 includes a series of arms or other cam moving elements that rotate each of the balloon form members 120. Each balloon form member 120 is assembled to a support member by a balloon form rotating bushing/bearing 1810. The balloon form rotating bushing/bearing 1810 can be a bushing, a roller bearing, a roller bearing using spherical rolling elements, a roller bearing using cylindrical rolling elements, a roller bearing using trapezoidal rolling elements, or any other suitable long life rotational movement interface enabling longevity of the rotation of the balloon form members 120. A balloon form rotating drive extension 1841 extends axially from the respective balloon form member 120. A balloon form rotational drive arm 1842 extends radially from the balloon form rotating drive extension 1841. The balloon form rotational drive arm 1842 is preferably assembled to a top surface of the balloon form rotating drive extension 1841 by a balloon form rotational drive arm securing member 1844. The balloon form rotational drive arm securing member 1844 can be a threaded mechanical fastener, such as a screw, a nut, a bolt, etc.; the balloon form rotational drive arm securing member 1844 can be a fixed mechanical fastener, such as a rivet, a washer, a formation in a component, etc.; and the like. The balloon form rotational drive arm 1842 would be affixed to the balloon form rotating drive extension 1841, wherein when the balloon form rotational drive arm 1842 is moved, the movement of the balloon form rotational drive arm 1842 drives a like movement of the balloon form rotating drive extension 1841. The movement of the balloon form rotating drive extension 1841 drives a like movement of the balloon form member 120.

A balloon form cam rotating drive component 1820 provides rotation of a shaft. A balloon form cam assembly rotating drive arm 1822 is secured to the shaft by a rotating drive arm mechanical securing member 1824. The rotating drive arm mechanical securing member 1824 can be a threaded mechanical fastener, such as a screw, a nut, a bolt, etc.; the rotating drive arm mechanical securing member 1824 can be a fixed mechanical fastener, such as a rivet, a washer, an o-ring, a formation in a component, etc.; and the like. The balloon form cam assembly rotating drive arm 1822 would be affixed to the balloon form cam rotating drive component 1820, wherein when the shaft of the balloon form cam rotating drive component 1820 rotates, the rotation of the shaft of the balloon form cam rotating drive component 1820 rotates the balloon form cam assembly rotating drive arm 1822.

A distal end of the balloon form cam assembly rotating drive arm 1822 is rotationally assembled to a proximal end of a balloon form rotating assembly drive cam arm 1830 by an axle or pin coupling 1834. The balloon form rotating assembly drive cam axle/pin 1834 can be secured by a balloon form rotating assembly drive cam c-clip 1836. A balloon form rotating assembly drive cam spacer 1832 can be inserted between facing surfaces of the balloon form cam assembly rotating drive arm 1822 and the balloon form rotating assembly drive cam arm 1830, wherein the balloon form rotating assembly drive cam spacer 1832 provides clearances to eliminate rubbing between facing surfaces of the balloon form cam assembly rotating drive arm 1822 and the balloon form rotating assembly drive cam arm 1830, clearances between the balloon form rotating assembly drive cam arm 1830 and components of the balloon form member 120, such as the balloon form rotational drive arm securing member 1844, and any other benefits thereof.

A distal end of the balloon form rotating assembly drive cam arm 1830 is rotationally assembled to a proximal end of a balloon form rotating assembly drive synchronizing arm 1850 by an axle or pin coupling 1854. Each balloon form rotational drive arm 1842 is rotationally assembled to the balloon form rotating assembly drive synchronizing arm 1850 by a similar axle or pin coupling 1854. The balloon form rotating assembly drive synchronizing arm 1850 can be retained upon each balloon form rotating assembly drive synchronizing arm axle/pin 1854 by securing a balloon form rotating assembly drive synchronizing arm c-clip 1856 to the balloon form rotating assembly drive synchronizing arm axle/pin 1854. A balloon form rotating assembly drive synchronizing arm spacer 1852 can be inserted between facing surfaces of each balloon form rotational drive arm 1842 and the balloon form rotating assembly drive synchronizing arm 1850, wherein the balloon form rotating assembly drive synchronizing arm spacer 1852 provides clearances to eliminate rubbing between facing surfaces of the balloon form rotational drive arm 1842 and the balloon form rotating assembly drive synchronizing arm 1850, clearances between the balloon form rotating assembly drive synchronizing arm 1850 and components of the balloon form member 120, such as the balloon form rotational drive arm securing member 1844, and any other benefits thereof.

During operation, a shaft of the balloon form cam rotating drive component 1820 rotates, driving the balloon form cam assembly rotating drive arm 1822 in a circular motion. The rotational motion of the balloon form cam assembly rotating drive arm 1822 translates a motion to the balloon form rotating assembly drive cam arm 1830. The balloon form rotating assembly drive cam arm 1830, in turn, translates a motion to the balloon form rotating assembly drive synchronizing arm 1850. The balloon form rotating assembly drive synchronizing arm 1850 synchronizes a rotational motion of each of the attached balloon form members 120. Movements are presented by arches lines having arrows indicating rotational motion. Each of the movements in the exemplary illustration is counterclockwise when viewed from a top.

It is understood that the balloon form rotating assembly drive cam arm 1830 can be integral with the balloon form rotating assembly drive synchronizing arm 1850 or separate (as illustrated).

The rotational motion can additionally be utilized during the rolling process. The rotational motion of the balloon form members 120 can rotate the neck release air delivery nozzle 282 about the balloon unfinished lip 222. The rotational motion of the balloon form members 120 can additionally aid the rolling process during the forming of the adhesive staging segment 172 and/or the lip bead 224.

The adhesive would be applied by a fixed adhesive applicator (not shown) or by a moving adhesive applicator (not shown). The adhesive would be applied by an adhesive applicator, such as the adhesive dispenser assembly 1380 and the adhesive dispenser assembly 1680. It is preferred to dispense the adhesive into a groove 150 formed circumferentially about the balloon neck mold segment 140 of the balloon form member 120. The adhesive would be applied simultaneously to each balloon form member 120 of the series of balloon form members 120, while each balloon form member 120 rotates about its respective central axis.

A second exemplary method employs a balloon form gear rotating assembly 1900, introduced in FIG. 41. The balloon form gear rotating assembly 1900 includes a series of gears that rotate each of the balloon form members 120. The balloon form cam rotating assembly 1800 and the balloon form gear rotating assembly 1900 have some similar components, where the similar components of the balloon form cam rotating assembly 1800 and the balloon form gear rotating assembly 1900 are numbered the same, except the components of the balloon form gear rotating assembly 1900 are preceded by a numeral 19.

A balloon form gear rotating drive gear 1922 is affixed to a shaft of a balloon form gear rotating drive component 1920 by a balloon form gear rotating drive gear securing member 1924, wherein when the balloon form gear rotating drive component 1920 drives a rotation of the shaft, the shaft drives a rotation of the balloon form gear rotating drive gear 1922. A balloon form rotational drive gear 1952 is affixed to a balloon form rotating drive extension 1941 of a respective balloon form member 120 by a balloon form rotational drive gear securing member 1954. Teeth of the balloon form gear rotating drive gear 1922 engage with teeth of a balloon form rotational drive gear 1952 located proximate to the balloon form gear rotating drive gear 1922. A balloon form gear rotating synchronizing gear 1932 is rotationally assembled to a support element by a balloon form gear rotating synchronizing gear securing member 1934 or other acceptable retention device. The support element can be of any form factor. The balloon form gear rotating synchronizing gear 1932 is preferably free to rotate, where the only element limiting motion is engagement of teeth of an adjacent balloon form rotational drive gear securing member 1954.

During operation, the balloon form gear rotating drive component 1920 rotates a respective shaft. The rotation of the shaft rotates the balloon form gear rotating drive gear 1922. The rotation of the balloon form gear rotating drive gear 1922 drives a rotation of the engaged balloon form rotational drive gear securing member 1954 in an opposite direction. The balloon form rotational drive gear securing member 1954, in turn, drives a rotation of the engaged balloon form gear rotating synchronizing gear 1932 in an opposite direction. This continues with each adjacent gear, causing all balloon form members 120 to rotate in synchronization.

It is understood other gears can be used. It is also understood that the balloon form gear rotating drive component 1920 can engage with a balloon form gear rotating synchronizing gear 1932, which, in turn, engages with a balloon form rotational drive gear 1952.

Outside of the mechanisms causing each balloon form member 120 to rotate, the balloon form cam rotating assembly 1800 and the balloon form gear rotating assembly 1900 operate in the same manner.

The balloon form cam rotating assembly 1800 and the balloon form gear rotating assembly 1900 are two exemplary methods for achieving the same results. It is understood that any suitable mechanical rotation driving configuration can be employed by the present invention. For example, the balloon form gear rotating synchronizing gears 1932 can be replaced by a chain or a belt. The chain can be routed to include or exclude the balloon form gear rotating drive gear 1922. In a configuration where the chain excludes the balloon form gear rotating drive gear 1922, a balloon form cam assembly rotating drive arm 1822 can be rotationally coupled to an adjacent balloon form rotating drive extension 1841 by any suitable rotational coupling, such as a combination of a balloon form cam assembly rotating drive arm 1822, a balloon form rotating assembly drive cam arm 1830, and a balloon form rotational drive arm 1842. The balloon form cam rotating drive component 1820 would rotate the adjacent balloon form rotating drive extension 1841, which in turn, would drive the chain or belt, which rotates the remaining balloon form rotating drive extensions 1841. In another example, synchronized stepper motors or any other suitable controlled motor can be employed. Each motor would be rotationally coupled directly or indirectly to the balloon form rotating bushing/bearing 1810, 1910.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

Reference Element Descriptions

| Ref. No. | Description |
|---|---|
| 100 | quick seal balloon fabrication form |
| 110 | fabrication manifold |
| 112 | fabrication manifold form surface |
| 114 | individual form transition member |
| 120 | balloon form member |
| 130 | balloon body bulb shaped mold segment |
| 140 | balloon neck mold segment |
| 142 | balloon neck mold segment longitudinal axis |
| 150 | adhesive dispensing segment |
| 152 | base adhesive control surface |
| 154 | angled adhesive control surface |
| 160 | adhesive dispensing aperture |
| 162 | adhesive primary delivery conduit |
| 164 | adhesive distribution delivery conduit |
| 170 | dispensed adhesive roll |
| 172 | adhesive staging segment |
| 174 | adhesive staging segment gap |
| 176 | adhesive exposing tensile force |
| 178 | adhesive bonding force |
| 180 | peripheral surface of the moldable adhesive cross sectioned profile |
| 182 | unfinished edge adhesive staging segment |
| 184 | expansion cavity adhesive staging segment |
| 190 | adhesive staging segment roller |
| 192 | lip bead roller |
| 200 | balloon |
| 210 | balloon gas retaining expansion cavity |
| 212 | balloon interior surface |
| 220 | tubular balloon neck segment |
| 221 | sealed, air entrapped neck segment |
| 222 | balloon unfinished lip |
| 224 | lip bead |
| 226 | lip bead adhesive receiving surface |
| 229 | tubular balloon neck unsealable length |
| 230 | pressurized inflating air |
| 232 | entrapped air |
| 280 | neck release air delivery system |
| 282 | neck release air delivery nozzle |
| 284 | neck release delivered air |
| 299 | compressed air delivery nozzle |
| 300 | first exemplary self-sealing balloon fabrication flow diagram |
| 301 | second exemplary self-sealing balloon fabrication flow diagram |
| 302 | self sealing balloon forming process initiation step |
| 310 | obtain balloon form step |
| 312 | dispense balloon sealing adhesive step |
| 314 | apply balloon material onto balloon form step |
| 316 | partially cure balloon material step |
| 318 | activate adhesive staging segment roller step |
| 320 | initiate formation of adhesive staging segment step |
| 322 | draw adhesive roll into adhesive staging segment step |
| 324 | finalizing formation of adhesive staging segment step |
| 326 | cure balloon material |
| 328 | separate balloon from balloon form step |
| 330 | activate lip bead roller step |
| 340 | self sealing balloon forming process termination step |
| 400 | self-sealing balloon inflation flow diagram |
| 402 | self sealing balloon inflation process initiation step |
| 410 | obtain self sealing balloon step |
| 412 | inflate balloon body segment step |
| 414 | determine desired inflation level step |
| 416 | pinch balloon neck segment step |
| 418 | apply tensile force to balloon neck segment step |
| 420 | expose adhesive material step |
| 422 | pinch adhesive staging segment to seal neck segment step |
| 424 | verify acceptable neck seal has been achieved step |
| 426 | attach string to neck step |
| 428 | display inflated balloon step |
| 440 | self sealing balloon inflation process termination step |
| 500 | adhesive composition presentation container |

-continued

Reference Element Descriptions

| Ref. No. | Description |
|---|---|
| 502 | adhesive composition containing surface |
| 570 | moldable adhesive composition |
| 571 | moldable adhesive composition bead |
| 590 | adhesive coating powder |
| 600 | self-sealing balloon |
| 610 | balloon gas retaining expansion cavity |
| 620 | tubular balloon neck segment |
| 622 | balloon unfinished lip |
| 624 | lip bead |
| 626 | lip bead adhesive receiving surface |
| 720 | balloon form member |
| 730 | balloon body bulb shaped mold segment |
| 740 | balloon neck mold segment |
| 750 | adhesive dispensing adapter |
| 752 | frustum shaped adapter body |
| 754 | adhesive adapter interior surface |
| 756 | adhesive adapter exterior surface |
| 760 | adhesive dispensing edge |
| 762 | adhesive storage volumetric space |
| 764 | adhesive dispensing passageway |
| 770 | moldable adhesive composition |
| 771 | applied moldable adhesive composition |
| 772 | adhesive staging segment |
| 780 | powder applying subassembly |
| 782 | powder applying mixing chamber |
| 784 | powder supply conduit |
| 786 | propellant supply conduit |
| 790 | surface protecting powder |
| 800 | self-sealing balloon |
| 810 | balloon gas retaining expansion cavity |
| 820 | tubular balloon neck segment |
| 822 | balloon unfinished lip |
| 824 | lip bead |
| 950 | adhesive dispensing adapter |
| 952 | frustum shaped adapter body |
| 953 | frustum shaped adapter body top panel |
| 954 | adhesive adapter interior surface |
| 956 | adhesive adapter exterior surface |
| 960 | adhesive dispensing orifice |
| 962 | adhesive storage volumetric space |
| 963 | supply line orifice |
| 964 | adhesive dispensing passageway |
| 966 | propellant/adhesive supply conduit |
| 968 | propellant/adhesive supply conduit passageway |
| 970 | moldable adhesive composition |
| 971 | applied moldable adhesive composition |
| 1000 | third exemplary self-sealing balloon fabrication flow diagram |
| 1002 | self sealing balloon forming process initiation step |
| 1010 | obtain balloon form step |
| 1012 | introduce adhesive adapter to balloon form step |
| 1014 | apply balloon material onto balloon form step |
| 1016 | partially cure balloon material step |
| 1018 | partially roll lip bead step |
| 1020 | dispense balloon sealing adhesive step |
| 1022 | optionally apply powder to exposed surface of adhesive step |
| 1030 | complete roll lip bead step |
| 1032 | cure balloon material |
| 1034 | separate balloon from balloon form step |
| 1040 | self sealing balloon forming process termination step |
| 1100 | self-sealing balloon inflation flow diagram |
| 1102 | self sealing balloon inflation process initiation step |
| 1110 | obtain self sealing balloon step |
| 1112 | inflate balloon body segment step |
| 1114 | determine desired inflation level step |
| 1116 | pinch balloon neck segment step |
| 1118 | partially unroll lip bead roll step |
| 1120 | expose adhesive material step |
| 1122 | pinch exposed moldable adhesive ring to seal neck segment step |
| 1124 | verify acceptable neck seal has been achieved step |
| 1126 | attach string to neck step |
| 1128 | display inflated balloon step |
| 1140 | self sealing balloon inflation process termination step |
| 1300 | sealing adhesive applicator assembly |
| 1310 | sealing adhesive applicator balloon neck support element |

-continued

Reference Element Descriptions

| Ref. No. | Description |
|---|---|
| 1312 | balloon neck support element, frustum shaped lead-in segment |
| 1314 | balloon neck support element, distal parallel shaped segment |
| 1315 | balloon neck support element, distal segment indicator |
| 1316 | balloon neck support element, central adhesive applicator segment |
| 1317 | balloon neck support element, proximal segment indicator |
| 1350 | adhesive applicator balloon neck sleeve element |
| 1352 | balloon neck sleeve element, frustum shaped lead-in segment |
| 1354 | balloon neck sleeve element, distal parallel shaped segment |
| 1356 | balloon neck sleeve element, interior cavity |
| 1359 | balloon neck sleeve element, interior cavity opening span |
| 1362 | balloon neck sleeve central support element |
| 1363 | balloon neck sleeve central support surface |
| 1364 | balloon neck sleeve rear support element |
| 1365 | balloon neck sleeve rear support surface |
| 1370 | unrolling neck upward motion |
| 1371 | unrolling neck downward motion |
| 1372 | applicator staging motion |
| 1373 | balloon neck support rotational motion |
| 1374 | applicator retraction motion |
| 1375 | sleeve staging motion |
| 1376 | balloon neck end sleeve seating motion |
| 1377 | initial sleeve retraction motion |
| 1378 | encasing formation balloon neck retention force |
| 1379 | continued sleeve retraction motion |
| 1380 | adhesive dispenser assembly |
| 1382 | adhesive dispenser |
| 1384 | adhesive supply conduit |
| 1386 | adhesive dispensing orifice |
| 1390 | adhesive |
| 1391 | dispensed adhesive |
| 1399 | dispensed adhesive span |
| 1400 | prefabricated self-sealing balloon |
| 1410 | balloon gas retaining expansion cavity |
| 1420 | tubular balloon neck segment |
| 1424 | lip bead |
| 1426 | lip bead adhesive receiving surface |
| 1428 | lip bead adhesive covering neck segment |
| 1500 | fourth exemplary self-sealing balloon fabrication flow diagram |
| 1502 | self sealing balloon forming process initiation step |
| 1510 | obtain adhesive application form step |
| 1512 | roll balloon neck onto adhesive application form step |
| 1514 | roll balloon neck onto adhesive application form in reverse direct step |
| 1516 | apply adhesive onto balloon neck interior surface step |
| 1518 | rotate adhesive applicator/adhesive applicator form step |
| 1520 | slide sleeve over adhesive step |
| 1522 | fold neck over sleeve step |
| 1524 | draw sleeve rearward step |
| 1526 | remove balloon from adhesive applicator form step |
| 1540 | self sealing balloon forming process termination step |
| 1600 | balloon sealing adhesive applicator assembly |
| 1640 | balloon form neck segment |
| 1649 | balloon form neck segment rotational axis |
| 1650 | balloon form neck adhesive receiving element |
| 1680 | adhesive dispenser assembly |
| 1682 | adhesive dispenser |
| 1684 | adhesive supply conduit |
| 1686 | adhesive dispensing passageway |
| 1688 | balloon form rotational motion |
| 1690 | sealing adhesive |
| 1691 | dispensed sealing adhesive |
| 1700 | balloon sealing adhesive applicator assembly |
| 1710 | adhesive applicator balloon neck support element |
| 1715 | balloon neck support element, distal segment indicator |
| 1717 | balloon neck support element, proximal segment indicator |
| 1720 | adhesive applicator balloon neck support element operating frame |
| 1722 | adhesive applicator balloon neck support element operating frame arm |
| 1724 | adhesive applicator balloon neck support element operating frame hub |
| 1726 | adhesive applicator balloon neck support element operating frame hub aperture |
| 1770 | balloon neck support element rotational motion |

-continued

Reference Element Descriptions

| Ref. No. | Description |
|---|---|
| 1772 | balloon neck support element operating frame rotational motion |
| 1800 | balloon form cam rotating assembly |
| 1810 | balloon form rotating bushing/bearing |
| 1820 | balloon form cam rotating drive component |
| 1822 | balloon form cam assembly rotating drive arm |
| 1824 | rotating drive arm mechanical securing member |
| 1830 | balloon form rotating assembly drive cam arm |
| 1832 | balloon form rotating assembly drive cam spacer |
| 1834 | balloon form rotating assembly drive cam axle/pin |
| 1836 | balloon form rotating assembly drive cam c-clip |
| 1841 | balloon form rotating drive extension |
| 1842 | balloon form rotational drive arm |
| 1844 | balloon form rotational drive arm securing member |
| 1850 | balloon form rotating assembly drive synchronizing arm |
| 1852 | balloon form rotating assembly drive synchronizing arm spacer |
| 1854 | balloon form rotating assembly drive synchronizing arm axle/pin |
| 1856 | balloon form rotating assembly drive synchronizing arm c-clip |
| 1900 | balloon form gear rotating assembly |
| 1910 | balloon form rotating bushing/bearing |
| 1920 | balloon form gear rotating drive component |
| 1922 | balloon form gear rotating drive gear |
| 1924 | balloon form gear rotating drive gear securing member |
| 1932 | balloon form gear rotating synchronizing gear |
| 1934 | balloon form gear rotating synchronizing gear securing member |
| 1941 | balloon form rotating drive extension |
| 1952 | balloon form rotational drive gear |
| 1954 | balloon form rotational drive gear securing member |

What is claimed is:

1. A method of fabricating a self sealing balloon assembly, the method comprising steps of:

applying an adhesive material to an exterior of a balloon neck mold segment of a balloon form member using an adhesive applicator, wherein the adhesive applicator applies the adhesive using a fiberization process to form an adhesive ring about a circumference of the balloon neck mold segment;

applying a balloon fabricating material to an exterior surface of the balloon form member creating the formed balloon, the formed balloon having a tubular balloon neck segment extending in fluid communication between a balloon unfinished lip and a balloon gas retaining expansion cavity, covering the adhesive ring; and removing the formed balloon and adhesive ring as a self sealing balloon assembly from the balloon form member.

2. A method of fabricating a self sealing balloon assembly as recited in claim 1, the method further comprising a step of:

using an adhesive applicator located externally to the balloon neck mold segment to apply the adhesive material to the exterior of the balloon neck mold segment.

3. A method of fabricating a self sealing balloon assembly as recited in claim 1, the method further comprising a step of:

using an adhesive applicator comprising a plurality of adhesive dispensing passageways to apply the adhesive material to the exterior of the balloon neck mold segment.

4. A method of fabricating a self sealing balloon assembly as recited in claim 1, the method further comprising a step of:

configuring the tubular balloon neck segment to substantially encase the moldable adhesive ring within a section of the tubular balloon neck segment to ensure one area of the moldable adhesive ring and a second area of the moldable adhesive ring do not join with one another until desired by a user.

5. A method of fabricating a self sealing balloon assembly as recited in claim 1, the method further comprising a step of:

rotating the balloon form member during the step of applying the adhesive.

6. A method of fabricating a self sealing balloon assembly as recited in claim 1, the balloon neck mold segment further comprising an annular groove, wherein the step of applying the adhesive is accomplished by applying the adhesive to the annular groove.

7. A method of fabricating a self sealing balloon assembly as recited in claim 1, the method further comprising a step of:

using rollers to form at least one of:

(a) a lip bead, and (b) the tubular balloon neck segment to substantially encase the moldable adhesive ring within a section of the tubular balloon neck segment to ensure one area of the moldable adhesive ring and a second area of the moldable adhesive ring do not join with one another until desired by a user.

8. A method of fabricating a self sealing balloon assembly as recited in claim 1, the method further comprising a step of:

applying airflow towards an interface between a balloon unfinished lip and the exterior surface of the balloon neck mold segment during at least one of:

(a) a step of forming a lip bead, (b) a step of configuring the tubular balloon neck segment to substantially encase the moldable adhesive ring within a section of the tubular balloon neck segment to ensure one area of the moldable adhesive ring and a second area of the moldable adhesive ring do not join with one another until desired by a user, and (c) the step of removing the formed balloon and adhesive ring as a self sealing balloon assembly from the balloon form member.

9. A method of fabricating a self sealing balloon assembly, the method comprising steps of:

applying an adhesive material to an exterior of a balloon neck mold segment of a balloon form member using an adhesive applicator while the balloon neck mold segment is rotating about an elongated axis of the balloon form member to form an adhesive ring about a circumference of the balloon neck mold segment;

applying a balloon fabricating material to an exterior surface of the balloon form member creating the formed balloon, the formed balloon having a tubular balloon neck segment extending in fluid communication between a balloon unfinished lip and a balloon gas retaining expansion cavity, covering the adhesive ring; and removing the formed balloon and adhesive ring as a self sealing balloon assembly from the balloon form member.

10. A method of fabricating a self sealing balloon assembly as recited in claim 9, the method further comprising a steps of:

replicating the process on a plurality of balloon form members; and rotating the plurality of balloon form members.

11. A method of fabricating a self sealing balloon assembly as recited in claim 9, the method further comprising a steps of:

replicating the process on a plurality of balloon form members; and rotating the plurality of balloon form members using at least one of:

(a) a cam arrangement, (b) a gear arrangement, (c) a belt arrangement, (d) a chain arrangement, (e) a motor directly engaging the respective balloon form member, (f) a motor engaging the respective balloon form member via at least one gear, (g) a motor engaging the respective balloon form member via a belt, (h) a motor engaging the respective balloon form member via a chain, (i) a motor engaging the respective balloon form member via at least one rotating drive arm.

12. A method of fabricating a self sealing balloon assembly as recited in claim 9, the method further comprising a steps of:

simultaneously replicating the process on a plurality of balloon form members; and simultaneously rotating the plurality of balloon form members in a synchronized manner.

13. A method of fabricating a self sealing balloon assembly as recited in claim 9, wherein the adhesive applicator applies the adhesive using a fiberization process to form the adhesive ring.

14. A method of fabricating a self sealing balloon assembly as recited in claim 9, the method further comprising a step of:

using an adhesive applicator located externally to the balloon neck mold segment to apply the adhesive material to the exterior of the balloon neck mold segment.

15. A method of fabricating a self sealing balloon assembly as recited in claim 9, the method further comprising a step of:

using an adhesive applicator comprising a plurality of adhesive dispensing passageways to apply the adhesive material to the exterior of the balloon neck mold segment.

16. A method of fabricating a self sealing balloon assembly as recited in claim 9, the method further comprising a step of:

configuring the tubular balloon neck segment to substantially encase the moldable adhesive ring within a section of the tubular balloon neck segment to ensure one area of the moldable adhesive ring and a second area of the moldable adhesive ring do not join with one another until desired by a user.

17. A method of fabricating a self sealing balloon assembly as recited in claim 9, the method further comprising a step of:

rotating the balloon form member during the step of applying the adhesive.

18. A method of fabricating a self sealing balloon assembly as recited in claim 9, the balloon neck mold segment further comprising an annular groove, wherein the step of applying the adhesive is accomplished by applying the adhesive to the annular groove.

19. A method of fabricating a self sealing balloon assembly as recited in claim 9, the method further comprising a step of:

applying airflow towards an interface between a balloon unfinished lip and the exterior surface of the balloon neck mold segment during at least one of:

(a) a step of rotating the balloon neck mold segment, (b) a step of forming a lip bead, (c) a step of configuring the tubular balloon neck segment to substantially encase the moldable adhesive ring within a section of the tubular balloon neck segment to ensure one area of the moldable adhesive ring and a second area of the moldable adhesive ring do not join with one another until desired by a user, and (d) the step of removing the formed balloon and adhesive ring as a self sealing balloon assembly from the balloon form member.

20. A method of fabricating a self sealing balloon assembly as recited in claim 9, the method further comprising a step of:

using rollers to form at least one of:

(a) a lip bead, and (b) the tubular balloon neck segment to substantially encase the moldable adhesive ring within a section of the tubular balloon neck segment to ensure one area of the moldable adhesive ring and a second area of the moldable adhesive ring do not join with one another until desired by a user.

* * * * *